US012235033B2

(12) United States Patent
Kim et al.

(10) Patent No.: US 12,235,033 B2
(45) Date of Patent: Feb. 25, 2025

(54) ICE MAKER AND REFRIGERATOR

(71) Applicant: LG Electronics Inc., Seoul (KR)

(72) Inventors: Yonghyun Kim, Seoul (KR); Hyunji Park, Seoul (KR); Jinil Hong, Seoul (KR); Seunggeun Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 338 days.

(21) Appl. No.: 16/793,817

(22) Filed: Feb. 18, 2020

(65) Prior Publication Data

US 2020/0300527 A1 Sep. 24, 2020

(30) Foreign Application Priority Data

Mar. 22, 2019 (KR) ..... 10-2019-0033167

(51) Int. Cl.
*F25C 1/246* (2018.01)

(52) U.S. Cl.
CPC ..... *F25C 1/246* (2013.01); *F25C 2305/0221* (2021.08); *F25C 2400/06* (2013.01); *F25C 2400/10* (2013.01)

(58) Field of Classification Search
CPC .. F25C 1/246; F25C 2400/06; F25C 2400/10; F25C 2305/022; F25C 1/04; F25C 1/18; F25C 1/24; F25C 1/243; F25C 5/08; F25C 5/187; F25C 2400/08; F25C 2305/0221; F25D 17/065; F25D 2317/061; F25D 2317/063; F25D 23/12; F25D 17/04; F25D 23/028
See application file for complete search history.

(56) References Cited

U.S. PATENT DOCUMENTS

| | | | | |
|---|---|---|---|---|
| 8,943,852 | B2 * | 2/2015 | Lee et al. | F25C 1/00 62/420 |
| 2006/0086134 | A1 * | 4/2006 | Voglewede et al. | F25C 1/00 62/351 |
| 2008/0264082 | A1 | 10/2008 | Tikhonov et al. | |
| 2010/0147011 | A1 | 6/2010 | Kang et al. | |
| 2010/0313594 | A1 | 12/2010 | Lee et al. | |

(Continued)

FOREIGN PATENT DOCUMENTS

| | | | | |
|---|---|---|---|---|
| CN | 100595498 C | * | 11/2006 | F25C 1/04 |
| CN | 101932895 | | 12/2010 | |

(Continued)

OTHER PUBLICATIONS

CN-102878743-A Translation (Year: 2013).*

(Continued)

*Primary Examiner* — Elizabeth J Martin
*Assistant Examiner* — Dario Antonio Deleon
(74) *Attorney, Agent, or Firm* — Fish & Richardson P.C.

(57) ABSTRACT

An ice maker includes first and second trays configured to form a plurality of ice chambers configured to make ice, an upper case including a cool air hole through which cool air passes, and a tray opening configured to allow the first tray to contact the cool air passing through the cool air hole, a driver configured to move the second tray, and a connector configured to transfer power of the driver to the second tray, wherein the upper case further includes the cool air guide configured to guide the cool air passing through the cool air hole toward the tray opening.

23 Claims, 32 Drawing Sheets

(56) References Cited

U.S. PATENT DOCUMENTS

| | | | | |
|---|---|---|---|---|
| 2011/0259036 | A1 | 10/2011 | Lim et al. | |
| 2013/0014535 | A1 | 1/2013 | Son et al. | |
| 2013/0014536 | A1 | 1/2013 | Son et al. | |
| 2013/0081412 | A1* | 4/2013 | Son et al. | F25C 1/10 62/73 |
| 2014/0000304 | A1 | 1/2014 | Kim et al. | |
| 2014/0165618 | A1 | 6/2014 | Culley et al. | |
| 2014/0182325 | A1 | 7/2014 | Lee et al. | |
| 2016/0245574 | A1 | 8/2016 | Jeong et al. | |
| 2016/0258663 | A1 | 9/2016 | Visin | |
| 2017/0292773 | A1* | 10/2017 | Yang | F25C 5/00 |
| 2018/0045448 | A1* | 2/2018 | Dirnberger et al. | F25C 1/22 |
| 2019/0011166 | A1* | 1/2019 | Bertolini et al. | F25C 1/24 |
| 2019/0093936 | A1* | 3/2019 | Saito et al. | F25C 5/22 |
| 2019/0093937 | A1* | 3/2019 | Saito et al. | F25C 5/187 |

FOREIGN PATENT DOCUMENTS

| | | | | |
|---|---|---|---|---|
| CN | 102224386 | | 10/2011 | |
| CN | 102235797 | | 11/2011 | |
| CN | 102428330 | | 4/2012 | |
| CN | 102878743 | | 1/2013 | |
| CN | 102878743 | A * | 1/2013 | F25C 1/04 |
| CN | 102878744 | | 1/2013 | |
| CN | 103033011 | | 4/2013 | |
| CN | 103528303 | | 1/2014 | |
| CN | 104329843 | | 2/2015 | |
| CN | 105180584 | | 12/2015 | |
| CN | 205119615 | | 3/2016 | |
| CN | 106257214 | | 12/2016 | |
| CN | 106642861 | | 5/2017 | |
| CN | 106766453 | | 5/2017 | |
| CN | 111735245 | | 10/2020 | |
| CN | 114909834 | | 8/2022 | |
| CN | 114992934 | | 9/2022 | |
| CN | 114992935 | | 9/2022 | |
| EP | 2679939 | | 1/2014 | |
| GB | 355122 | | 8/1931 | |
| JP | H05-223291 | | 8/1993 | |
| JP | 2003114072 | | 4/2003 | |
| JP | 2003148842 | | 5/2003 | |
| JP | 2004053092 | | 2/2004 | |
| JP | 2004-271047 | A | 9/2004 | |
| JP | 2006105479 | | 4/2006 | |
| JP | 2006250489 | * | 9/2006 | F25C 1/24 |
| JP | 2007-057149 | | 3/2007 | |
| KR | 10-1850918 | | 5/2018 | |
| WO | WO 2010/123175 | | 10/2010 | |
| WO | WO 2012/124075 | | 9/2012 | |
| WO | WO 2017/176073 | | 10/2017 | |

OTHER PUBLICATIONS

JP-2006250489 Translation (Year: 2006).*
CN-100595498-C Translation (Year: 2006).*
CN Office Action in Chinese Appln. No. 201911327653.X, dated Jun. 3, 2021, 14 pages (with English translation).
Extended European Search Report in European Appln. No. 201555599.2, dated Aug. 10, 2020, 8 pages.
Office Action in Chinese Appln. No. 202210563868.7, dated Apr. 29, 2023, 9 pages.
Office Action in Chinese Appln. No. 202210564929.1, dated Apr. 22, 2019, 8 pages.
Office Action in Chinese Appln. No. 202210564970.9, dated Apr. 26, 2023, 8 pages.
Office Action in Australian Appln. No. 2022221479, mailed on Oct. 31, 2023, 6 pages.
Office Action in Chinese Appln. No. 202210563868.7, mailed on Mar. 13, 2024, 14 pages (with English translation).
Office Action in Chinese Appln. No. 202210564929.1, mailed on Mar. 16, 2024, 16 pages (with English translation).

* cited by examiner

ICE MAKER AND REFRIGERATOR

CROSS-REFERENCE TO RELATED APPLICATION

This application claims the benefit of priority to Korean Patent Application No. 10-2019-0033167, filed in the Korean Intellectual Property Office on Mar. 22, 2019, the entire contents of which are incorporated herein by reference.

BACKGROUND

The present disclosure relates to an ice maker and a refrigerator.

In general, refrigerators are home appliances for storing foods at a low temperature in a storage space that is covered by a door.

The refrigerator may cool the inside of the storage space by using cold air to store the stored food in a refrigerated or frozen state.

Generally, an ice maker for making ice is provided in the refrigerator.

The ice maker is constructed so that water supplied from a water supply source or a water tank is accommodated in a tray to make ice.

Also, the ice maker is constructed to transfer the made ice from the ice tray in a heating manner or twisting manner.

As described above, the ice maker through which water is automatically supplied, and the ice automatically transferred may be opened upward so that the mode ice is pumped up.

As described above, the ice made in the ice maker may have at least one flat surface such as crescent or cubic shape.

When the ice has a spherical shape, it is more convenient to ice the ice, and also, it is possible to provide different feeling of use to a user. Also, even when the made ice is stored, a contact area between the ice cubes may be minimized to minimize a mat of the ice cubes.

The cited reference, Korean Patent No. 10-1850918 discloses an ice maker.

The ice maker of the cited reference includes an upper tray on which a plurality of hemispherical upper cells are arranged and which includes a pair of link guides extending upward from opposite lateral ends, a lower tray on which a plurality of hemispherical lower cells are arranged and which is rotatably connected to the upper tray, a rotation axis connected to rear ends of the lower tray and the upper tray and configured to rotate the lower tray with respect to the upper tray, a pair of links having one end connected to the lower tray and the other end connected to the link guide, and an upper ejecting pin assembly which has opposite ends respectively connected to the pair of links while being inserted into the link guide and ascends and descends along with the link.

In the cited reference, although spherical ice is generated by the hemispherical upper cell and the hemispherical lower cell, the ice is simultaneously generated by the upper cell and the lower cell, and thus bubbles included in water are dispersed in water rather than being completely discharged, and accordingly, generated ice is disadvantageously opaque.

In addition, a plurality of cells are arranged in a line, and thus heat transfer between cool air and cells positioned at opposite ends of the plurality of cells is maximized. In this case, ice is rapidly generated in cells positioned at the opposite ends of the plurality of cells, and thus water is moved to cells positioned between the opposite ends by expansive force when water at the opposite ends of the cells is phase-changed to ice and there is a problem a spherical shape of ice is deformed.

SUMMARY

The present embodiment provides an ice maker and a refrigerator in which cool air is concentrated into an upper side of an ice chamber to equalize speeds at which ices are generated in a plurality of ice chambers.

The present embodiment provides an ice maker and a refrigerator for making transparent ice.

The present embodiment provides an ice maker and a refrigerator for equalizing the transparency of ice irrespective of a type of a refrigerator with an ice maker installed therein.

The present embodiment provides an ice maker and a refrigerator for preventing a portion at which a driver for rotating a lower tray is installed from being deformed during a rotation procedure in which the lower tray repeatedly reciprocates.

The present embodiment provides an ice maker and a refrigerator for preventing a lower tray from interfering with an upper tray during a rotation procedure of the lower tray.

The present embodiment provides a refrigerator including the aforementioned ice maker.

According to an embodiment, an ice maker includes first and second trays configured to form a plurality of ice chambers configured to make ice, and an upper case including a cool air hole through which cool air passes, and a tray opening configured to allow the first tray to contact the cool air passing through the cool air hole.

The upper case may further include the cool air guide configured to guide the cool air passing through the cool air hole toward the tray opening.

The second tray may be disposed below the first tray, and a portion of the first tray may penetrate the tray opening.

The first tray may include a plurality of upper openings configured to guide the cool air to the plurality of ice chambers.

The plurality of ice chambers may be arranged in a line in a direction to be away from the cool air hole.

The cool air guide may include a first vertical guide and a second vertical guide spaced apart from the first vertical guide.

The first vertical guide and the second vertical guide may form a guidance path configured to guide the cool air passing through the cool air hole toward the tray opening.

An upper end of the first and second vertical guides may be positioned higher than the tray opening.

The upper end of each of the first and second vertical guides may be positioned at the same height or positioned higher than an upper opening of the first tray.

A cross-sectional area of at least a portion of the guidance path may be reduced in a direction away from the cool air hole.

A first imaginary line that bisects a horizontal length of the cool air hole and extends in a horizontal direction, and a second imaginary line that connects centers of the plurality of ice chambers and extends in a horizontal direction may be spaced apart from each other.

The second imaginary line may penetrate the first vertical guide after passing along the guidance path.

One end of the first vertical guide may be positioned at an opposite side to the second imaginary line based on the first imaginary line, and the plurality of ice chambers may include a first ice chamber closest to the cool air hole, and a second ice chamber adjacent to the first ice chamber.

Other end of the first vertical guide may be positioned closer to an upper opening of the second ice chamber than an upper opening of the first ice chamber.

The first vertical guide may extend to be rounded in a horizontal direction from the one end toward the other end.

One end of the second vertical guide may be positioned at an opposite side to the one end of the first vertical guide in the cool air hole, and at least a portion of the first ice chamber may be positioned between other end of the second vertical guide and the other end of the first vertical guide.

The ice maker may further include a driver configured to move the second tray, and a connector configured to transfer power of the driver to the second tray.

The upper case may further include an through-opening that the connector penetrates.

The cool air guide may guide a flow of cool air to allow the cool air passing through the cool air hole to flow toward the plurality of ice chambers before flowing toward the through-opening.

The through-opening may include a first through-opening positioned adjacent to the cool air hole, and a second through-opening spaced apart from the first through-opening. At least a portion of the tray opening may be positioned between the first through-opening and the second through-opening.

The second vertical guide may be positioned closer to the first through-opening than the first vertical guide.

The cool air guide may further include a horizontal guide configured to guide the cool air passing through the cool air hole. The horizontal guide may extend from a position that is the same or is lower than a lowermost point of the cool air hole.

According to another embodiment, a refrigerator includes a storage compartment configured to store a food material, and an ice maker configured to phase-change water of an ice chamber to ice by cool air supplied to the storage compartment.

The ice maker may include first and second trays configured to form a plurality of ice chambers, and an upper case configured to support the first tray.

The plurality of ice chambers may be arranged in a line in a direction to be away from a cool air hole. The upper case may include the cool air hole through which cool air passes, and a cool air guide configured to guide the cool air passing through the cool air hole toward the plurality of ice chambers.

The second tray may be disposed below the first tray, and the upper case may include a tray opening that the first tray penetrates. The cool air guide may guide the cool air toward the tray opening.

DETAILED DESCRIPTION OF THE EMBODIMENTS

Figure 1:
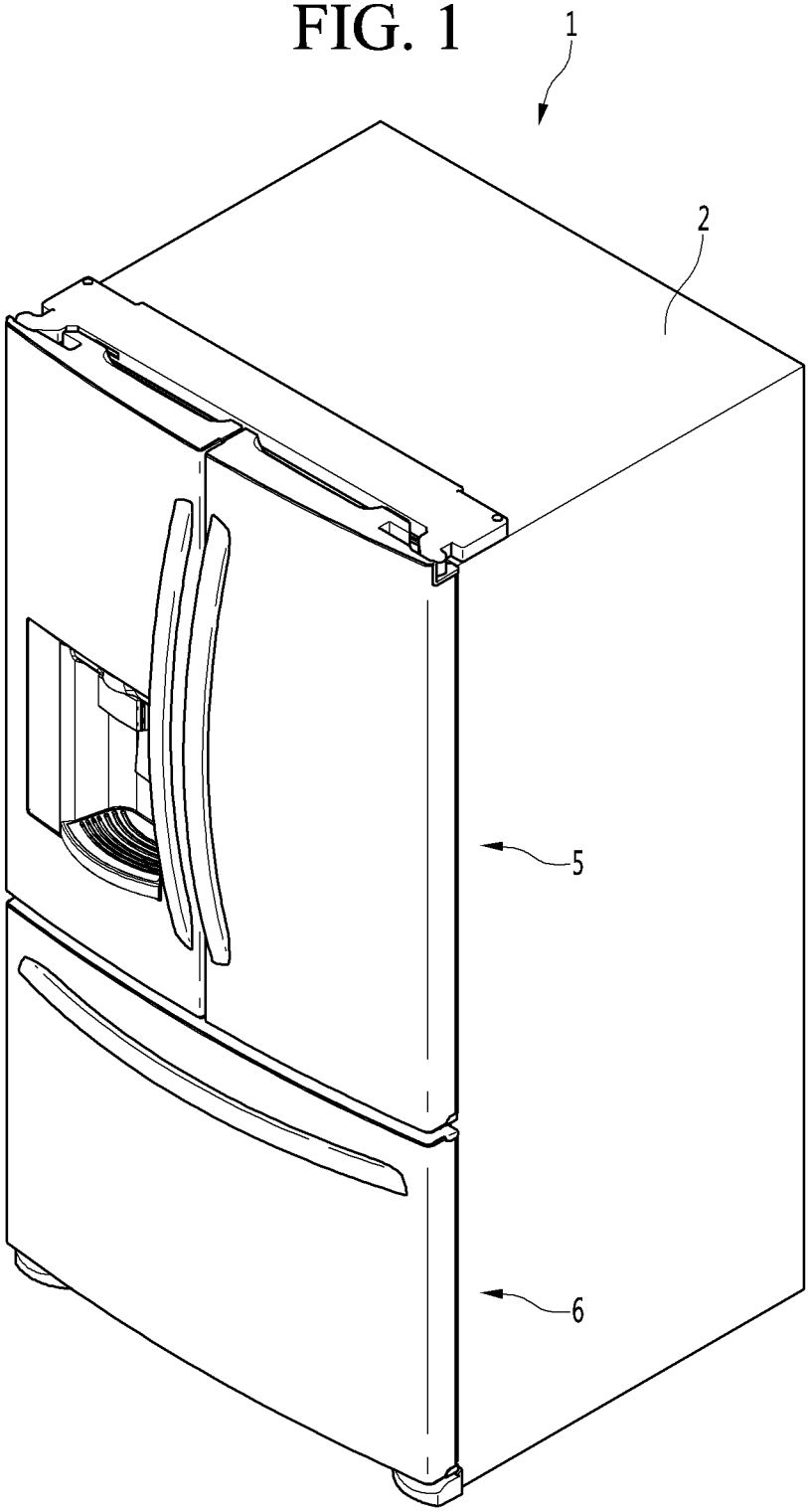
FIG. 1 is a perspective view of a refrigerator according to an embodiment.
Figure 2:
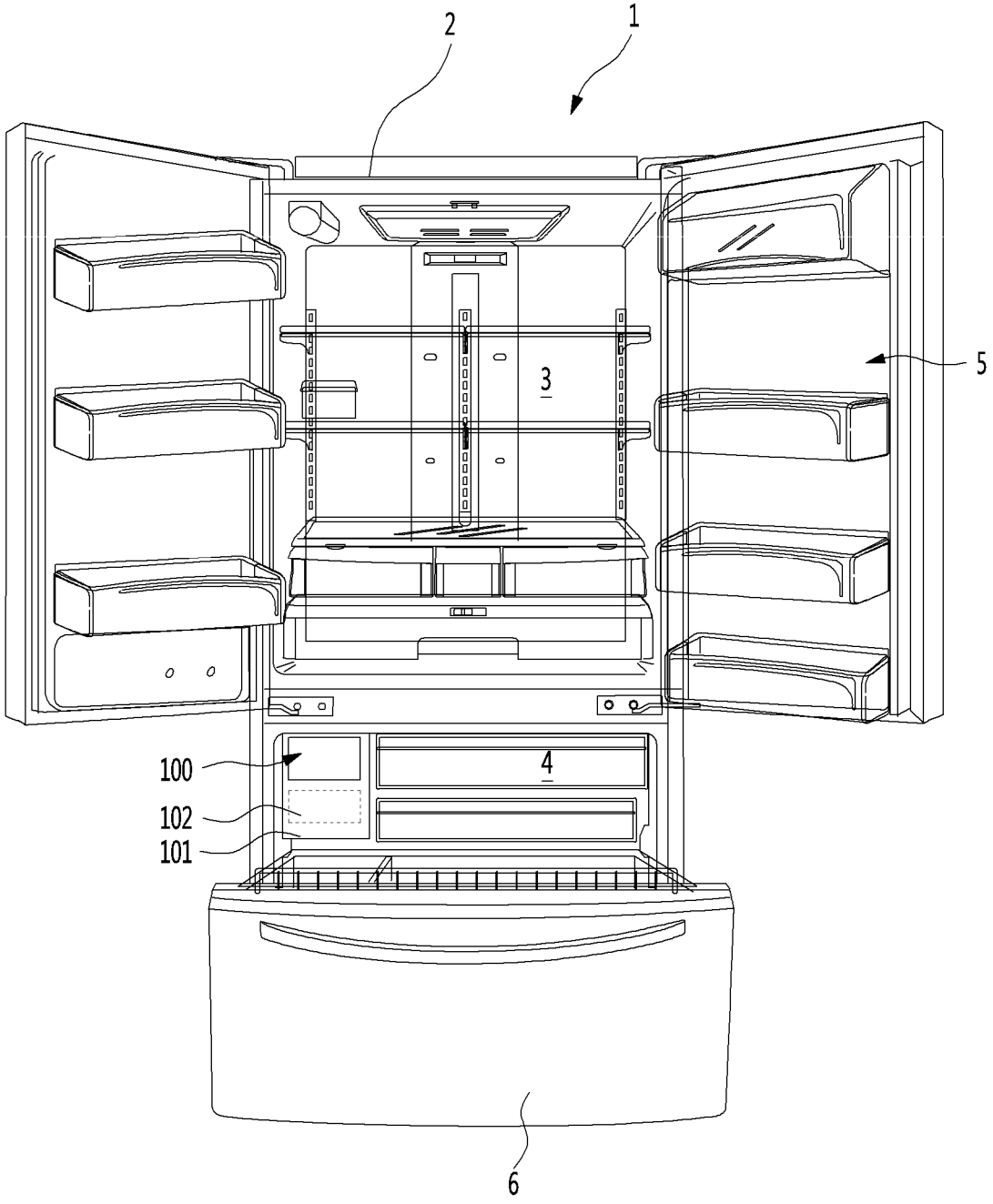
FIG. 2 is a view illustrating a state in which a door of the refrigerator of FIG. 1 is opened.

FIG. 1 is a perspective view of a refrigerator according to an embodiment, and FIG. 2 is a view illustrating a state in which a door of the refrigerator of FIG. 1 is opened.

Referring to FIGS. 1 and 2, a refrigerator 1 according to an embodiment may include a cabinet 2 defining a storage space and a door that opens and closes the storage space.

In detail, the cabinet 2 may define the storage space that is vertically divided by a barrier. Here, a refrigerating compartment 3 may be defined at an upper side, and a freezing compartment 4 may be defined at a lower side.

Accommodation members such as a drawer, a shelf, a basket, and the like may be provided in the refrigerating compartment 3 and the freezing compartment 4.

The door may include a refrigerating compartment door 5 opening/closing the refrigerating compartment 3 and a freezing compartment door 6 opening/closing the freezing compartment 4.

The refrigerating compartment door 5 may be constituted by a pair of left and right doors and be opened and closed through rotation thereof. Also, the freezing compartment door 6 may be inserted and withdrawn in a drawer manner.

Alternatively, the arrangement of the refrigerating compartment 3 and the freezing compartment 4 and the shape of the door may be changed according to kinds of refrigerators, but are not limited thereto. For example, the embodiments may be applied to various kinds of refrigerators. For example, the freezing compartment 4 and the refrigerating compartment 3 may be disposed at left and right sides, or the freezing compartment 4 may be disposed above the refrigerating compartment 3.

An ice maker 100 may be provided in the freezing compartment 4. The ice maker 100 is constructed to make ice by using supplied water. Here, the ice may have a spherical shape.

Also, an ice bin 102 in which the ice is stored after being transferred from the ice maker 100 may be further provided below the ice maker 100.

The ice maker 100 and the ice bin 102 may be mounted in the freezing compartment 4 in a state of being respectively mounted in separate housings 101.

The freezing compartment 4 may include a duct (not shown) for supplying cool air to the ice maker 100. Air discharged from the duct may flow in the ice maker 100 and may then flow in the freezing compartment 4.

A user may open the refrigerating compartment door 6 to approach the ice bin 102, thereby obtaining the ice.

In another example, a dispenser for dispensing purified water or the made ice to the outside may be provided in the refrigerating compartment door 5.

Also, the ice made in the ice maker 100 or the ice stored in the ice bin 102 after being made in the ice maker 100 may be transferred to the dispenser by a transfer unit. Thus, the user may obtain the ice from the dispenser.

Hereinafter, the ice maker will be described in detail with reference to the accompanying drawings.

Figure 3:
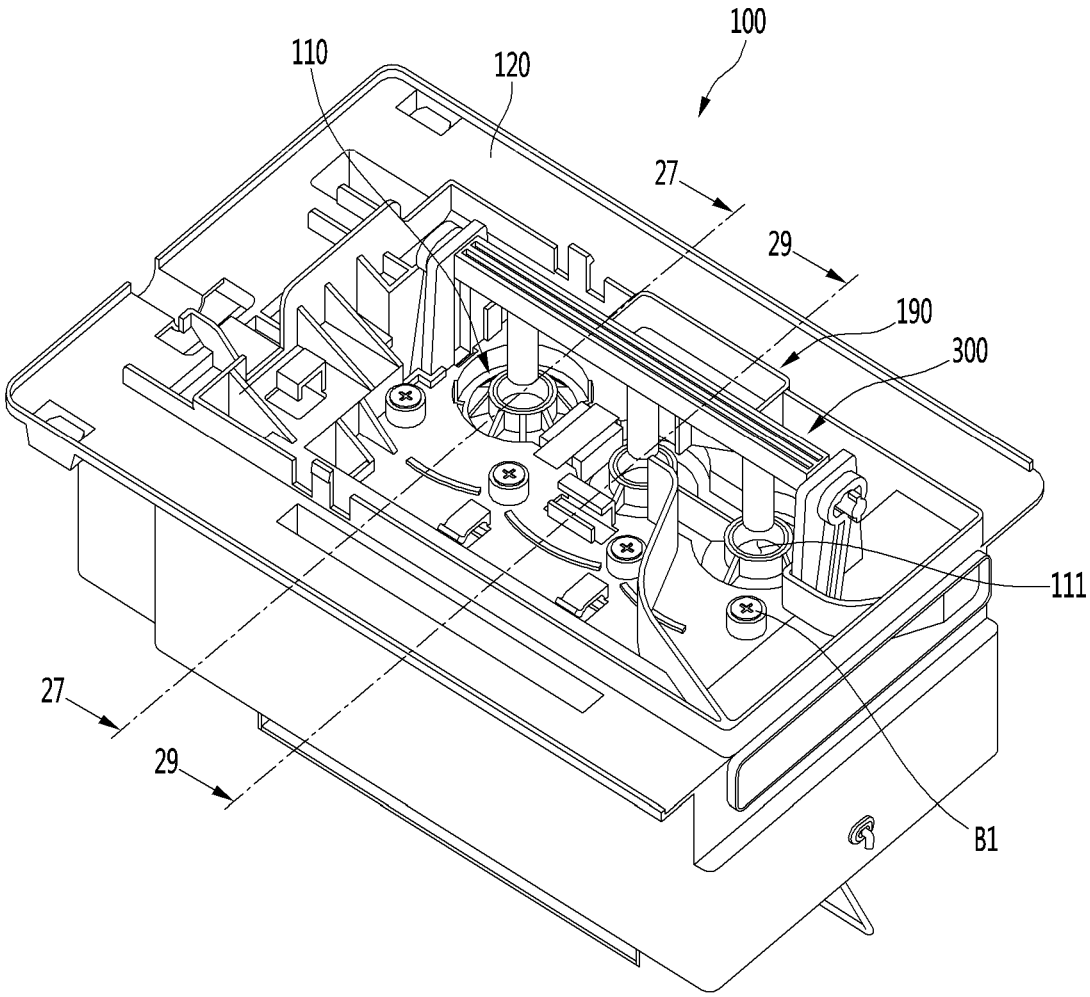
FIG. 3 is a perspective view of an ice maker viewed from above according to an embodiment.
Figure 4:
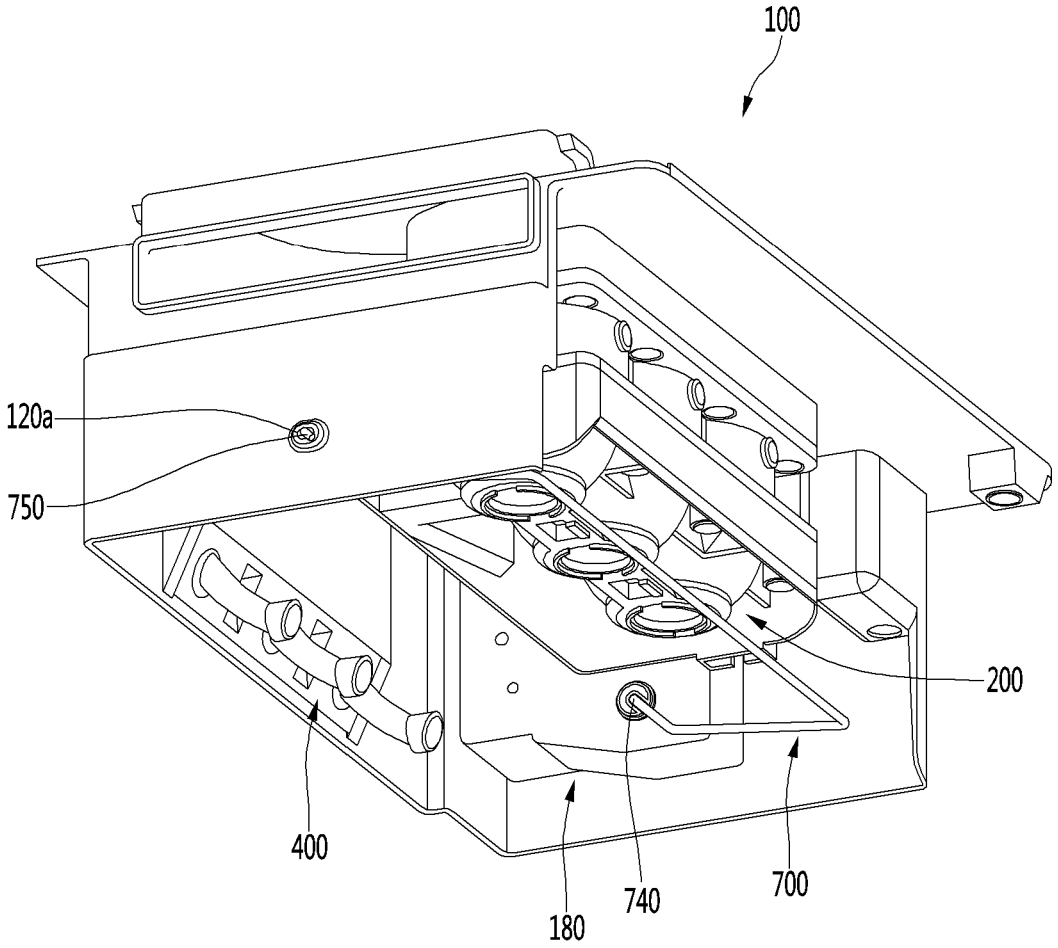
FIG. 4 is a perspective view of an ice maker viewed from below according to an embodiment.
Figure 5:
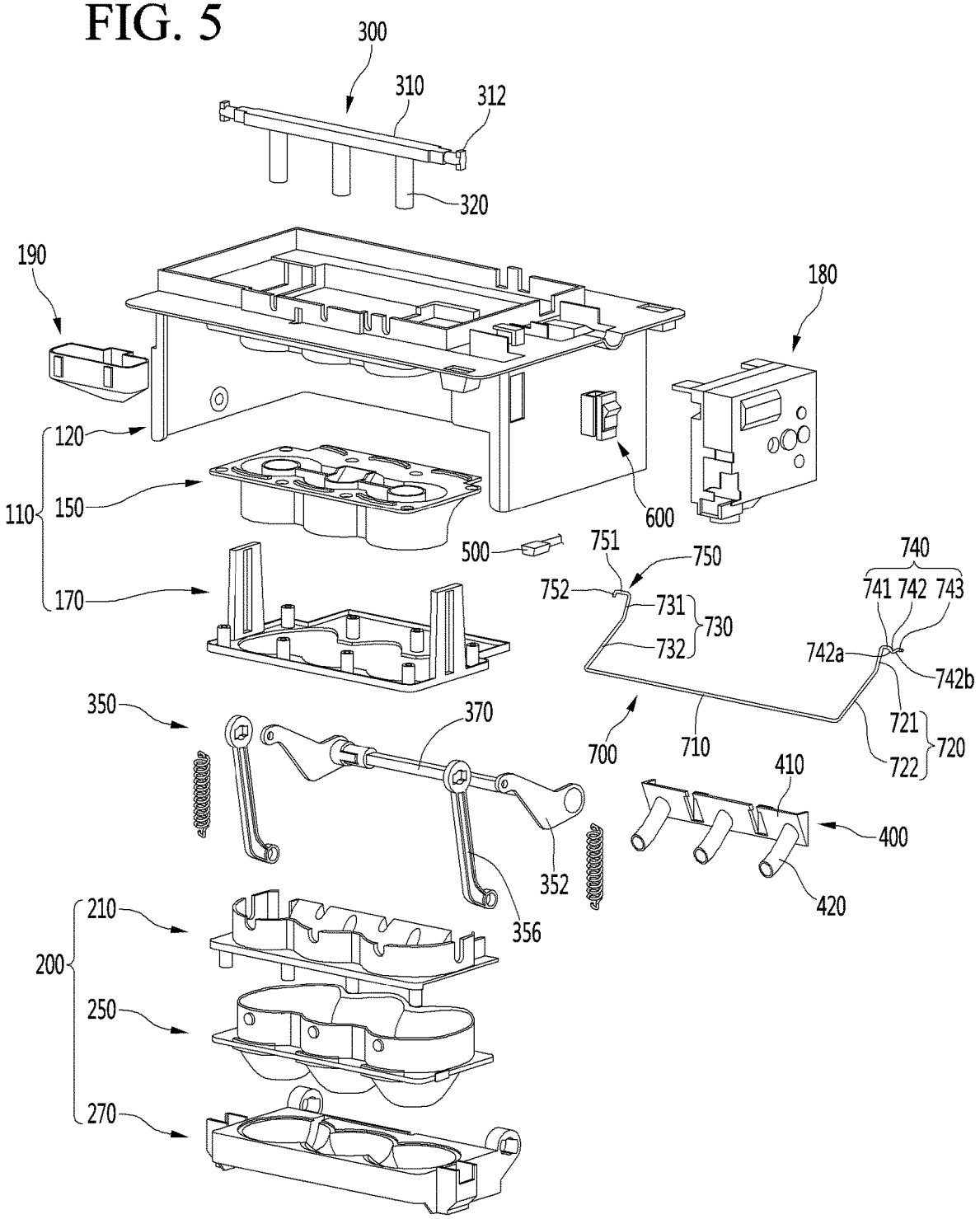
FIG. 5 is an exploded perspective view of an ice maker according to an embodiment.

FIG. 3 is a perspective view of an ice maker viewed from above according to an embodiment. FIG. 4 is a perspective view of an ice maker viewed from below according to an embodiment. FIG. 5 is an exploded perspective view of an ice maker according to an embodiment.

Referring to FIGS. 3 to 5, the ice maker 100 may include an upper assembly 110 and a lower assembly 200.

The lower assembly 200 may movable with respect to the upper assembly 110. For example, the lower assembly 200 may be connected to be rotatable with respect to the upper assembly 110.

In a state in which the lower assembly 200 contacts the upper assembly 110, the lower assembly 200 together with the upper assembly 110 may make spherical ice.

That is, the upper assembly 110 and the lower assembly 200 may define an ice chamber 111 for making the spherical ice. The ice chamber 111 may have a chamber having a substantially spherical shape.

The upper assembly 110 and the lower assembly 200 may define a plurality of ice chambers 111.

Hereinafter, a structure in which three ice chambers are defined by the upper assembly 110 and the lower assembly 200 will be described as an example, and also, the embodiments are not limited to the number of ice chambers 111.

In the state in which the ice chamber 111 is defined by the upper assembly 110 and the lower assembly 200, water is supplied to the ice chamber 111 through a water supply part 190.

The water supply part 190 is coupled to the upper assembly 110 to guide water supplied from the outside to the ice chamber 111.

After the ice is made, the lower assembly 200 may rotate in a forward direction. Thus, the spherical ice made between the upper assembly 110 and the lower assembly 200 may be separated from the upper assembly 110 and the lower assembly 200.

The ice maker 100 may further include a driver 180 so that the lower assembly 200 is rotatable with respect to the upper assembly 110.

The driver 180 may include a driving motor and a power transmission part for transmitting power of the driving motor to the lower assembly 200. The power transmission part may include one or more gears.

The driving motor may be a bi-directional rotatable motor. Thus, the lower assembly 200 may rotate in both directions.

The ice maker 100 may further include an upper ejector 300 so that the ice is capable of being separated from the upper assembly 110.

The upper ejector 300 may be constructed so that the ice closely attached to the upper assembly 110 is separated from the upper assembly 110.

The upper ejector 300 may include an ejector body 310 and one or more upper ejecting pins 320 extending in a direction crossing the ejector body 310.

The upper ejecting pins 320 may be provided in the same number of ice chambers 111.

A separation prevention protrusion 312 for preventing a connector 350 from being separated in the state of being coupled to the connector 350 that will be described later may be provided on each of both ends of the ejector body 310.

For example, the pair of separation prevention protrusions 312 may protrude in opposite directions from the ejector body 310.

While the upper ejecting pin 320 passing through the upper assembly 110 and inserted into the ice chamber 111, the ice within the ice chamber 111 may be pressed.

The ice pressed by the upper ejecting pin 320 may be separated from the upper assembly 110.

Also, the ice maker 100 may further include a lower ejector 400 so that the ice closely attached to the lower assembly 200 is capable of being separated.

The lower ejector 400 may press the lower assembly 200 to separate the ice closely attached to the lower assembly 200 from the lower assembly 200. For example, the lower ejector 400 may be fixed to the upper assembly 110.

The lower ejector 400 may include an ejector body 410 and one or more lower ejecting pins 420 protruding from the ejector body 410. The lower ejecting pins 420 may be provided in the same number of ice chambers 111.

While the lower assembly 200 rotates to transfer the ice, rotation force of the lower assembly 200 may be transmitted to the upper ejector 300.

For this, the ice maker 100 may further include a connector 350 connecting the lower assembly 200 to the upper ejector 300. The connector 350 may include one or more links.

For example, the connector 350 may include a first link 352 for rotating the lower support 270, and a second link 356 connected to the lower support 270 and configured to transfer rotational force of the lower support 270 to the upper ejector 300 when the lower support 270 rotates.

For example, when the lower assembly 200 rotates in one direction, the upper ejector 300 may descend by the connector 350 to allow the upper ejector pin 320 to press the ice of the ice chamber 111.

On the other hand, when the lower assembly 200 rotates in the other direction, the upper ejector 300 may ascend by the connector 350 to return to its original position.

Hereinafter, the upper assembly 110 and the lower assembly 200 will be described in more detail.

The upper assembly 110 may include an upper tray 150 defining a portion of the ice chamber 111 making the ice. For example, the upper tray 150 may define an upper portion of the ice chamber 111.

The upper assembly 110 may further include an upper support 170 fixing a position of the upper tray 150.

The upper support 170 may restrict downward movement of the upper tray 150.

The upper assembly 110 may further include an upper case 120 fixing a position of the upper tray 150.

The upper tray 150 may be disposed below the upper case 120.

As described above, the upper case 120, the upper tray 150, and the upper support 170, which are vertically aligned, may be coupled to each other through a coupling member.

That is, the upper tray 150 may be fixed to the upper case 120 through coupling of the coupling member.

For example, the water supply part 190 may be fixed to the upper case 120.

The ice maker 100 may further include a temperature sensor 500 detecting a temperature of the ice chamber 111.

In one example, the temperature sensor 500 detects the temperature of the upper tray 150 thus to indirectly detect the temperature of the water or the temperature of the ice in the ice chamber 111.

For example, the temperature sensor 500 may be mounted on the upper case 120. Also, when the upper tray 150 is fixed to the upper case 120, the temperature sensor 500 may contact the upper tray 150.

The lower assembly 200 may include a lower tray 250 defining the other portion of the ice chamber 111 making the ice. For example, the lower tray 250 may define a lower portion of the ice chamber 111.

The lower assembly 200 may further include a lower support 270 supporting a lower portion of the lower tray 250.

The lower assembly 200 may further include a lower case 210 of which at least a portion covers an upper side of the lower tray 250.

The lower case 210, the lower tray 250, and the lower support 270 may be coupled to each other through a coupling member.

The ice maker 100 may further include a switch for turning on/off the ice maker 100. When the user turns on the switch 600, the ice maker 100 may make ice.

That is, when the switch 600 is turned on, water may be supplied to the ice maker 100. Then, an ice making process of making ice by using cold air and an ice separating process of transferring the ice through the rotation of the lower assembly 200.

On the other hand, when the switch 600 is manipulated to be turned off, the making of the ice through the ice maker 100 may be impossible. For example, the switch 600 may be provided in the upper case 120.

The ice maker 100 may further include a full ice detection lever 700.

For example, the full ice detection lever 700 may detect whether the ice bin 102 is filled with ice while receiving power of the driver 180 and rotating.

One side of the full ice detection lever 700 may be connected to the driver 180 and the other side of the full ice detection lever 700 may be connected to the upper case 120.

For example, the other side of the full ice detection lever 700 may be rotatably connected to the upper case 120 below a connection shaft 370 of the connector 350.

Thus, the rotational center of the full ice detection lever 700 may be positioned below the connection shaft 370.

The driver 180 may include a motor and a plurality of gears for transferring power of the motor to the lower assembly.

The driver 180 may further include a cam that rotates by receiving rotation power of the motor, and a moving lever that moves along a surface of the cam. The moving lever may include the magnet. The driver 180 may further include a hall sensor for detecting the magnet during a procedure in which the moving lever moves.

A first gear coupled to the full ice detection lever 700 among a plurality of gears of the driver 180 may be selectively coupled or decoupled to and from a second gear engaged with the first gear. For example, the first gear may be elastically supported by an elastic member and may be engaged with the second gear in a state in which external force is not applied.

In contrast, when higher resistance than elastic force of the elastic member is applied to the first gear, the first gear may be spaced apart from the second gear.

An example of the case in which higher resistance than elastic force of the elastic member is applied to the first gear may include the case in which the full ice detection lever 700 is restrained by ice during a produce of transferring ice (when the ice bin 102 is filled with ice). In this case, the first gear may be spaced apart from the second gear, and thus gears may be prevented from being damaged.

The full ice detection lever 700 may be operatively associated with the lower assembly 200 and may be rotated while the lower assembly 200 is rotated, by the plurality of gears and the cam. In this case, the cam may be connected to the second gear or may be operatively associated with the second gear.

According to whether the hall sensor detects a magnet, the hall sensor may output a first signal and a second signal that are different. Any one of the first signal may be a high signal and the other one may be a low signal.

The full ice detection lever 700 may be rotated to a position at which whether the ice bin 102 is filled with ice from a standby position (a position of the lower assembly, at which ice is made) in order to detect whether the ice bin 102 is filled with ice.

In the state in which the full ice detection lever 700 is positioned at the standby position, at least a portion of the full ice detection lever 700 may be positioned below the lower assembly 200.

The full ice detection lever 700 may include a detection body 710. The detection body 710 may be positioned at the lowermost side during a rotation procedure of the full ice detection lever 700.

An entire portion of the detection body 710 may be positioned below the lower assembly 200 in order to prevent the lower assembly 200 and the detection body 710 from interfering with each other during a rotation procedure of the lower assembly 200.

The detection body 710 may contact ice in the ice bin 102 in the state in which ice is filled with the ice bin 102.

The full ice detection lever 700 may be a wire type lever. That is, the full ice detection lever 700 may be formed by bending a wire with a predetermined diameter a plurality of number of times.

The full ice detection lever 700 may include the detection body 710. The detection body 710 may extend in a parallel direction to a direction in which the connection shaft 370 extends.

The detection body 710 may be positioned lower than a lowermost point of the lower assembly 200 irrespective of a position.

The full ice detection lever 700 may further include a pair of extension parts 720 and 730 that extend upward at opposite ends of the detection body 710.

The pair of extension parts 720 and 730 may extend substantially parallel to each other.

The pair of extension parts 720 and 730 may include a first extension part 720 and a second extension part 730.

A horizontal length of the detection body 710 may be larger than a vertical length of each of the pair of extension parts 720 and 730.

An interval between the pair of extension parts 720 and 730 may be larger than a horizontal length of the lower assembly 200.

Thus, during a rotation procedure of the full ice detection lever 700 and a rotation procedure of the lower assembly 200, the pair of extension parts 720 and 730 and the lower assembly 200 may be prevented from interfering with each other.

Each of the pair of extension parts 720 and 730 may include first extension bars 722 and 732 that extend from the detection body 710, and second extension bars 721 and 731 that extend from the first extension bars 722 and 732 to be inclined at a predetermined angle.

The full ice detection lever 700 may further include a pair of couplers 740 and 750 that are bent at ends of the pair of extension parts 720 and 730 and extend.

The pair of couplers 740 and 750 may include a first coupler 740 that extends from the first extension part 720 and a second coupler 750 that extends from the second extension part 730.

For example, the pair of couplers 740 and 750 may extend from the second extension bars 721 and 731.

The first coupler 740 and the second coupler 750 may extend in a direction to be spaced apart from the extension parts 720 and 730, respectively.

The first coupler 740 may be connected to the driver 180, and the second coupler 750 may be connected to the upper case 120.

At least a portion of the first coupler 740 may extend in a horizontal direction. That is, at least a portion of the first coupler 740 may be positioned in parallel to the detection body 710.

The first coupler 740 and the second coupler 750 may provide the rotational center of the full ice detection lever 700.

According to the present embodiment, the second coupler 750 may be coupled to the upper case 120 in an idle state. Thus, the first coupler 740 may substantially provide the rotational center of the full ice detection lever 700.

The first coupler 740 may include a first horizontal extension part 741 that extends in a horizontal direction from the first extension part 720.

The first coupler 740 may further include a bent portion 742 bent from the first horizontal extension part 741.

Without being limited to, the bent portion 742 may be inclined downward in a direction to be spaced apart from the first horizontal extension part 741 and may then be inclined upward.

For example, the bent portion 742 may include a first inclination portion 742*a* that is inclined downward from the first horizontal extension part 741, and a second inclination portion 742*b* that is inclined upward from the first inclination portion 742*a*.

A boundary portion between the first inclination portion 742*a* and the second inclination portion 742*b* may be positioned at the lowermost side of the first coupler 740.

The first coupler 740 includes the bent portion 742 in order to increase coupling force with the driver 180.

The first coupler 740 may further include a second horizontal extension part 743 that extends in a horizontal direction from an end of the bent portion 742.

For example, the second horizontal extension part 743 may extend in a horizontal direction from the second inclination portion 742*b*.

The second horizontal extension part 743 and the first horizontal extension part 741 may be positioned at the same height based on the detection body 710. That is, the first horizontal extension part 741 and the second horizontal extension part 743 may be positioned at the same extension line.

In another example, according to the present embodiment, the first coupler 740 may include only the first horizontal extension part 741 or may also include only the first horizontal extension part 741 and the bent portion 742.

Alternatively, the first coupler 740 may include only the bent portion 742 and the second horizontal extension part 743.

The second coupler 750 may include a coupling body 751 that extends in a horizontal direction from the second extension part 730, and a flange body 752 bent from the coupling body 751.

For example, the coupling body 751 may extend in parallel to the flange body 752.

For example, the flange body 752 may extend in upward and downward directions. The flange body 752 may extend downward from the coupling body 751.

The flange body 752 may extend in parallel to the second extension part 730.

The second coupler 750 may penetrate the upper case 120. The upper case 120 may include a hole 120*a* that the second coupler 750 penetrates.

<Upper Case>

Figure 6A:
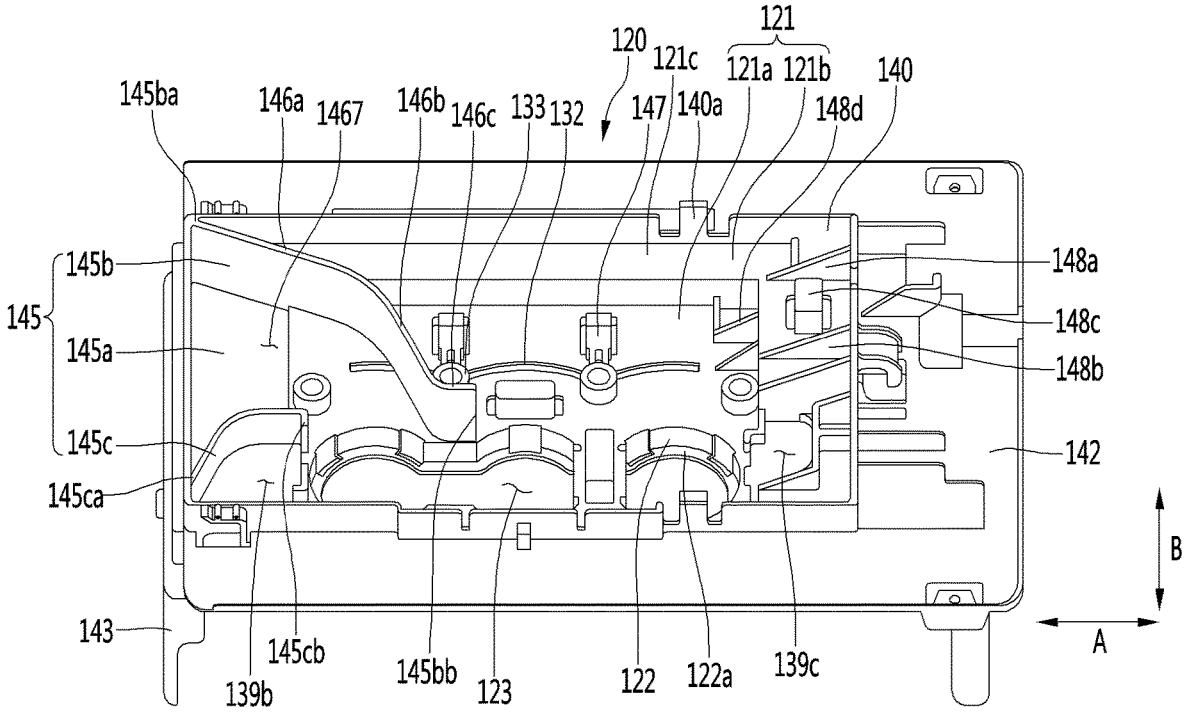
FIGS. 6A and 6B are perspective views of an upper case according to an embodiment.
Figure 6B:
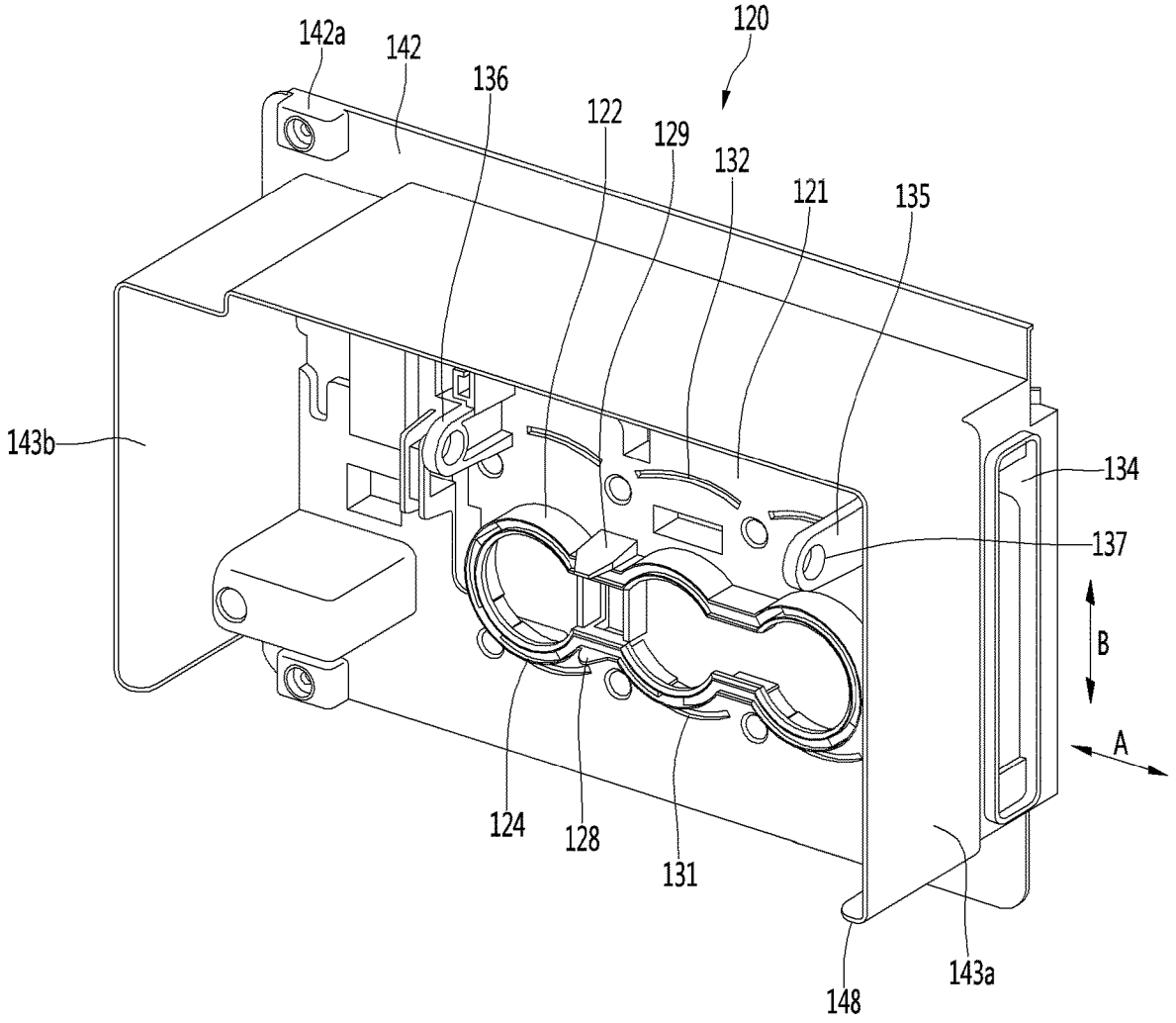
Figure 7:
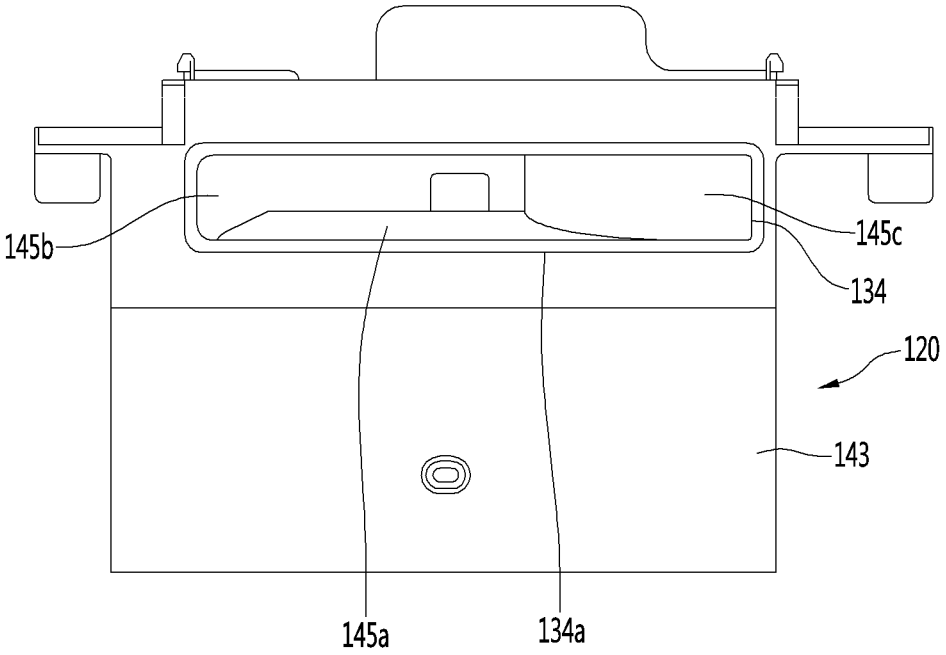
FIG. 7 is a view showing an upper case viewed from a side of a cool air hole.
Figure 8:
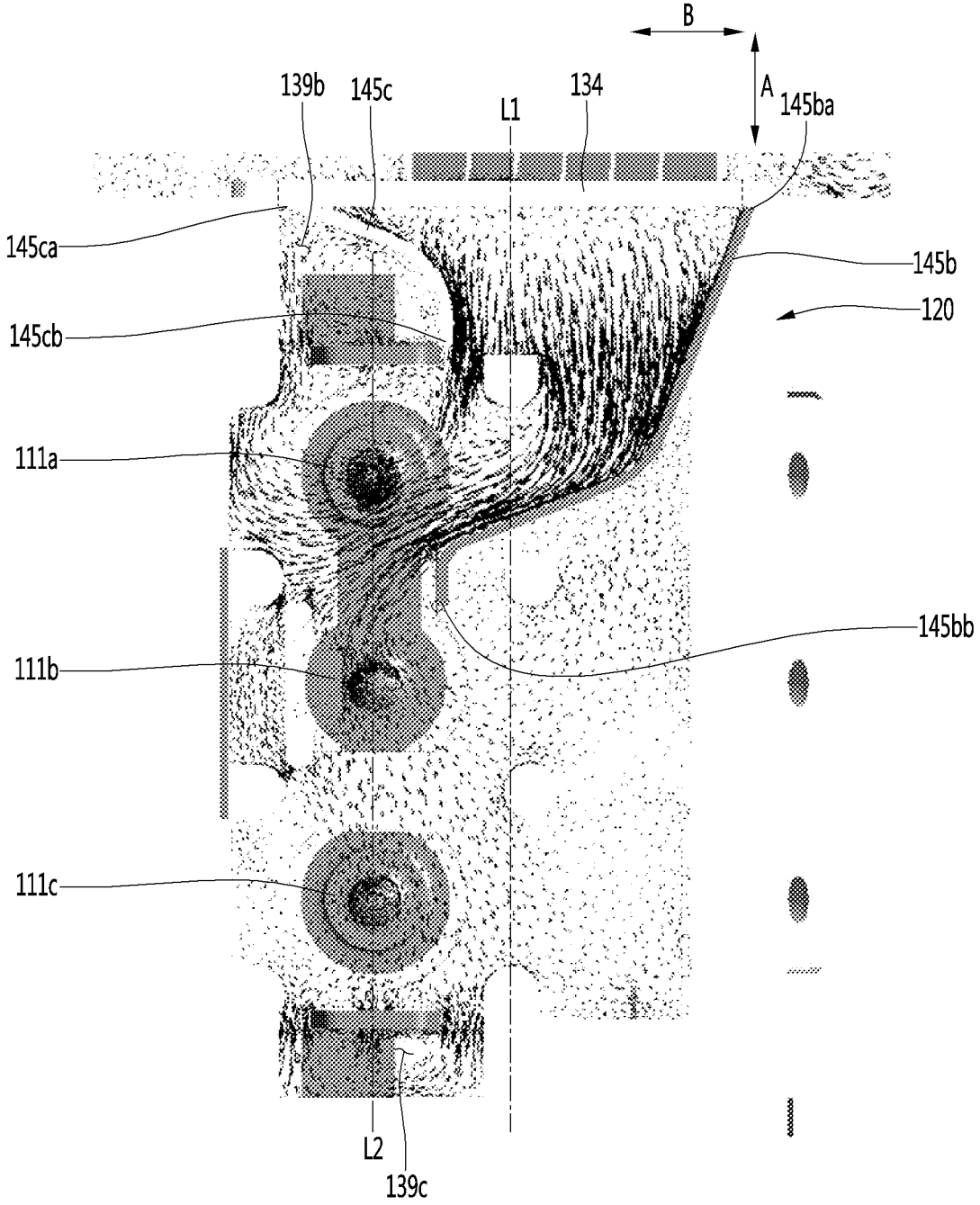
FIG. 8 is a view showing the case in which cool air passing through a cool air hole flows in an ice maker.

FIGS. 6A and 6B are perspective views of an upper case according to an embodiment. FIG. 7 is a view showing an upper case viewed from a side of a cool air hole. FIG. 8 is a view showing the case in which cool air passing through a cool air hole flows in an ice maker.

Referring to FIGS. 6 to 8, the upper case 120 may be fixed to a housing 101 within the freezing compartment 4 in a state in which the upper tray 150 is fixed.

The upper case 120 may include an upper plate for fixing the upper tray 150.

The upper tray 150 may be fixed to the upper plate 121 in a state in which a portion of the upper tray 150 contacts a bottom surface of the upper plate 121.

A tray opening 123 through which a portion of the upper tray 150 passes may be defined in the upper plate 121.

For example, when the upper tray 150 is fixed to the upper plate 121 in a state in which the upper tray 150 is disposed below the upper plate 121, a portion of the upper tray 150 may protrude upward from the upper plate 121 through the tray opening 123.

Alternatively, the upper tray 150 may not protrude upward from the upper plate 121 through tray opening 123 but protrude downward from the upper plate 121 through the tray opening 123.

The upper plate 121 may include a recess 122 that is recessed downward. The tray opening 123 may be defined in a bottom surface 122*a* of the recess 122.

Thus, the upper tray 150 passing through the tray opening 123 may be disposed in a space defined by the recess 122.

A heater coupling part 124 for coupling an upper heater (see reference numeral 148 of FIG. 14) that heats the upper tray 150 so as to transfer the ice may be provided in the upper case 120.

For example, the heater coupling part 124 may be provided on the upper plate 121. The heater coupling part 124 may be disposed below the recess 122.

The upper case 120 may further include a plurality of installation ribs 128 and 129 for installing the temperature sensor 500.

The pair of installation ribs 128 and 129 may be disposed to be spaced apart from each other in a direction of an arrow B of FIG. 6B. The pair of installation ribs 128 and 129 may be disposed to face each other, and the temperature sensor 500 may be disposed between the pair of installation ribs 128 and 129.

The pair of installation ribs 128 and 129 may be provided on the upper plate 121.

A plurality of slots 131 and 132 coupled to the upper tray 150 may be provided in the upper plate 121.

A portion of the upper tray 150 may be inserted into the plurality of slots 131 and 132.

The plurality of slots 131 and 132 may include a first upper slot 131 and a second upper slot 132 disposed at an opposite side of the first upper slot 131 with respect to the tray opening 123.

The tray opening 123 may be defined between the first upper slot 131 and the second upper slot 132.

The first upper slot 131 and the second upper slot 132 may be spaced apart from each other in a direction of an arrow B of FIG. 6B.

Although not limited, the plurality of first upper slots 131 may be arranged to be spaced apart from each other in a direction of an arrow A (hereinafter, referred to as a first direction) that a direction crossing a direction of an arrow B (hereinafter, referred to as a second direction).

Also, the plurality of second upper slots 132 may be arranged to be spaced apart from each other in the direction of the arrow A.

In this specification, the direction of the arrow A may be the same direction as the arranged direction of the plurality of ice chambers 111.

For example, the first upper slot 131 may be defined in a curved shape. Thus, the first upper slot 131 may increase in length.

For example, the second upper slot 132 may be defined in a curved shape. Thus, the second upper slot 132 may increase in length.

When each of the upper slots 131 and 132 increases in length, a protrusion (that is disposed on the upper tray) inserted into each of the upper slots 131 and 132 may increase in length to improve coupling force between the upper tray 150 and the upper case 120.

A distance between the first upper slot 131 and the tray opening 123 may be different from that between the second upper slot 132 and the tray opening 123. For example, the distance between the first upper slot 131 and the tray opening 123 may be greater than that between the second upper slot 132 and the tray opening 123.

Also, when viewed from the tray opening 123 toward each of the upper slots 131, a shape that is convexly rounded from each of the slots 131 toward the outside of the tray opening 123 may be provided.

The upper plate 121 may further include a sleeve 133 into which a coupling boss of the upper support, which will be described later, is inserted.

The sleeve 133 may have a cylindrical shape and extend upward from the upper plate 121.

For example, a plurality of sleeves 133 may be provided on the upper plate 121. The plurality of sleeves 133 may be arranged to be spaced apart from each other in the direction of the arrow A. Also, the plurality of sleeves 133 may be arranged in a plurality of rows in the direction of the arrow B.

A portion of the plurality of sleeves may be disposed between the two first upper slots 131 adjacent to each other.

The other portion of the plurality of sleeves may be disposed between the two second upper slots 132 adjacent to each other or be disposed to face a region between the two second upper slots 132.

The upper case 120 may further include a plurality of hinge supports 135 and 136 allowing the lower assembly 200 to rotate.

The plurality of hinge supports 135 and 136 may be disposed to be spaced apart from each other in the direction of the arrow A with respect to FIG. 6B. Also, a first hinge hole 137 may be defined in each of the hinge supports 135 and 136.

For example, the plurality of hinge supports 135 and 136 may extend downward from the upper plate 121.

The plurality of hinge supports 135 and 136 and the tray opening 123 may be spaced apart from each other in a direction indicated by arrow B.

The upper case 120 may include may include through-opening 139*b* and 139 that a portion of the connector 350 penetrates. For example, the second link 356 positioned at each of opposite sides of the lower assembly 200 may penetrate through-openings 139*b* and 139*c*.

The through-openings 139*b* and 139*c* may be spaced apart from each other in a direction indicated by arrow A. For example, the through-openings 139*b* and 139*c* may be formed in the upper plate 121.

The upper case 120 may further include a vertical extension part 140 vertically extending along a circumference of the upper plate 121. The vertical extension part 140 may extend upward from the upper plate 121.

The vertical extension part 140 may include one or more coupling hooks 140*a*. The upper case 120 may be hook-coupled to the housing 101 by the coupling hooks 140*a*.

The water supply part 190 may be coupled to the vertical extension part 140.

The upper case 120 may further include a horizontal extension part 142 horizontally extending to the outside of the vertical extension part 140.

A screw coupling part 142*a* protruding outward to screw-couple the upper case 120 to the housing 101 may be provided on the horizontal extension part 142.

The upper case 120 may further include a side circumferential part 143. The side circumferential part 143 may extend downward from the horizontal extension part 142.

The side circumferential part 143 may be disposed to surround a circumference of the lower assembly 200. That is, the side circumferential part 143 may prevent the lower assembly 200 from being exposed to the outside.

Although the upper case is coupled to the separate housing 101 within the freezing compartment 4 as described above, the embodiment is not limited thereto. For example, the upper case 120 may be directly coupled to a wall defining the freezing compartment 4.

The side circumferential part 143 may include a first side wall 143*a* in which a cool air hole 134 is formed, and a second side wall 143*b* disposed to face the first side wall 143*a*.

The first side wall 143*a* and the second side wall 143*b* may be spaced apart from each other in a direction indicated by arrow A.

When the ice maker 100 is installed in the freezing compartment 4, the first side wall 143*a* may face a rear wall of the freezing compartment 4 or one wall of opposite walls of the freezing compartment 4.

The lower assembly 200 may be positioned between the first side wall 143*a* and the second side wall 143*b*.

The full ice detection lever 700 rotates, and thus the side circumferential part 143 may include an anti-interference groove 148 formed therein in order to prevent interference during a rotation procedure of the full ice detection lever 700.

The through-openings 139*b* and 139*c* may include a first through-opening 139*b* positioned adjacent to the first side wall 143*a*, and a second through-opening 139 positioned adjacent to the second side wall 143*b*. The first through-opening 139*b* may be positioned more adjacent to the cool air hole 134 than the second through-opening 139*c*.

At least a portion of the tray opening 123 may be positioned between the through-opening 139*b* and 139*c*.

The cool air hole 134 may be formed to be long in right and left directions from the first side wall 143*a*.

The lowermost point of the cool air hole 134 may be positioned lower than the lowermost point of the upper plate 121 or at the same height as the lowermost point of the upper plate 121.

At least a portion of the upper tray 150 may be positioned higher than the tray opening 123 of the upper plate 121 based on the upper plate 121. In contrast, the lower tray 250 may be positioned lower than the tray opening 123 of the upper plate 121.

Thus, heat of a portion of cool air may be directly or indirectly transferred to the upper tray 150 from an upper side of the upper plate 121, and heat of another portion of the cool air may be directly or indirectly transferred to the lower tray 250 from a lower side of the upper plate 121.

FIG. 8 shows a first imaginary line L1 that bisects the horizontal length of the cool air hole 134 and extends in a horizontal direction, and a second imaginary line L2 that connects the centers of the plurality of ice chambers 111 and extends in a horizontal direction.

The first imaginary line L1 may be positioned in parallel to the second imaginary line L2 rather than being matched with each other. Thus, the first imaginary line L1 and the second imaginary line L2 may be spaced apart from each other in a direction indicated by arrow B.

According to an embodiment, the upper case 120 may include a cool air guide 145 in order to guide cool air passing through the cool air hole 134 toward the upper tray 150. The cool air guide 145 may guide the cool air passing through the cool air hole 134 toward the tray opening 123.

A flow of cool air according to whether the cool air guide 145 is present will be described.

When a cool air guide is not present in the upper case 120, the first imaginary line L1 is arranged in parallel to the second imaginary line L2 as described above, and thus, from cool air passing through the cool air hole 134, cool air at an opposite side to the second imaginary line L2 based on the first imaginary line L1 may flow straightly and may then may flow downward through the second through-opening 139*c*.

In contrast, based on from cool air passing through the cool air hole 134, a portion of cool air at the second imaginary line L2 based on the first imaginary line L1 may flow toward the upper tray, and another portion of the cool air at the second imaginary line L2 may flow downward through the first through-opening 139*b*.

As a result, when the cool air guide 145 is not present, based on cool air passing through the cool air hole 134, the amount of cool air flowing in a downward direction of the upper plate 121 through the through-opening 139*b* and 139*c* may be larger than the amount of cool air flowing in a perpendicular direction of the upper tray 150.

According to the present embodiment, the plurality of ice chambers 111 may be arranged in a line. When the amount of cool air below the upper plate 121 is equal to or larger than the amount of cool air above the upper plate 121, a heat transfer of cool air between cool air and the ice chambers 111 at opposite ends among the plurality of ice chambers 111 may be larger than a heat transfer between cool air and the ice chamber 111 at the central part. This is because the cool air first transfers heat to the ice chambers 111 at the opposite ends and then flows toward the central part.

In this case, ice may be more rapidly generated at the ice chambers 111 at the opposite ends among the plurality of ice chambers 111.

Water expands while being changed in phase, and in this regard, when ice is rapidly generated at opposite ends of the plurality of ice chambers 111, expansive force of the water may be applied to the ice chamber 111 at the central part. Then, water in the ice chambers at the opposite ends between the upper tray 150 and the lower tray 250 may move toward the central part, and thus the shape of ice generated in the ice chamber 111 is not uniform, and manufactured ices may be disadvantageously connected.

Thus, according to the present embodiment, the upper case 120 may include the cool air guide 145 in such a way that cool air is concentrated into an upper side of the upper plate 121 and ices are manufactured at the same or similar speed in the plurality of ice chambers 111.

The cool air guide 145 may include a horizontal guide 145*a* for guiding cool air passing through the cool air hole 134, and a plurality of vertical guides 145*b* and 145*c*.

The horizontal guide 145*a* may guide cool air in an upward direction of the upper plate 121 from a position that is the same position or a lower position than the lowermost point of the cool air hole 134.

The horizontal guide 145*a* may connect the first side wall 143*a* and the upper plate 121.

When a lowermost point 134*a* of the cool air hole 134 is positioned lower than a lowermost point of the upper plate 121, the horizontal guide 145*a* may be inclined in an upward direction toward the upper plate 121 from the cool air hole 134.

The plurality of vertical guides 145*b* and 145*c* may be arranged to cross the horizontal guide 145*a* or may be arranged perpendicular thereto.

The plurality of vertical guides 145*b* and 145*c* may include a first vertical guide 145*b* and a second vertical guide 145*c* spaced apart from the first vertical guide 145*b*.

One end 145*ba* of the first vertical guide 145*b* may be positioned adjacent to the cool air guide 145, and the other end 145*bb* may be positioned adjacent to the tray opening 123.

For example, the plurality of ice chambers 111 may include a first ice chamber 111*a*, a second ice chamber 111*b*, and a third ice chamber 111*c* that are sequentially arranged in a direction to be spaced apart from the cool air hole 134.

That is, the first ice chamber 111*a* may be positioned closest to the cool air hole 134, and the third ice chamber 111*c* may be positioned farthest from the cool air hole 134.

According to the present embodiment, the first ice chamber 111*a* and the third ice chamber 111*c* may be referred to as an opposite-end ice chamber.

Then, the other end 145*bb* of the first vertical guide 145*b* may be positioned in a region corresponding to a region between the first ice chamber 111*a* and the third ice chamber 111*c*. FIG. 8 shows an example in which the other end 145*bb* of the first vertical guide 145*b* is positioned adjacent to the second ice chamber 111*b*.

The other end 145*bb* of the first vertical guide 145*b* may be positioned closer to an upper opening 154 of the second ice chamber 111*b* than the upper opening 154 of the first ice chamber 111*a*.

The end 145*ba* of the first vertical guide 145*b* may be positioned at an opposite side to the second imaginary line L2 based on the first imaginary line L1.

The first vertical guide 145*b* may extend to be round in a horizontal direction toward the other end 145*bb* from the end 145*ba* in such a way that the other end 145*bb* of the first vertical guide 145*b* is positioned adjacent to the second ice chamber 111*b*.

For example, the first vertical guide 145*b* may include a first guide part 146*a*, a second guide part 146*b* that extends with a different curvature from the first guide part 146*a*, and a third guide part 146*c* that extends toward the second through-opening 139*c* from the second guide part 146*b*.

In another example, each of the first guide part 146*a* and the second guide part 146*b* may extend in a straight line, and in this case, the second guide part 146*b* may extend to be inclined at a predetermined angle with respect to the first guide part 146*a*.

The third guide part 146*c* may guide air flowing in the second guide part 146*b* to the second through-opening 139*c*. Needless to say, the third guide part 146*c* may be omitted. Alternatively, the first vertical guide 145*b* may extend in a straight line and may be positioned adjacent to the second ice chamber 111*b*.

The other end 145*bb* of the first vertical guide 145*b* may be positioned closer to the first ice chamber 111*a* than the third ice chamber 111*c* in such a way that cool air flow in the plurality of ice chambers sequentially or entirely.

When the other end 145*bb* of the first vertical guide 145*b* is positioned close to the third ice chamber 111*c*, the air guided by the first vertical guide 145*b* may flow toward the third ice chamber 111*c* in the state in which the air does not flow in the first ice chamber 111*a* and the second ice chamber 111*b*.

Thus, cool air does not flow in the plurality of ice chambers 111 sequentially or entirely, and thus ice may be made at different speeds in the plurality of ice chambers 111. However, as seen from the upper perspective view of the upper tray, the other end 145*bb* of the first vertical guide 145*b* may be positioned closer to the first ice chamber 111*a* than the third ice chamber 111*c*, and thus ice may be made at the same or similar speed in the plurality of ice chambers 111.

The second vertical guide 145*c* may be spaced apart from the first vertical guide 145*b* in a direction indicated by arrow B. The second vertical guide 145*c* may form a guidance path 1467 with the first vertical guide 145*b*. Upper ends of the first and second vertical guides 145*b* and 145*c* may be positioned higher than the tray opening 123. The upper ends of the first and second vertical guides 145*b* and 145*c* may be positioned at the same height or higher than the upper opening 154 of t the upper tray 150.

A horizontal length of the second vertical guide 145*c* may be shorter than a horizontal length of the first vertical guide 145*b*.

One end 145*ca* of the second vertical guide 145*c* may be positioned adjacent to the cool air hole 134.

In this case, the first imaginary line L1 may be positioned between the end 145*ba* of the first vertical guide 145*b* and the end 145*ca* of the second vertical guide 145*c*.

At least a portion of the second vertical guide 145*c* may extend toward the first vertical guide 145*b* from the end 145*ca*. Thus, a cross-sectional area of at least a portion of the guidance path 1467 may be reduced in a direction away from the cool air hole 134.

For example, a width of at least a portion of the guidance path 1467 in a horizontal direction may be reduced in a direction away from the cool air hole 134.

A partial or entire portion of the second vertical guide 145*c* may be formed to be rounded.

The other end 145*cb* of the second vertical guide 145*c* may be positioned closer to the cool air hole 134 than the other end 145*bb* of the second vertical guide 145*c*.

The other end 145*cb* of the second vertical guide 145*c* may be positioned in a region between the first imaginary line L1 and the second imaginary line L2.

Viewed from the above, the upper case 120 may be configured in such a way that the second imaginary line L2 penetrates the second vertical guide 145*c*.

The second vertical guide 145*c* may substantially separate the cool air hole 134 and the first through-opening 139*b*.

A horizontal distance to the other end 145*cb* of the second vertical guide 145*c* from the first side wall 143*a* may be formed to be longer than a maximum horizontal distance of the first through-opening 139*b* from the first side wall 143*a*.

Thus, as shown in FIG. 8, a portion of cool air passing through the cool air hole 134 may flow along the second vertical guide 145*c*, may be changed in direction after flowing toward at least the first ice chamber 111*a*, and may then pass through the first through-opening 139*b*.

One end of the second vertical guide 145*c* may be positioned in the cool air hole 134 at an opposite side to the end 145*ba* of the first vertical guide 145*b*. At least a portion of the first ice chamber 111*a* may be positioned between the other end 145*cb* of the second vertical guide 145*c* and the other end 145*ba* of the first vertical guide 145*b*.

Referring to FIG. 8, according to the present embodiment, cool air passing through the cool air hole 134 may be concentrated on into an upper side of the upper plate 121 by the cool air guide 145, and cool air flowing in the upper plate 121 may pass through the first and second through-openings 139*b* and 139*c*.

Thus, ice may be made at uniform speed in the plurality of ice chambers 111, and thus spherical ice may be made, thereby preventing the ice from being connected with each other.

In the full ice detection lever 700, the first coupler 740 may be connected to the driver 180, and the second coupler 750 may be connected to the first side wall 143*a*.

The driver 180 may be coupled to the second side wall 143*b*. The lower assembly 200 may be rotated by the driver 180 during a procedure of transferring ice, and the lower tray 250 may be pressurized by the lower ejector 400.

In this case, during a procedure in which the lower tray 250 is pressurized by the lower ejector 400, relative movement between the driver 180 and the lower assembly 200 may be performed.

Pressurizing force for pressurizing the lower tray 250 by the lower ejector 400 may be transferred to an entire portion of the lower assembly 200, and may also be transferred to the driver 180. For example, torsion force may be applied to the driver 180.

Then, force applied to the driver 180 may also be applied to the second side wall 143*b*. When the second side wall 143*b* is deformed by force applied to the second side wall 143*b*, relative movement between the connector 350 and the driver 180 installed on the second side wall 143*b* may be changed. In this case, there is a probability that an axis of the driver 180 and the connector 350 are decoupled from each other.

Thus, a structure for minimizing deformation of the second side wall 143*b* may be additionally included in the upper case 120.

For example, the upper case 120 may further include one or more first ribs 148*a* for connection of the upper plate 121 and the vertical extension part 140. FIG. 6A shows the case in which a plurality of first ribs 148*a* and 148*b* are arranged to be spaced apart from each other in a horizontal direction.

A wire guide part 148*c* for guiding a wire connected to the upper heater (see reference numeral 148 of FIG. 14) or the lower heater (see reference numeral 296 of FIG. 27) may be disposed between two adjacent first ribs 148*a* and 148*b* among the plurality of first ribs 148*a* and 148*b*.

The upper plate 121 may include at least two steeped plates 121. For example, the upper plate 121 may include a first plate 121*a*, and a second plate 121*b* positioned higher than the first plate 121*a*.

In this case, the tray opening 123 may be formed in the first plate 121*a*.

The first plate 121*a* and the second plate 121*b* may be connected to each other by a connection wall 121*c*. The upper plate 121 may further include one or more second ribs 148*d* for connecting the first plate 121*a* and the second plate 121*b*, to the connection wall 121*c*.

Figure 27:
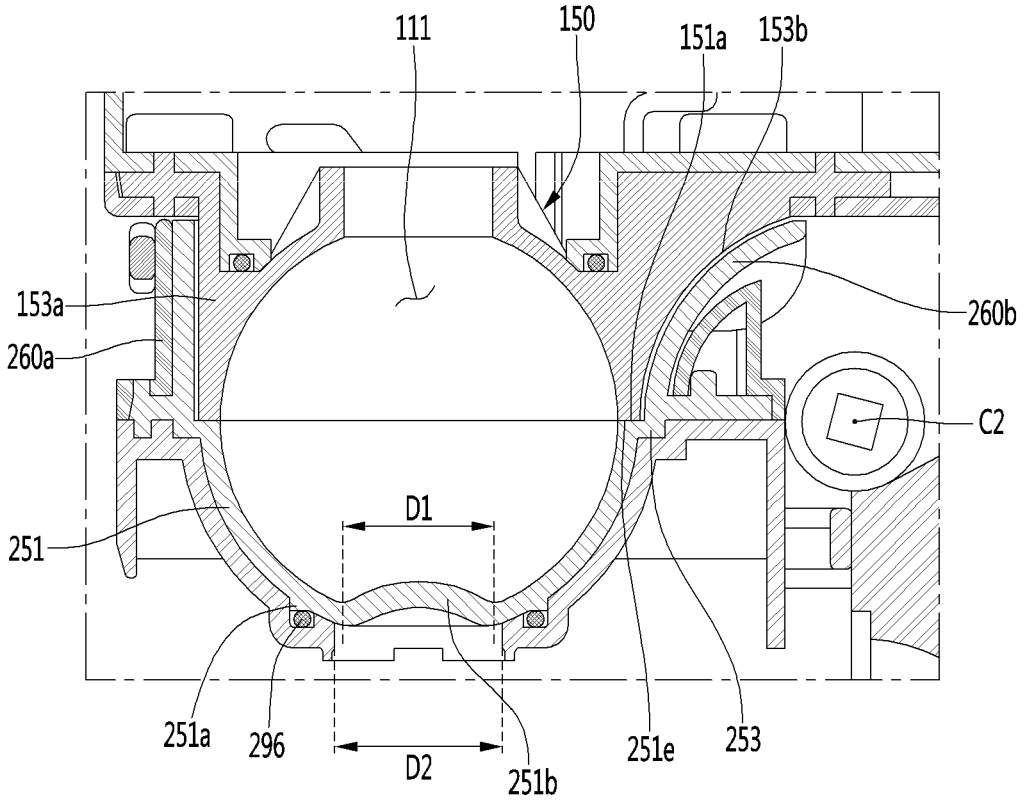
FIG. 27 is a cross-sectional view taken along 27-27 of FIG. 3.

The upper plate 121 may further include a wire guide hook 147 for guiding a wire for connected to the upper heater (see reference numeral 148 of FIG. 14) or the lower heater (see reference numeral 296 of FIG. 27). For example, the wire guide hook 147 may be provided to be elastically modified with respect to the first plate 121*a*.

<Upper Tray>

Figure 9:
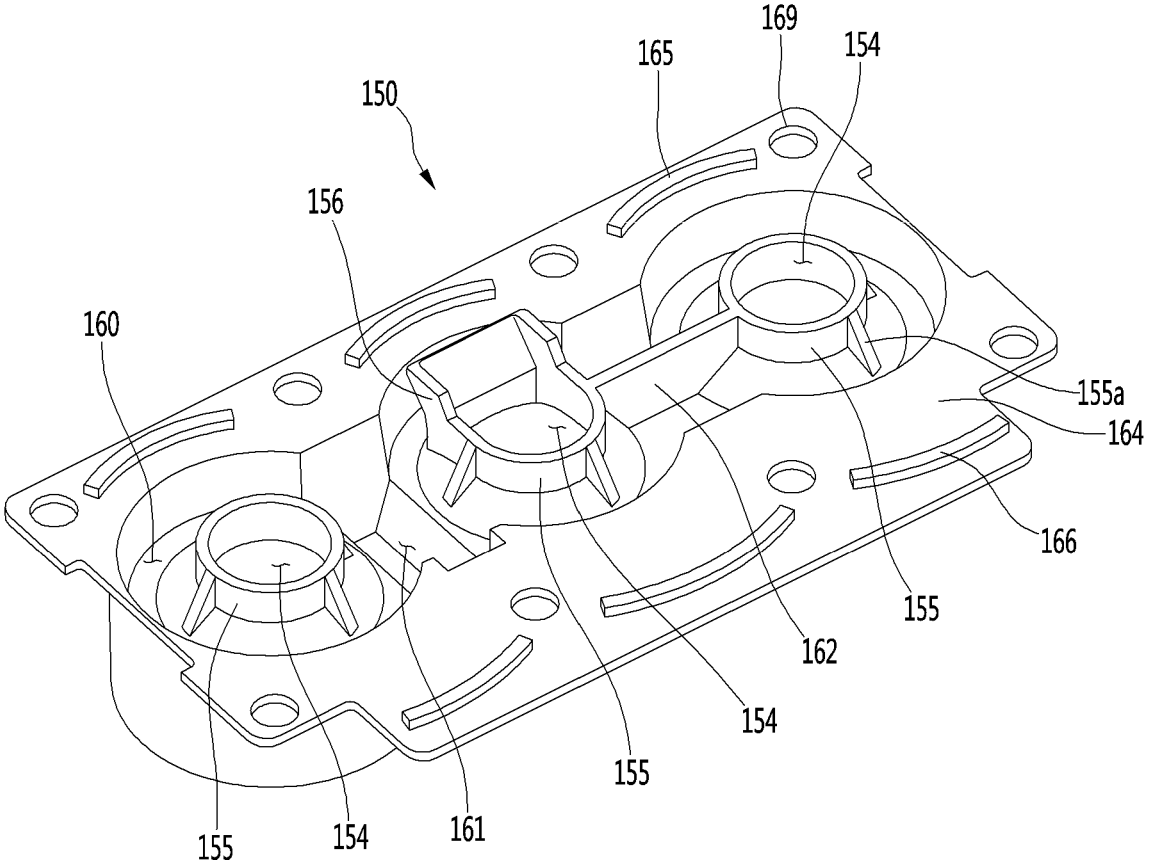
FIG. 9 is an upper perspective view of an upper tray according to an embodiment.
Figure 10:
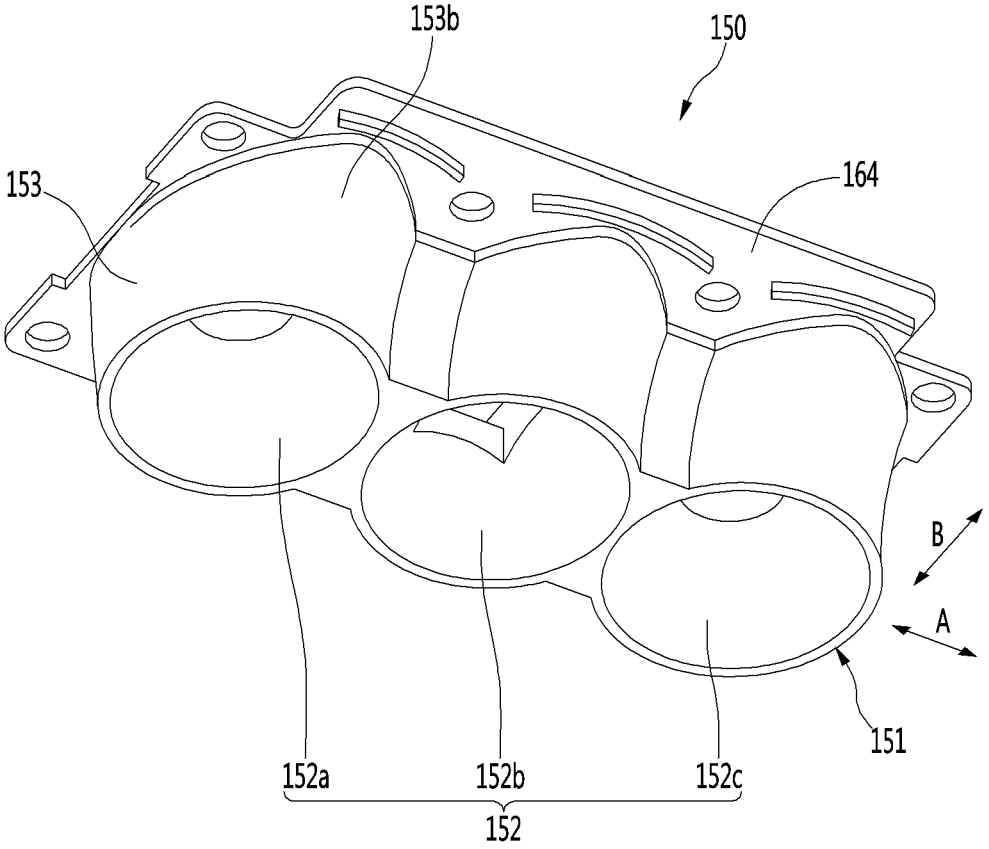
FIG. 10 is a lower perspective view of an upper tray according to an embodiment.
Figure 11:
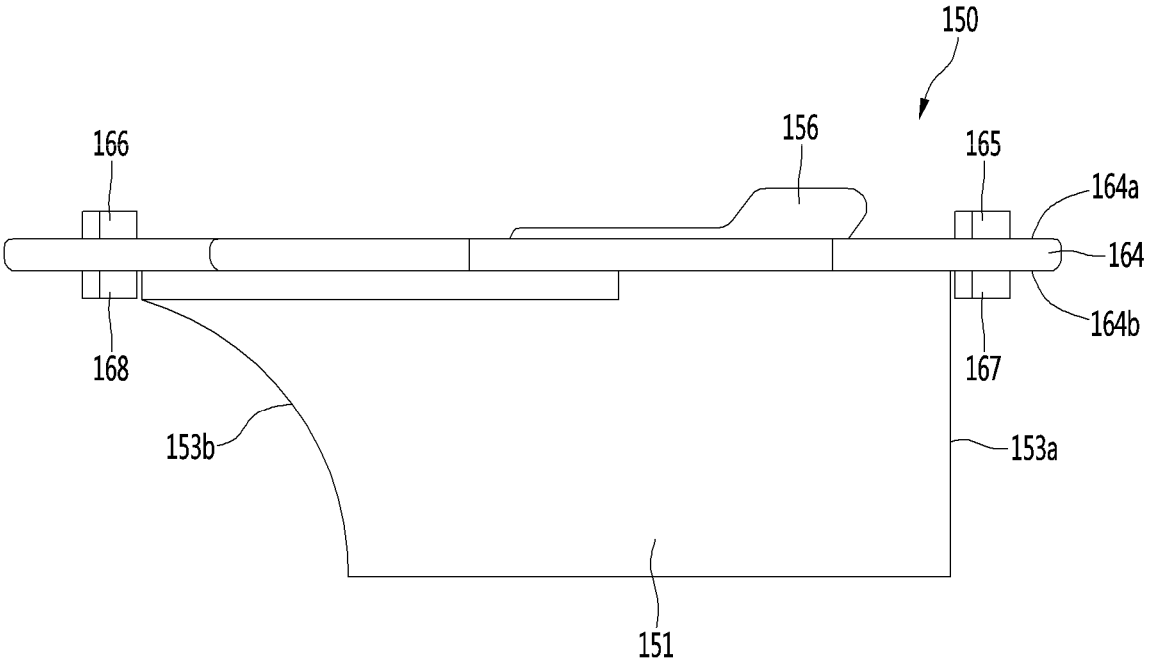
FIG. 11 is a side view of an upper tray according to an embodiment.

FIG. 9 is an upper perspective view of an upper tray according to an embodiment. FIG. 10 is a lower perspective view of an upper tray according to an embodiment. FIG. 11 is a side view of an upper tray according to an embodiment.

Referring to FIGS. 9 to 11, the upper tray 150 may be made of a non-metal material and a flexible material that is capable of being restored to its original shape after being deformed by an external force.

For example, the upper tray 150 may be made of a silicon material. Like this embodiment, when the upper tray 150 is made of the silicon material, even though external force is applied to deform the upper tray 150 during the ice separating process, the upper tray 150 may be restored to its original shape. Thus, in spite of repetitive ice making, spherical ice may be made.

If the upper tray 150 is made of a metal material, when the external force is applied to the upper tray 150 to deform the upper tray 150 itself, the upper tray 150 may not be restored to its original shape any more.

In this case, after the upper tray 150 is deformed in shape, the spherical ice may not be made. That is, it is impossible to repeatedly make the spherical ice.

On the other hand, like this embodiment, when the upper tray 150 is made of the flexible material that is capable of being restored to its original shape, this limitation may be solved.

Also, when the upper tray 150 is made of the silicon material, the upper tray 150 may be prevented from being melted or thermally deformed by heat provided from an upper heater that will be described later.

The upper tray 150 may include an upper tray body 151 defining an upper chamber 152 that is a portion of the ice chamber 111.

The upper tray body 151 may be define a plurality of upper chambers 152.

For example, the plurality of upper chambers 152 may define a first upper chamber 152*a*, a second upper chamber 152*b*, and a third upper chamber 152*c*.

The upper tray body 151 may include three chamber walls 153 defining three independent upper chambers 152*a*, 152*b*, and 152*c*. The three chamber walls 153 may be connected to each other to form one body.

The first upper chamber 152*a*, the second upper chamber 152*b*, and the third upper chamber 152*c* may be arranged in a line. For example, the first upper chamber 152*a*, the second upper chamber 152*b*, and the third upper chamber 152*c* may be arranged in a direction of an arrow A with respect to FIG. 10. The direction of the arrow A of FIG. 10 may be the same direction as the direction of the arrow A of FIG. 7.

The upper chamber 152 may have a hemispherical shape. That is, an upper portion of the spherical ice may be made by the upper chamber 152.

An upper opening 154 may be defined in an upper side of the upper tray body 151. The upper opening 154 may be communicated with the upper chamber 152.

For example, three upper openings 154 may be defined in the upper tray body 151.

Cold air may be guided into the ice chamber 111 through the upper opening 154. Further, water may be supplied into the ice chamber 111 through the upper opening 154.

In the ice separating process, the upper ejector 300 may be inserted into the upper chamber 152 through the upper opening 154.

While the upper ejector 300 is inserted through the upper opening 154, an inlet wall 155 may be provided on the upper tray 150 to minimize deformation of the upper opening 154 in the upper tray 150.

The inlet wall 155 may be disposed along a circumference of the upper opening 154 and extend upward from the upper tray body 151.

The inlet wall 155 may have a cylindrical shape. Thus, the upper ejector 30 may pass through the upper opening 154 via an inner space of the inlet wall 155.

One or more first connection ribs 155*a* may be provided along a circumference of the inlet wall 155 to prevent the inlet wall 155 from being deformed while the upper ejector 300 is inserted into the upper opening 154.

The first connection rib 155*a* may connect the inlet wall 155 to the upper tray body 151. For example, the first connection rib 155*a* may be integrated with the circumference of the inlet wall 155 and an outer face of the upper tray body 151.

Although not limited, the plurality of connection ribs 155*a* may be disposed along the circumference of the inlet wall 155.

The two inlet walls 155 corresponding to the second upper chamber 152*b* and the third upper chamber 152*c* may be connected to each other through the second connection rib 162. The second connection rib 162 may also prevent the inlet wall 155 from being deformed.

A water supply guide 156 may be provided in the inlet wall 155 corresponding to one of the three upper chambers 152*a*, 152*b*, and 152*c*.

Although not limited, the water supply guide 156 may be provided in the inlet wall corresponding to the second upper chamber 152*b*.

The water supply guide 156 may be inclined upward from the inlet wall 155 in a direction which is away from the second upper chamber 152*b*.

The upper tray 150 may further include a first accommodation part 160. The heater coupling part 124 of the upper case 120 may be accommodated in the first accommodation part 160.

An upper heater (see reference numeral 148 of FIG. 14) may be provided in the heater coupling part 124. Thus, it may be understood that the upper heater (see reference numeral 148 of FIG. 14) is accommodated in the first accommodation part 160.

The first accommodation part 160 may be disposed in a shape that surrounds the upper chambers 152*a*, 152*b*, and 152*c*. The first accommodation part 160 may be provided by recessing a top surface of the upper tray body 151 downward.

The first accommodation part 160 may be positioned lower than the upper opening 154.

The upper tray 150 may further include a second accommodation part 161 (or referred to as a sensor accommodation part) in which the temperature sensor 500 is accommodated.

For example, the second accommodation part 161 may be provided in the upper tray body 151. Although not limited, the second accommodation part 161 may be provided by recessing a bottom surface of the first accommodation part 160 downward.

Also, the second accommodation part 161 may be disposed between the two upper chambers adjacent to each other. For example, the second accommodation part 161 may be disposed between the first upper chamber 152*a* and the second upper chamber 152*b*.

Thus, an interference between the upper heater (see reference numeral 148 of FIG. 14) accommodated in the first accommodation part 160 and the temperature sensor 500 may be prevented.

In the state in which the temperature sensor 500 is accommodated in the second accommodation part 161, the temperature sensor 500 may contact an outer face of the upper tray body 151.

The chamber wall 153 of the upper tray body 151 may include a vertical wall 153*a* and a curved wall 153*b*.

The curved wall 153*b* may be rounded upward in a direction that is away from the upper chamber 152.

The upper tray 150 may further include a horizontal extension part 164 horizontally extending from the circumference of the upper tray body 151. For example, the horizontal extension part 164 may extend along a circumference of an upper edge of the upper tray body 151.

The horizontal extension part 164 may contact the upper case 120 and the upper support 170.

For example, a bottom surface 164*b* (or referred to as a "first surface") of the horizontal extension part 164 may contact the upper support 170, and a top surface 164*a* (or referred to as a "second surface") of the horizontal extension part 164 may contact the upper case 120.

At least a portion of the horizontal extension part 164 may be disposed between the upper case 120 and the upper support 170.

The horizontal extension part 164 may include a plurality of upper protrusions 165 and 166 respectively inserted into the plurality of upper slots 131 and 132.

The plurality of upper protrusions 165 and 166 may include a first upper protrusion 165 and a second upper protrusion 166 disposed at an opposite side of the first upper protrusion 165 with respect to the upper opening 154.

The first upper protrusion 165 may be inserted into the first upper slot 131, and the second upper protrusion 166 may be inserted into the second upper slot 132.

The first upper protrusion 165 and the second upper protrusion 166 may protrude upward from the top surface 164*a* of the horizontal extension part 164.

The first upper protrusion 165 and the second upper protrusion 166 may be spaced apart from each other in the direction of the arrow B of FIG. 10. The direction of the arrow B of FIG. 10 may be the same direction as the direction of the arrow B of FIG. 7.

Although not limited, the plurality of first upper protrusions 165 may be arranged to be spaced apart from each other in the direction of the arrow A.

The plurality of second upper protrusions 166 may be arranged to be spaced apart from each other in the direction of the arrow A.

For example, the first upper protrusion 165 may be provided in a curved shape. Also, for example, the second upper protrusion 166 may be provided in a curved shape.

In this embodiment, each of the upper protrusions 165 and 166 may be constructed so that the upper tray 150 and the upper case 120 are coupled to each other, and also, the horizontal extension part is prevented from being deformed during the ice making process or the ice separating process.

Here, when each of the upper protrusions 165 and 166 is provided in the curved shape, distances between the upper protrusions 165 and 166 and the upper chamber 152 in a longitudinal direction of the upper protrusions 165 and 166 may be equal or similar to each other to effectively prevent the horizontal extension parts 264 from being deformed.

For example, the deformation in the horizontal direction of the horizontal extension part 264 may be minimized to prevent the horizontal extension part 264 from being plastic-deformed. If when the horizontal extension part 264 is plastic-deformed, since the upper tray body is not positioned at the correct position during the ice making, the shape of the ice may not close to the spherical shape.

The horizontal extension part 164 may further include a plurality of lower protrusions 167 and 168. The plurality of lower protrusions 167 and 168 may be inserted into a lower slot of the upper support 170, which will be described below.

The plurality of lower protrusions 167 and 168 may include a first lower protrusion 167 and a second lower protrusion 168 disposed at an opposite side of the first lower protrusion 167 with respect to the upper chamber 152.

The first lower protrusion 167 and the second lower protrusion 168 may protrude downward from the bottom surface 164*b* of the horizontal extension part 164.

The first lower protrusion 167 may be disposed at an opposite to the first upper protrusion 165 with respect to the horizontal extension part 164. The second lower protrusion 168 may be disposed at an opposite side of the second upper protrusion 166 with respect to the horizontal extension part 164.

The first lower protrusion 167 may be spaced apart from the vertical wall 153*a* of the upper tray body 151. The second lower protrusion 168 may be spaced apart from the curved wall 153*b* of the upper tray body 151.

Each of the plurality of lower protrusions 167 and 168 may also be provided in a curved shape. Since the protrusions 165, 166, 167, and 168 are disposed on each of the top and bottom surfaces 164*a* and 164*b* of the horizontal extension part 164, the deformation in the horizontal direction of the horizontal extension part 164 may be effectively prevented.

A through-hole 169 through which the coupling boss of the upper support 170, which will be described later, may be provided in the horizontal extension part 164.

For example, a plurality of through-holes 169 may be provided in the horizontal extension part 164.

A portion of the plurality of through-holes 169 may be disposed between the two first upper protrusions 165 adjacent to each other or the two first lower protrusions 167 adjacent to each other.

The other portion of the plurality of through-holes 169 may be disposed between the two second lower protrusions 168 adjacent to each other or be disposed to face a region between the two second lower protrusions 168.

<Upper Support>

Figure 12:
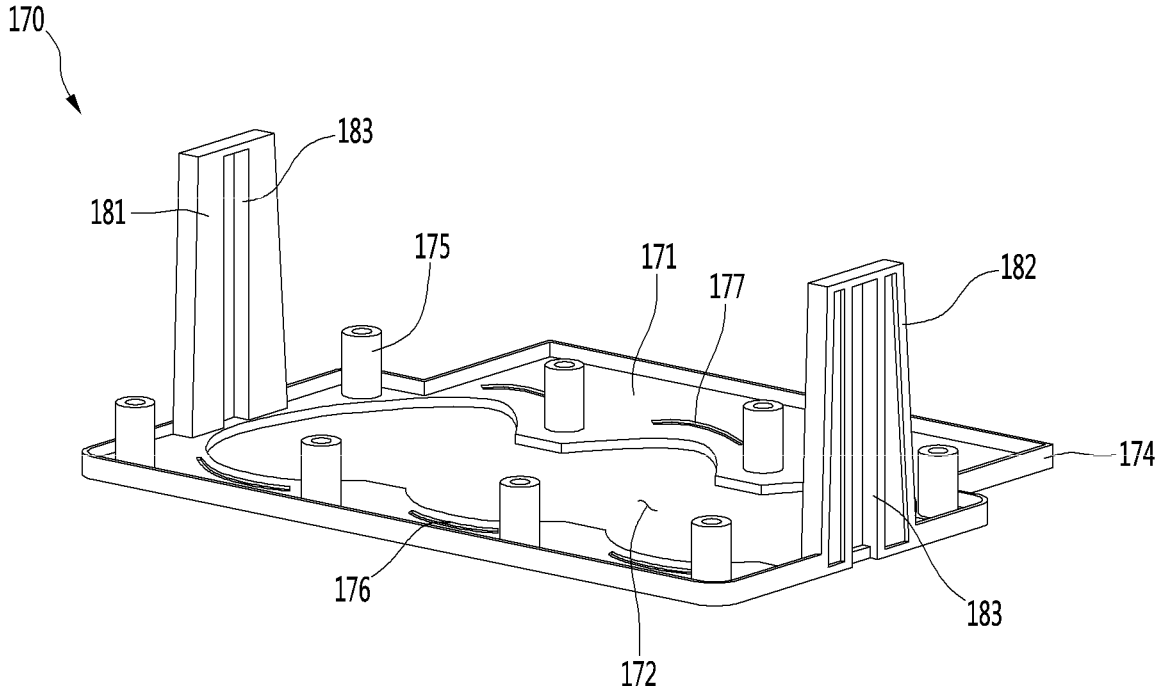
FIG. 12 is an upper perspective view of an upper support according to an embodiment.
Figure 13:
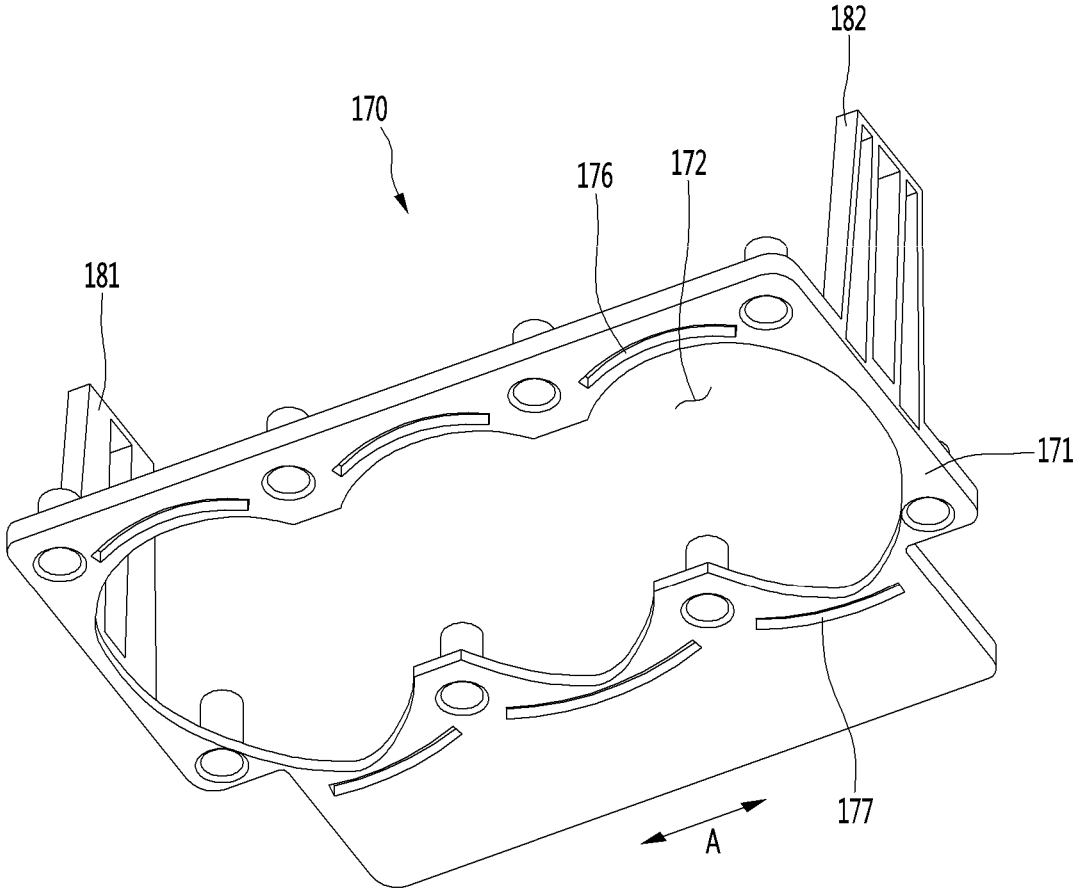
FIG. 13 is a lower perspective view of an upper support according to an embodiment.

FIG. 12 is an upper perspective view of an upper support according to an embodiment. FIG. 13 is a lower perspective view of an upper support according to an embodiment.

Referring to FIGS. 12 and 13, the upper support 170 may include a support plate 171 contacting the upper tray 150.

For example, a top surface of the support plate 171 may contact the bottom surface 164*b* of the horizontal extension part 164 of the upper tray 150.

A plate opening 172 through which the upper tray body 151 passes may be defined in the support plate 171.

A circumferential wall 174 that is bent upward may be provided on an edge of the support plate 171. For example, the circumferential wall 174 may contact at least a portion of a circumference of a side surface of the horizontal extension part 164.

Also, a top surface of the circumferential wall 174 may contact a bottom surface of the upper plate 121.

The support plate 171 may include a plurality of lower slots 176 and 177.

The plurality of lower slots 176 and 177 may include a first lower slot 176 into which the first lower protrusion 167 is inserted and a second lower slot 177 into which the second lower protrusion 168 is inserted.

The plurality of first lower slots 176 may be disposed to be spaced apart from each other in the direction of the arrow A on the support plate 171. Also, the plurality of second lower slots 177 may be disposed to be spaced apart from each other in the direction of the arrow A on the support plate 171.

The support plate 171 may further include a plurality of coupling bosses 175. The plurality of coupling bosses 175 may protrude upward from the top surface of the support plate 171.

Each of the coupling bosses 175 may pass through the through-hole 169 of the horizontal extension part 164 and be inserted into the sleeve 133 of the upper case 120.

In the state in which the coupling boss 175 is inserted into the sleeve 133, a top surface of the coupling boss 175 may be disposed at the same height as a top surface of the sleeve 133 or disposed at a height lower than that of the top surface of the sleeve 133.

A coupling member coupled to the coupling boss 175 may be, for example, a bolt (see reference symbol B1 of FIG. 3). The bolt B1 may include a body part and a head part having a diameter greater than that of the body part. The bolt B1 may be coupled to the coupling boss 175 from an upper side of the coupling boss 175.

While the body part of the bolt B1 is coupled to the coupling boss 175, when the head part contacts the top surface of the sleeve 133, and the head part contacts the top surface of the sleeve 133 and the top surface of the coupling boss 175, assembling of the upper assembly 110 may be completed.

The upper support 170 may further include a plurality of unit guides 181 and 182 for guiding the connector 350 connected to the upper ejector 300.

The plurality of unit guides 181 and 182 may be, for example, disposed to be spaced apart from each other in the direction of the arrow A with respect to FIG. 13.

The unit guides 181 and 182 may extend upward from the top surface of the support plate 171. Each of the unit guides 181 and 182 may be connected to the circumferential wall 174.

Each of the unit guides 181 and 182 may include a guide slot 183 vertically extends.

In a state in which both ends of the ejector body 310 of the upper ejector 300 pass through the guide slot 183, the connector 350 is connected to the ejector body 310.

Thus, when the rotation force is transmitted to the ejector body 310 by the connector 350 while the lower assembly 200 rotates, the ejector body 310 may vertically move along the guide slot 183.

<Upper Heater Coupling Structure>

Figure 14:
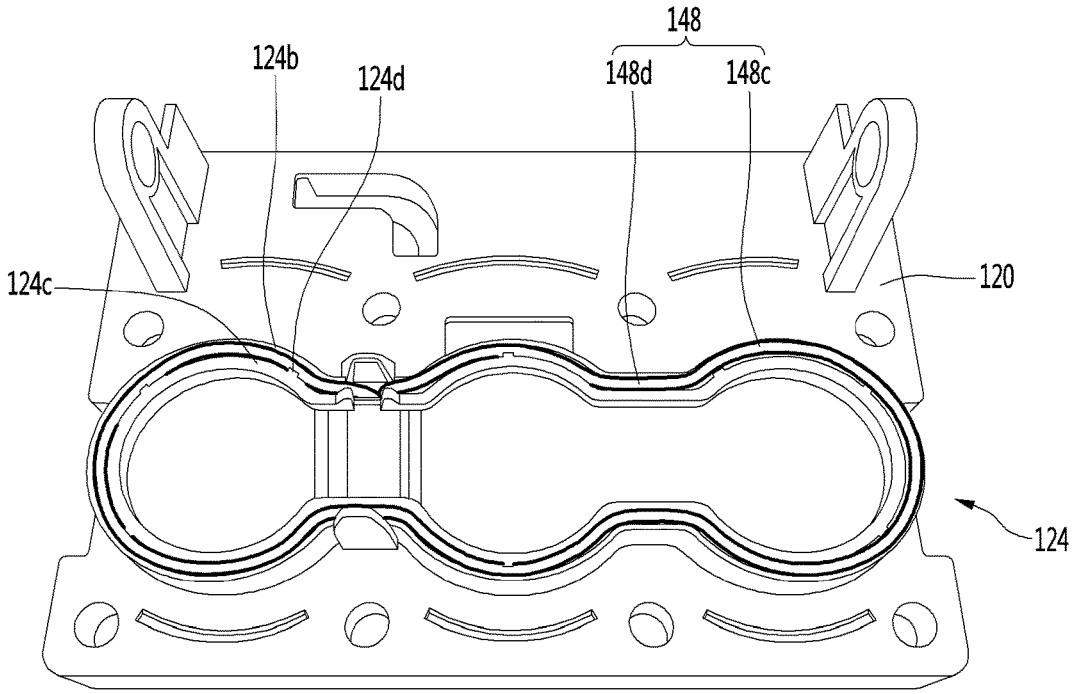
FIG. 14 is an enlarged view of a heater coupling part in the upper case of FIG. 6B.

FIG. 14 is an enlarged view of a heater coupling part in the upper case of FIG. 6B.

Referring to FIG. 14, the heater coupling part 124 may include a heater accommodation groove 124*a* accommodating the upper heater 148.

For example, the heater accommodation groove 124*a* may be defined by recessing a portion of a bottom surface of the recess 122 of the upper case 120 upward.

The heater accommodation groove 124*a* may extend along a circumference of the tray opening 123 of the upper case 120.

For example, the upper heater 148 may be a wire-type heater. Thus, the upper heater 148 may be bendable. The upper heater 148 may be bent to correspond to a shape of the heater accommodation groove 124*a* so as to accommodate the upper heater 148 in the heater accommodation groove 124*a*.

The upper heater 148 may be a DC heater receiving DC power. The upper heater 148 may be turned on to transfer ice.

When heat of the upper heater 148 is transferred to the upper tray 150, ice may be separated from a surface (inner face) of the upper tray 150.

If the upper tray 150 is made of a metal material, and the heat of the upper heater 148 has a high temperature, a portion of the ice, which is heated by the upper heater 148, may be adhered again to the surface of the upper tray after the upper heater 148 is turned off. As a result, the ice may be opaque.

That is, an opaque band having a shape corresponding to the upper heater may be formed around the ice.

However, in this embodiment, since the DC heater having low output is used, and the upper tray 150 is made of the silicon material, an amount of heat transferred to the upper tray 150 may be reduced, and thus, the upper tray itself may have low thermal conductivity.

Thus, the heat may not be concentrated into the local portion of the ice, and a small amount of heat may be slowly applied to prevent the opaque band from being formed around the ice because the ice is effectively separated from the upper tray.

The upper heater 148 may be disposed to surround the circumference of each of the plurality of upper chambers 152 so that the heat of the upper heater 148 is uniformly transferred to the plurality of upper chambers 152 of the upper tray 150.

Also, the upper heater 148 may contact the circumference of each of the chamber walls 153 respectively defining the plurality of upper chambers 152. Here, the upper heater 148 may be disposed at a position that is lower than that of the upper opening 154.

Since the heater accommodation groove 124*a* is recessed from the recess 122, the heater accommodation groove 124*a* may be defined by an outer wall 124*b* and an inner wall 124*c*.

The upper heater 148 may have a diameter greater than that of the heater accommodation groove 124*a* so that the upper heater 148 protrudes to the outside of the heater coupling part 124 in the state in which the upper heater 148 is accommodated in the heater accommodation groove 124*a*.

Since a portion of the upper heater 148 protrudes to the outside of the heater accommodation groove 124*a* in the state in which the upper heater 148 is accommodated in the heater accommodation groove 124*a*, the upper heater 148 may contact the upper tray 150.

A separation prevention protrusion 124*d* may be provided on one of the outer wall 124*b* and the inner wall 124*c* to prevent the upper heater 148 accommodated in the heater accommodation groove 124*a* from being separated from the heater accommodation groove 124*a*.

In FIG. 14, for example, a plurality of separation prevention protrusions 124*d* are provided on the inner wall 124*c*.

The separation prevention protrusion 124*d* may protrude from an end of the inner wall 124*c* toward the outer wall 124*b*.

Here, a protruding length of the separation prevention protrusion 124*d* may be less than about ½ of a distance between the outer wall 124*b* and the inner wall 124*c* to prevent the upper heater 148 from being easily separated from the heater accommodation groove 124*a* without interfering with the insertion of the upper heater 148 by the separation prevention protrusion 124*d*.

As illustrated in FIG. 14, in the state in which the upper heater 148 is accommodated in the heater accommodation groove 124*a*, the upper heater 148 may be divided into an upper rounded portion 148*c* and an upper linear portion 148*d*.

That is, the heater accommodation groove 124*a* may include an upper rounded portion and an upper linear portion. Thus, the upper heater 148 may be divided into the upper rounded portion 148*c* and the upper linear portion 148*d* to correspond to the upper rounded portion and the linear portion of the heater accommodation groove 124*a*.

The upper rounded portion 148*c* may be a portion disposed along the circumference of the upper chamber 152 and also a portion that is bent to be rounded in a horizontal direction.

The liner portion 148*d* may be a portion connecting the upper rounded portions 148*c* corresponding to the upper chambers 152 to each other.

Since the upper heater 148 is disposed at a position lower than that of the upper opening 154, a line connecting two points of the upper rounded portions, which are spaced apart from each other, to each other may pass through upper chamber 152.

Since the upper rounded portion 148*c* of the upper heater 148 may be separated from the heater accommodation groove 124*a*, the separation prevention protrusion 124*d* may be disposed to contact the upper rounded portion 148*c*.

Figure 15:
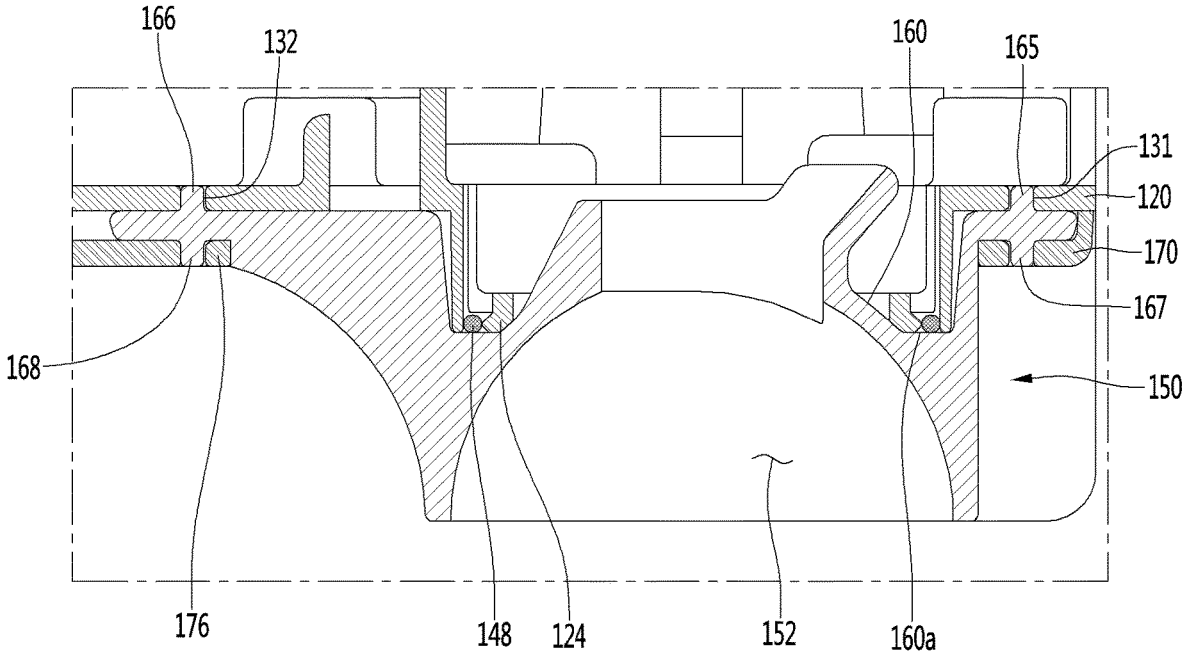
FIG. 15 is a cross-sectional view illustrating a state in which an upper assembly is assembled.

FIG. 15 is a cross-sectional view illustrating a state in which an upper assembly is assembled.

Referring to FIGS. 3 and 15, in the state in which the upper heater 148 is coupled to the heater coupling part 124 of the upper case 120, the upper case 120, the upper tray 150, and the upper support 170 may be coupled to each other.

The first upper protrusion 165 of the upper tray 150 may be inserted into the first upper slot 131 of the upper case 120. Also, the second upper protrusion 166 of the upper tray 150 may be inserted into the second upper slot 132 of the upper case 120.

Then, the first lower protrusion 167 of the upper tray 150 may be inserted into the first lower slot 176 of the upper support 170, and the second lower protrusion 168 of the upper tray 150 may be inserted into the second lower slot 177 of the upper support 170.

Thus, the coupling boss 175 of the upper support 170 may pass through the through-hole of the upper tray 150 and then be accommodated in the sleeve 133 of the upper case 120. In this state, the bolt B1 may be coupled to the coupling boss 175 from an upper side of the coupling boss 175.

In the state in which the bolt B1 is coupled to the coupling boss 175, the head part of the bolt B1 may be disposed at a position higher than that of the upper plate 121.

On the other hand, since the hinge supports 135 and 136 are disposed lower than the upper plate 121, while the lower assembly 200 rotates, the upper assembly 110 or the connector 350 may be prevented from interfering with the head part of the bolt B1.

While the upper assembly 110 is assembled, a plurality of unit guides 181 and 182 of the upper support 170 may protrude upward from the upper plate 121 through the through-opening 139*b* and 139*c* defined in both sides of the upper plate 121.

As described above, the upper ejector 300 passes through the guide slots 183 of the unit guides 181 and 182 protruding upward from the upper plate 121.

Thus, the upper ejector 300 may descend in the state of being disposed above the upper plate 121 and be inserted into the upper chamber 152 to separate ice of the upper chamber 152 from the upper tray 150.

When the upper assembly 110 is assembled, the heater coupling part 124 to which the upper heater 148 is coupled may be accommodated in the first accommodation part 160 of the upper tray 150.

In the state in which the heater coupling part 124 is accommodated in the first accommodation part 160, the upper heater 148 may contact the bottom surface 160*a* of the first accommodation part 160.

Like this embodiment, when the upper heater 148 is accommodated in the heater coupling part 124 having the recessed shape to contact the upper tray body 151, heat of the upper heater 148 may be minimally transferred to other portion except for the upper tray body 151.

At least a portion of the upper heater 148 may be disposed to vertically overlap the upper chamber 152 so that the heat of the upper heater 148 is smoothly transferred to the upper chamber 152.

In this embodiment, the upper rounded portion 148*c* of the upper heater 148 may vertically overlap the upper chamber 152.

That is, a maximum distance between two points of the upper rounded portion 148*c*, which are disposed at opposite sides with respect to the upper chamber 152 may be less than a diameter of the upper chamber 152.

<Lower Case>

Figure 16:
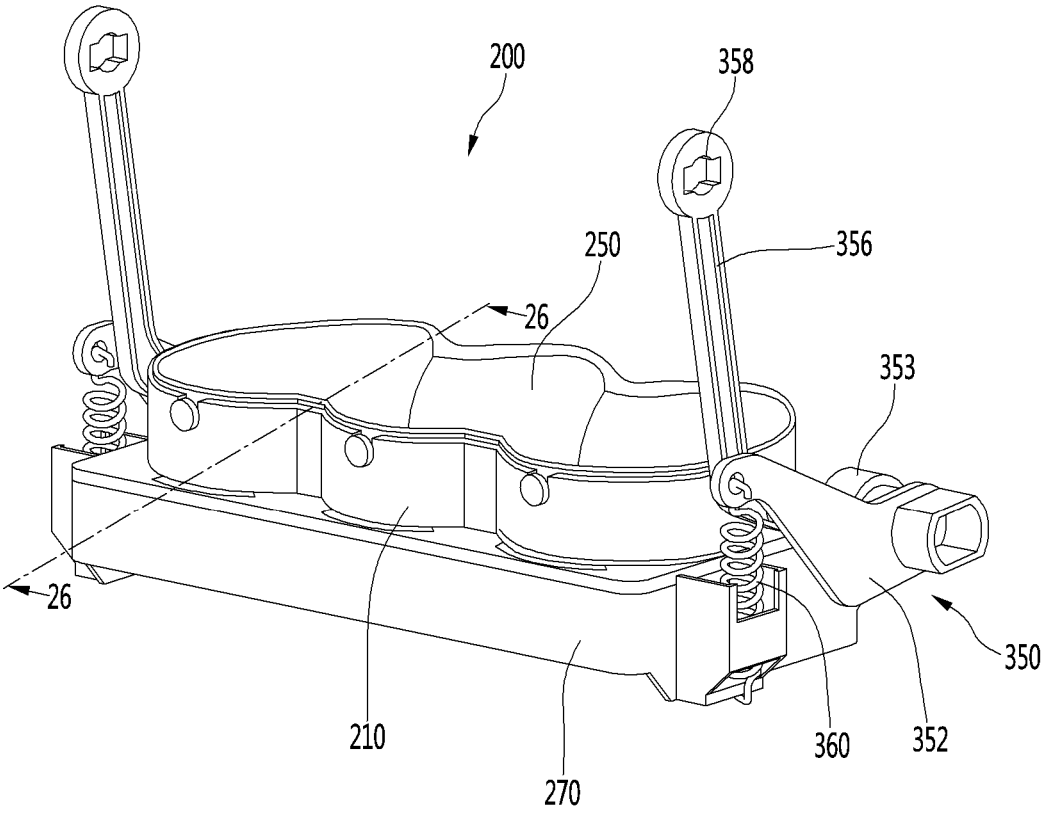
FIG. 16 is a perspective view of a lower assembly according to an embodiment.
Figure 17:
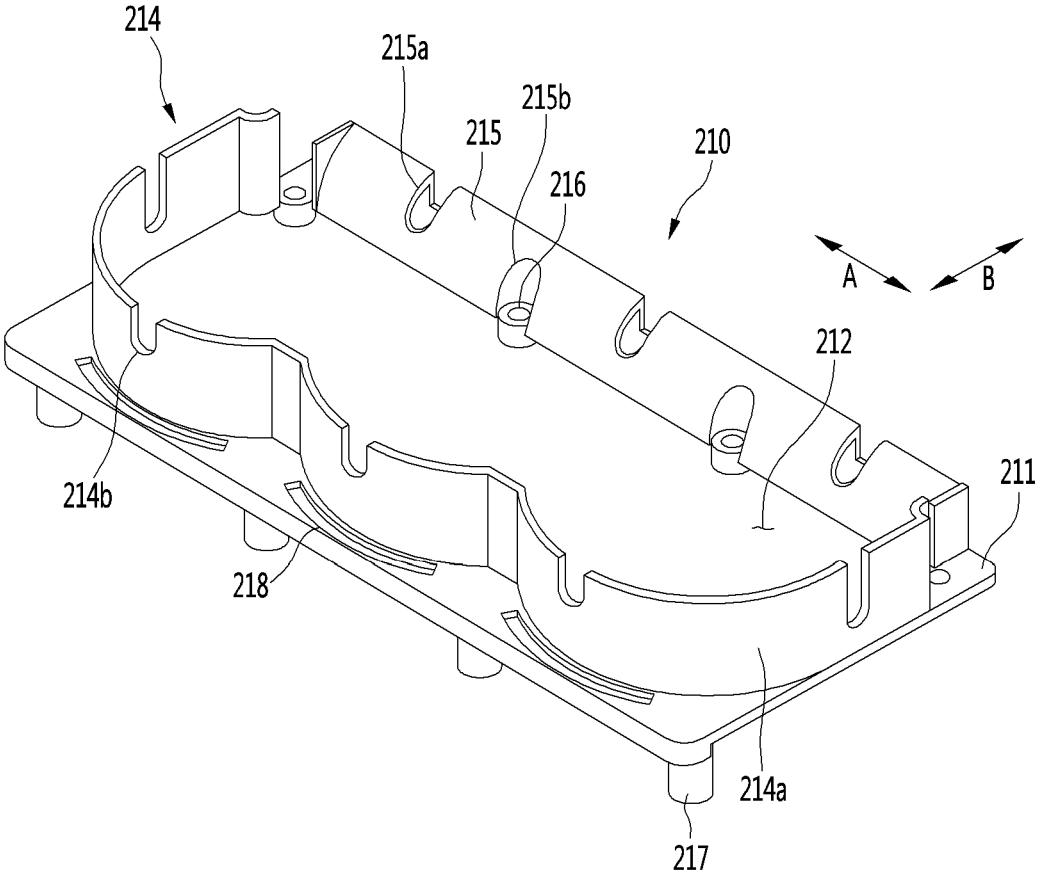
FIG. 17 is an upper perspective view of a lower case according to an embodiment.
Figure 18:
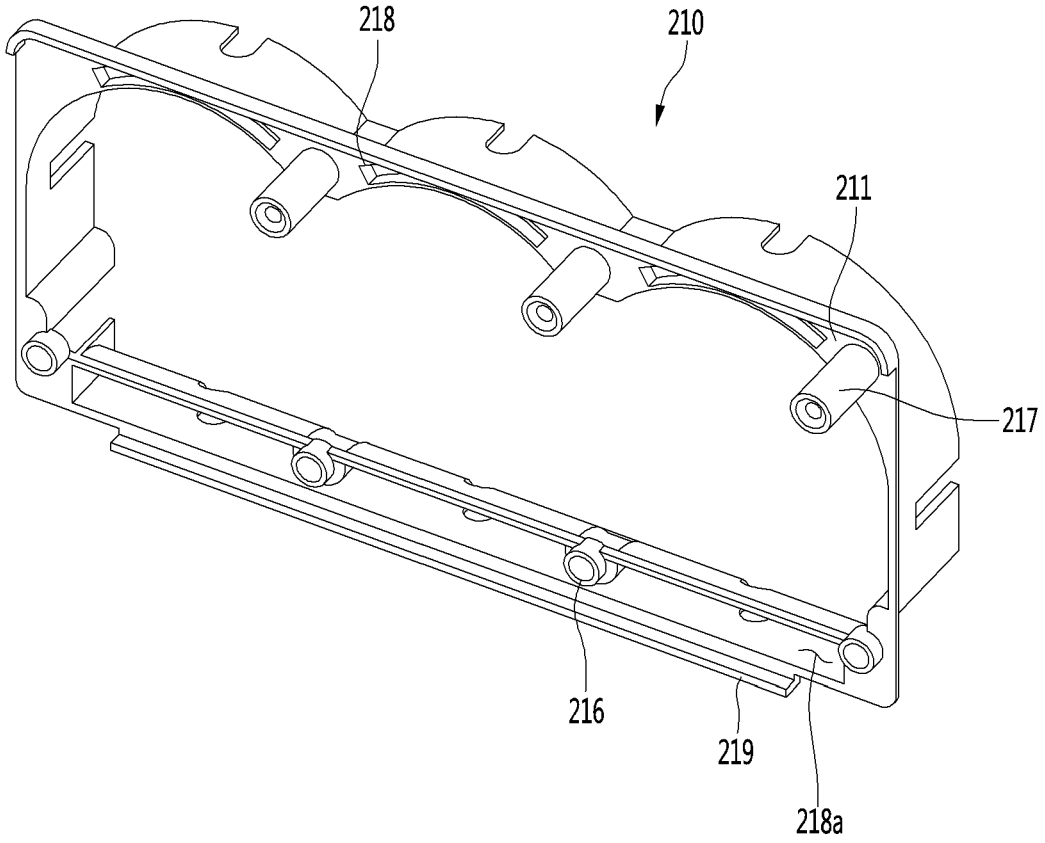
FIG. 18 is a lower perspective view of a lower case according to an embodiment.

FIG. 16 is a perspective view of a lower assembly according to an embodiment. FIG. 17 is an upper perspective view of a lower case according to an embodiment. FIG. 18 is a lower perspective view of a lower case according to an embodiment.

Referring to FIGS. 16 to 17, the lower assembly 200 may include a lower tray 250. The lower tray 250 defines the ice chamber 121 together with the upper tray 150.

The lower assembly 200 may further include a lower support 270 that supports the lower tray 250. The lower support 270 and the lower tray 250 may rotate together while the lower tray 250 is seated on the lower support 270.

The lower assembly 200 may further include a lower case 210 for fixing a position of the lower tray 250.

The lower case 210 may surround the circumference of the lower tray 250, and the lower support 270 may support the lower tray 250.

The connector 350 may be coupled to the lower support 270.

The connector 350 may include a first link 352 that receives power of the driver 180 to allow the lower support 270 to rotate and a second link 356 connected to the lower support 270 to transmit rotation force of the lower support 270 to the upper ejector 300 when the lower support 270 rotates.

The first link 352 and the lower support 270 may be connected to each other by an elastic member 360. For example, the elastic member 360 may be a coil spring.

The elastic member 360 may have one end connected to the first link 362 and the other end connected to the lower support 270.

The elastic member 360 provides elastic force to the lower support 270 so that contact between the upper tray 150 and the lower tray 250 is maintained.

In this embodiment, the first link 352 and the second link 356 may be disposed on both sides of the lower support 270, respectively.

One of the two first links may be connected to the driver 180 to receive the rotation force from the driver 180.

The two first links 352 may be connected to each other by the connection shaft 370.

A hole 358 through which the ejector body 310 of the upper ejector 300 passes may be defined in an upper end of the second link 356.

The lower case 210 may include a lower plate 211 for fixing the lower tray 250.

A portion of the lower tray 250 may be fixed to contact a bottom surface of the lower plate 211.

An opening 212 through which a portion of the lower tray 250 passes may be defined in the lower plate 211.

For example, when the lower tray 250 is fixed to the lower plate 211 in a state in which the lower tray 250 is disposed below the lower plate 211, a portion of the lower tray 250 may protrude upward from the lower plate 211 through the opening 212.

The lower case 210 may further include a circumferential wall 214 (or a cover wall) surrounding the lower tray 250 passing through the lower plate 211.

The circumferential wall 214 may include a vertical wall 214*a* and a curved wall 215.

The vertical wall 214*a* is a wall vertically extending upward from the lower plate 211. The curved wall 215 is a wall that is rounded in a direction that is away from the opening 212 upward from the lower plate 211.

The vertical wall 214*a* may include a first coupling slit 214*b* coupled to the lower tray 250. The first coupling slit 214*b* may be defined by recessing an upper end of the vertical wall downward.

The curved wall 215 may include a second coupling slit 215*a* to the lower tray 250.

The second coupling slit 215*a* may be defined by recessing an upper end of the curved wall 215 downward.

The lower case 210 may further include a first coupling boss 216 and a second coupling boss 217.

The first coupling boss 216 may protrude downward from the bottom surface of the lower plate 211. For example, the plurality of first coupling bosses 216 may protrude downward from the lower plate 211.

The plurality of first coupling bosses 216 may be arranged to be spaced apart from each other in the direction of the arrow A with respect to FIG. 17.

The second coupling boss 217 may protrude downward from the bottom surface of the lower plate 211. For example, the plurality of second coupling bosses 217 may protrude from the lower plate 211. The plurality of first coupling bosses 217 may be arranged to be spaced apart from each other in the direction of the arrow A with respect to FIG. 17.

The first coupling boss 216 and the second coupling boss 217 may be disposed to be spaced apart from each other in the direction of the arrow B.

In this embodiment, a length of the first coupling boss 216 and a length of the second coupling boss 217 may be different from each other. For example, the first coupling boss 216 may have a length less than that of the second coupling boss 217.

The first coupling member may be coupled to the first coupling boss 216 at an upper portion of the first coupling boss 216. On the other hand, the second coupling member may be coupled to the second coupling boss 217 at a lower portion of the second coupling boss 217.

A groove 215*b* for movement of the coupling member may be defined in the curved wall 215 to prevent the first coupling member from interfering with the curved wall 215 while the first coupling member is coupled to the first coupling boss 216.

The lower case 210 may further include a slot 218 coupled to the lower tray 250.

A portion of the lower tray 250 may be inserted into the slot 218. The slot 218 may be disposed adjacent to the vertical wall 214*a*.

For example, a plurality of slots 218 may be defined to be spaced apart from each other in the direction of the arrow A of FIG. 17. Each of the slots 218 may have a curved shape.

The lower case 210 may further include an accommodation groove 218*a* into which a portion of the lower tray 250 is inserted.

The accommodation groove 218*a* may be defined by recessing a portion of the lower tray 211 toward the curved wall 215.

The lower case 210 may further include an extension wall 219 contacting a portion of the circumference of the side surface of the lower plate 212 in the state of being coupled to the lower tray 250. The extension wall 219 may linearly extend in the direction of the arrow A.

<Lower Tray>

Figure 19:
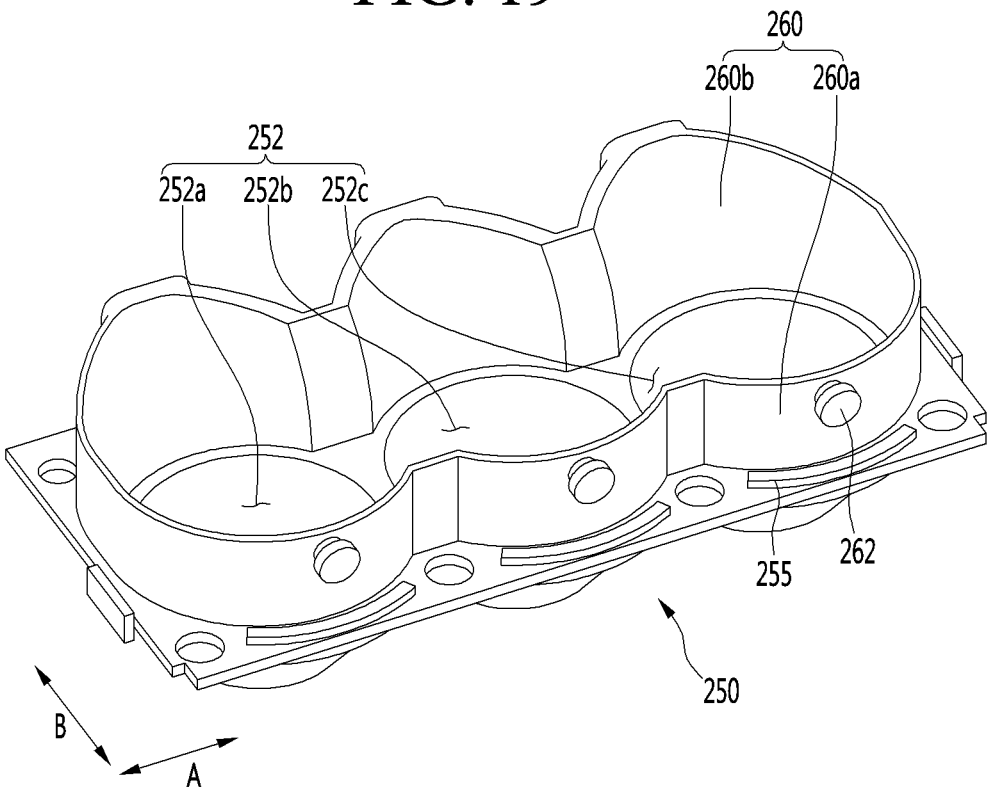
FIGS. 19 and 20 are perspective views of a lower tray viewed from above according to an embodiment.
Figure 20:
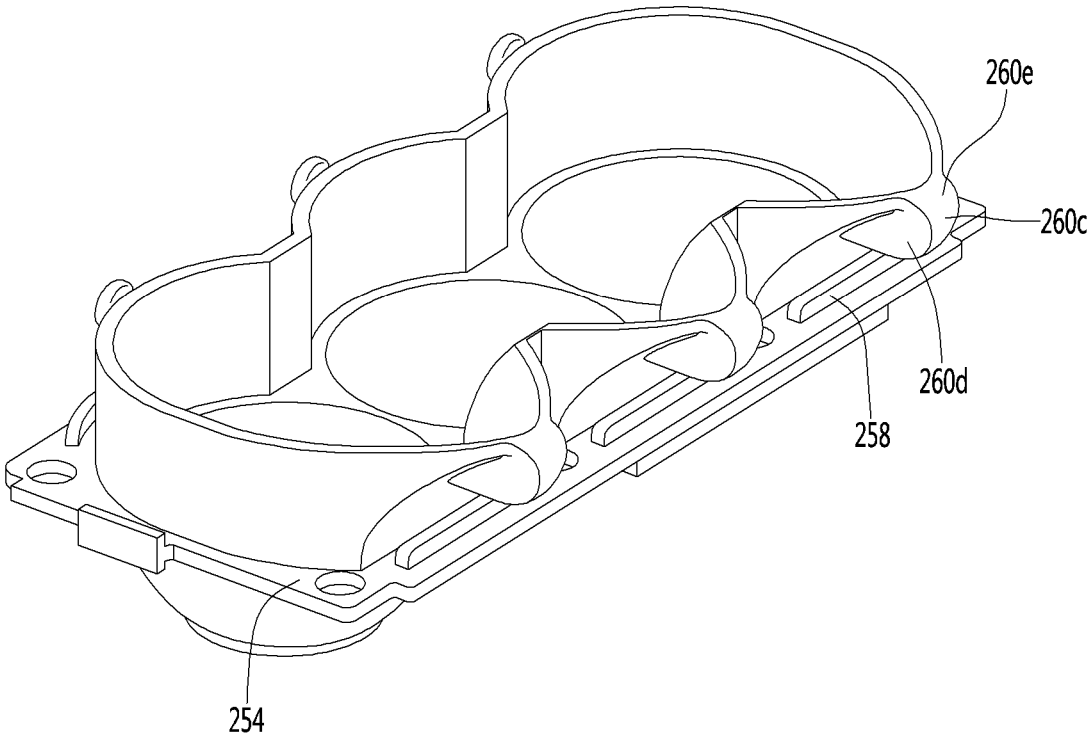
Figure 21:
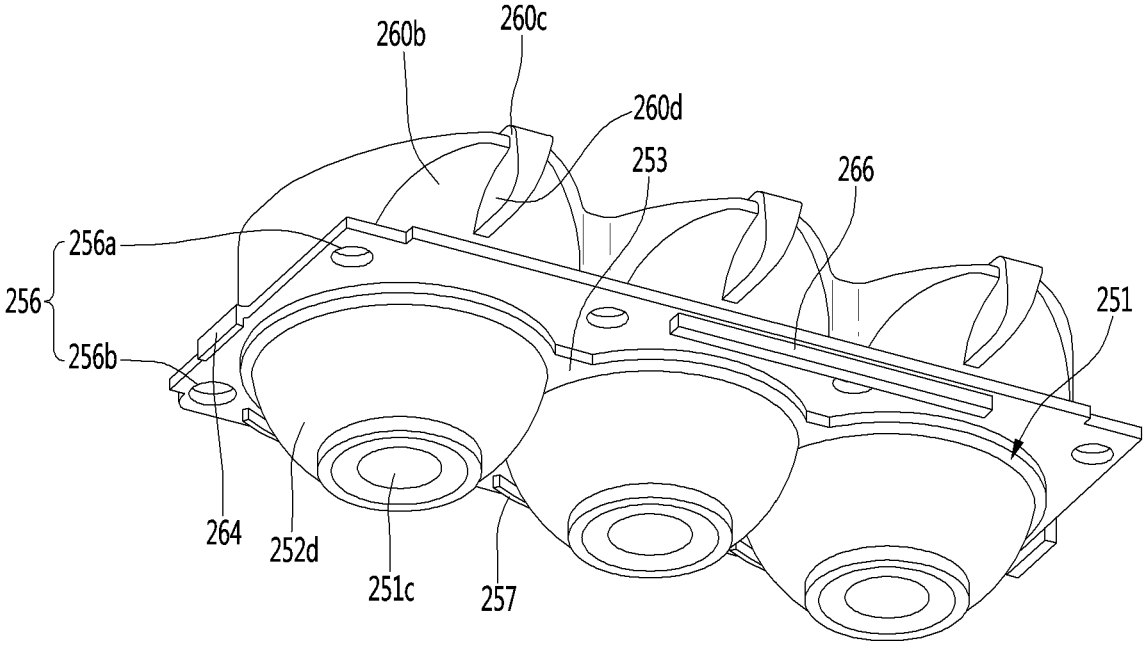
FIG. 21 is a perspective view of a lower tray viewed from below according to an embodiment.
Figure 22:
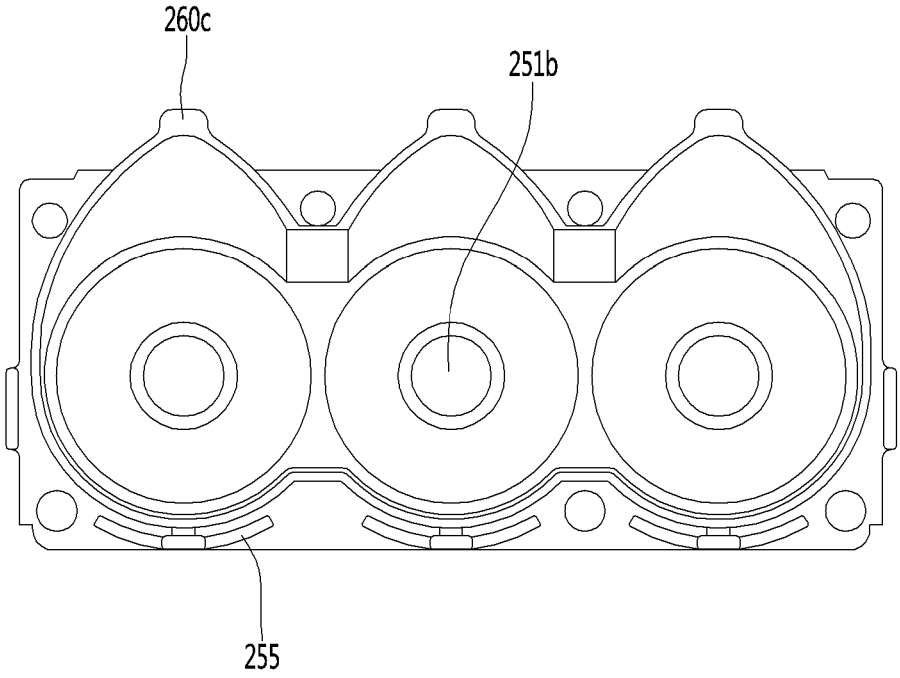
FIG. 22 is a plan view of a lower tray according to an embodiment.
Figure 23:
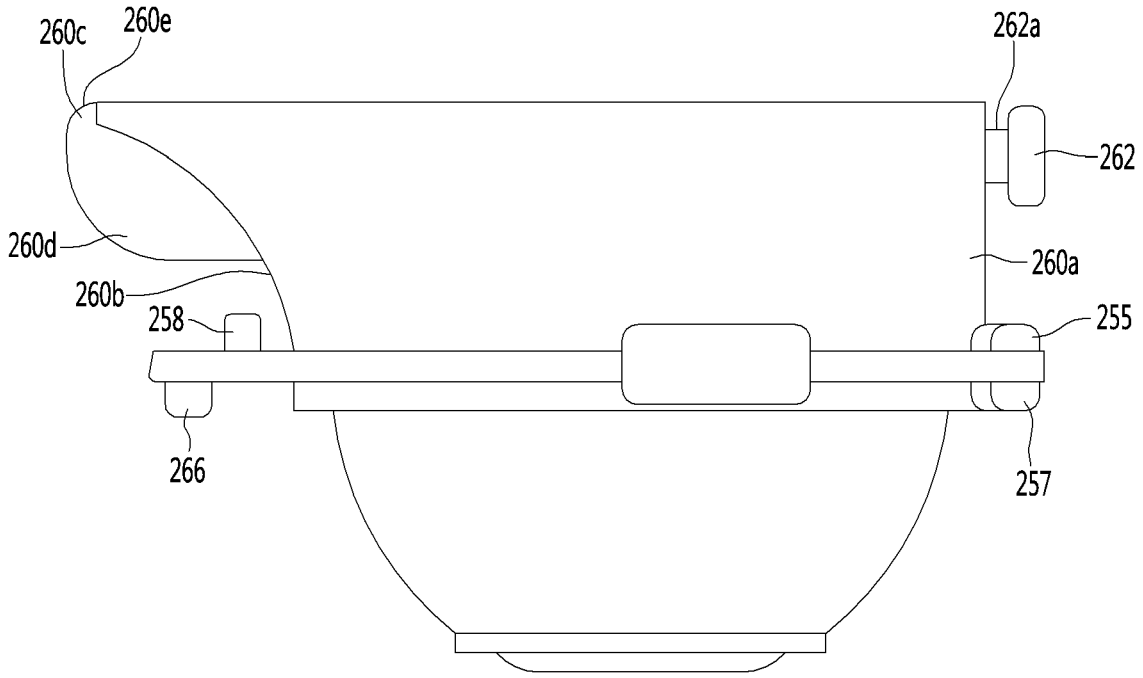
FIG. 23 is a side view of a lower tray according to an embodiment.

FIGS. 19 and 20 are perspective views of a lower tray viewed from above according to an embodiment. FIG. 21 is a perspective view of a lower tray viewed from below according to an embodiment. FIG. 22 is a plan view of a lower tray according to an embodiment. FIG. 23 is a side view of a lower tray according to an embodiment.

Referring to FIGS. 19 to 23, the lower tray 250 may be made of a flexible material that is capable of being restored to its original shape after being deformed by an external force.

For example, the lower tray 250 may be made of a silicon material. Like this embodiment, when the lower tray 250 is made of a silicon material, the lower tray 250 may be restored to its original shape even through external force is applied to deform the lower tray 250 during the ice separating process. Thus, in spite of repetitive ice making, spherical ice may be made.

If the lower tray 250 is made of a metal material, when the external force is applied to the lower tray 250 to deform the lower tray 250 itself, the lower tray 250 may not be restored to its original shape any more.

In this case, after the lower tray 250 is deformed in shape, the spherical ice may not be made. That is, it is impossible to repeatedly make the spherical ice.

On the other hand, like this embodiment, when the lower tray 250 is made of the flexible material that is capable of being restored to its original shape, this limitation may be solved.

Also, when the lower tray 250 is made of the silicon material, the lower tray 250 may be prevented from being melted or thermally deformed by heat provided from an upper heater that will be described later.

The lower tray 250 may include a lower tray body 251 defining a lower chamber 252 that is a portion of the ice chamber 111.

The lower tray body 251 may be defined by a plurality of lower chambers 252.

For example, the plurality of lower chambers 252 may include a first lower chamber 252*a*, a second lower chamber 252*b*, and a third lower chamber 252*c*.

The lower tray body 251 may include three chamber walls 252*d* defining three independent lower chambers 252*a*, 252*b*, and 252*c*. The three chamber walls 252*d* may be integrated in one body to form the lower tray body 251.

In one example, the chamber wall 252*d* may have a hemispherical form.

The first lower chamber 252*a*, the second lower chamber 252*b*, and the third lower chamber 252*c* may be arranged in a line. For example, the first lower chamber 252*a*, the second lower chamber 252*b*, and the third lower chamber 252*c* may be arranged in a direction of an arrow A with respect to FIG. 19.

Accordingly, the lower chamber 252 may have a hemispherical shape or a shape similar to the hemispherical shape. That is, a lower portion of the spherical ice may be made by the lower chamber 252.

In the specification, a similar shape to a hemisphere may refer to a shape approximately close to a hemisphere but not a complete hemisphere.

The lower tray 250 may further include a first extension part 253 horizontally extending from an edge of an upper end of the lower tray body 251. The first extension part 253 may be continuously formed along the circumference of the lower tray body 251.

The lower tray 250 may further include a circumferential wall 260 extended upward from an upper surface of the first extension part 253.

A bottom surface of the upper tray body 151 may be contact with the top surface 251*e* of the lower tray body 251.

The circumferential wall 260 may surround the upper tray body 251 seated on the top surface 251*e* of the lower tray body 251.

The circumferential wall 260 may include a first wall 260*a* surrounding the vertical wall 153*a* of the upper tray body 151 and a second wall 260*b* surrounding the curved wall 153*b* of the upper tray body 151.

The first wall 260*a* is a vertical wall vertically extending from the top surface of the first extension part 253. The second wall 260*b* is a curved wall having a shape corresponding to that of the upper tray body 151. That is, the second wall 260*b* may be rounded upward from the first extension part 253 in a direction that is away from the lower chamber 252.

The lower tray 250 may further include a second extension part 254 horizontally extending from the circumferential wall 260.

The second extension part 254 may be disposed higher than the first extension part 253. Thus, the first extension part 253 and the second extension part 254 may be stepped with respect to each other.

The second extension part 254 may include a first upper protrusion 255 inserted into the slot 218 of the lower case 210. The first upper protrusion 255 may be disposed to be horizontally spaced apart from the circumferential wall 260.

For example, the first upper protrusion 255 may protrude upward from a top surface of the second extension part 254 at a position adjacent to the first wall 260*a*.

Although not limited, a plurality of first upper protrusions 255 may be arranged to be spaced apart from each other in the direction of the arrow A with respect to FIG. 20. The first upper protrusion 255 may extend, for example, in a curved shape.

The second extension part 254 may include a first lower protrusion 257 inserted into a protrusion groove of the lower case 270, which will be described later. The first lower protrusion 257 may protrude downward from a bottom surface of the second extension part 254.

Although not limited, the plurality of first lower protrusions 257 may be arranged to be spaced apart from each other in the direction of arrow A.

The first upper protrusion 255 and the first lower protrusion 257 may be disposed at opposite sides with respect to a vertical direction of the second extension part 254. At least a portion of the first upper protrusion 255 may vertically overlap the second lower protrusion 257.

A plurality of through-holes may be defined in the second extension part 254.

The plurality of through-holes 256 may include a first through-hole 256*a* through which the first coupling boss 216 of the lower case 210 passes and a second through-hole 256*b* through which the second coupling boss 217 of the lower case 210 passes.

For example, the plurality of through-holes 256*a* may be defined to be spaced apart from each other in the direction of the arrow A of FIG. 19.

Also, the plurality of second through-holes 256*b* may be disposed to be spaced apart from each other in the direction of the arrow A of FIG. 19.

The plurality of first through-holes 256*a* and the plurality of second through-holes 256*b* may be disposed at opposite sides with respect to the lower chamber 252.

A portion of the plurality of second through-holes 256*b* may be defined between the two first upper protrusions 255. Also, a portion of the plurality of second through-holes 256*b* may be defined between the two first lower protrusions 257.

The second extension part 254 may further a second upper protrusion 258. The second upper protrusion 258 may be disposed at an opposite side of the first upper protrusion 255 with respect to the lower chamber 252.

The second upper protrusion 258 may be disposed to be horizontally spaced apart from the circumferential wall 260. For example, the second upper protrusion 258 may protrude upward from a top surface of the second extension part 254 at a position adjacent to the second wall 260*b*.

Although not limited, the plurality of second upper protrusions 258 may be arranged to be spaced apart from each other in the direction of the arrow A of FIG. 19.

The second upper protrusion 258 may be accommodated in the accommodation groove 218*a* of the lower case 210. In the state in which the second upper protrusion 258 is accommodated in the accommodation groove 218*a*, the second upper protrusion 258 may contact the curved wall 215 of the lower case 210.

The circumferential wall 260 of the lower tray 250 may include a first coupling protrusion 262 coupled to the lower case 210.

The first coupling protrusion 262 may horizontally protrude from the first wall 260*a* of the circumferential wall 260. The first coupling protrusion 262 may be disposed on an upper portion of a side surface of the first wall 260*a*.

The first coupling protrusion 262 may include a neck part 262*a* having a relatively less diameter when compared to those of other portions. The neck part 262*a* may be inserted into a first coupling slit 214*b* defined in the circumferential wall 214 of the lower case 210.

The circumferential wall 260 of the lower tray 250 may further include a second coupling protrusion 262*c* coupled to the lower case 210.

The second coupling protrusion 262*c* may horizontally protrude from the second wall 260*a* of the circumferential wall 260. The second coupling protrusion 260*c* may be inserted into a second coupling slit 215*a* defined in the circumferential wall 214 of the lower case 210.

The second coupling protrusion 260*c* may prevent an end of the second wall 260*b* of the lower tray 250 from contacting upper tray 150 and from being deformed during a procedure in which the lower tray 250 is rotated in an opposite direction.

When an end of the second wall 260*b* of the lower tray 250 contacts the upper tray 150 and is deformed, the lower tray 250 may be moved to a water supply position in the state in which the lower tray 250 enters the upper chamber 152 of the upper tray 150. In this case, when ice is made after water is supplied, ice may not be formed in a sphere.

Thus, when the second coupling protrusion 260*c* protrudes from the second wall 260*b*, the second wall 260*b* may be prevented from being deformed. Thus, the second coupling protrusion 260*c* may be referred to as an anti-deformation protrusion.

The second coupling protrusion 260*c* may protrude in a horizontal direction from the second wall 260*b*.

An upper end of the second coupling protrusion 260*c* may be positioned at the same height as an upper end of the second wall 260*b*.

The second coupling protrusion 260*c* may include a rounded surface 260*e* that is rounded downward from an upper side toward an external side in order to prevent the second coupling protrusion 260*c* from interfering with the upper tray 150 during a rotation procedure of the lower tray 250.

A portion of a lower portion 260*d* of the second coupling protrusion 260*c* may be formed with a thickness that is reduced downward. The lower portion 260*d* of the second coupling protrusion 260*c* may be inserted into the second coupling slit 215*a*.

The lower portion 260*d* of the second coupling protrusion 260*c* may be referred to as an insertion part. A lower surface of the insertion part may be a flat surface in such a way that the insertion part is stably positioned in the state in which the insertion part is inserted into the second coupling slit 215*a*.

The lower portion 260*d* of the second coupling protrusion 260*c* may be spaced apart from the second extension part 254 of the lower tray 250 in such a way that the lower portion 260*d* of the second coupling protrusion 260*c* is inserted into the second coupling slit 215*a*.

The second extension part 254 may include a second lower protrusion 266. The second lower protrusion 266 may be disposed at an opposite side of the second lower protrusion 257 with respect to the lower chamber 252.

The second lower protrusion 266 may protrude downward from a bottom surface of the second extension part 254. For example, the second lower protrusion 266 may linearly extend.

A portion of the plurality of first through-holes 256*a* may be defined between the second lower protrusion 266 and the lower chamber 252.

The second lower protrusion 266 may be accommodated in a guide groove defined in the lower support 270, which will be described later.

The second extension part 254 may further a side restriction part 264. The side restriction part 264 restricts horizontal movement of the lower tray 250 in the state in which the lower tray 250 is coupled to the lower case 210 and the lower support 270.

The side restriction part 264 laterally protrudes from the second extension part 254 and has a vertical length greater than a thickness of the second extension part 254. For example, one portion of the side restriction part 264 may be disposed higher than the top surface of the second extension part 254, and the other portion of the side restriction part 264 may be disposed lower than the bottom surface of the second extension part 254.

Thus, the one portion of the side restriction part 264 may contact a side surface of the lower case 210, and the other portion may contact a side surface of the lower support 270. In one example, the lower tray body 251 may has a heater contact portion 251*a* which the lower heater 296 contacts. In one example, the heater contact portion 251*a* may be formed on each of the chamber walls 252*d*. The heater contact portion 251*a* may protrude from the respective chamber wall 252*d*. In one example, the heater contact portion 251*a* may be formed in a circular ring shape.

The lower tray body 251 may further include the convex portion 251*b*, a lower side of which is formed to be partially convex upward. That is, the convex portion 251*b* may be disposed to be convex toward an internal side of the ice chamber 111.

<Lower Support>

Figure 24:
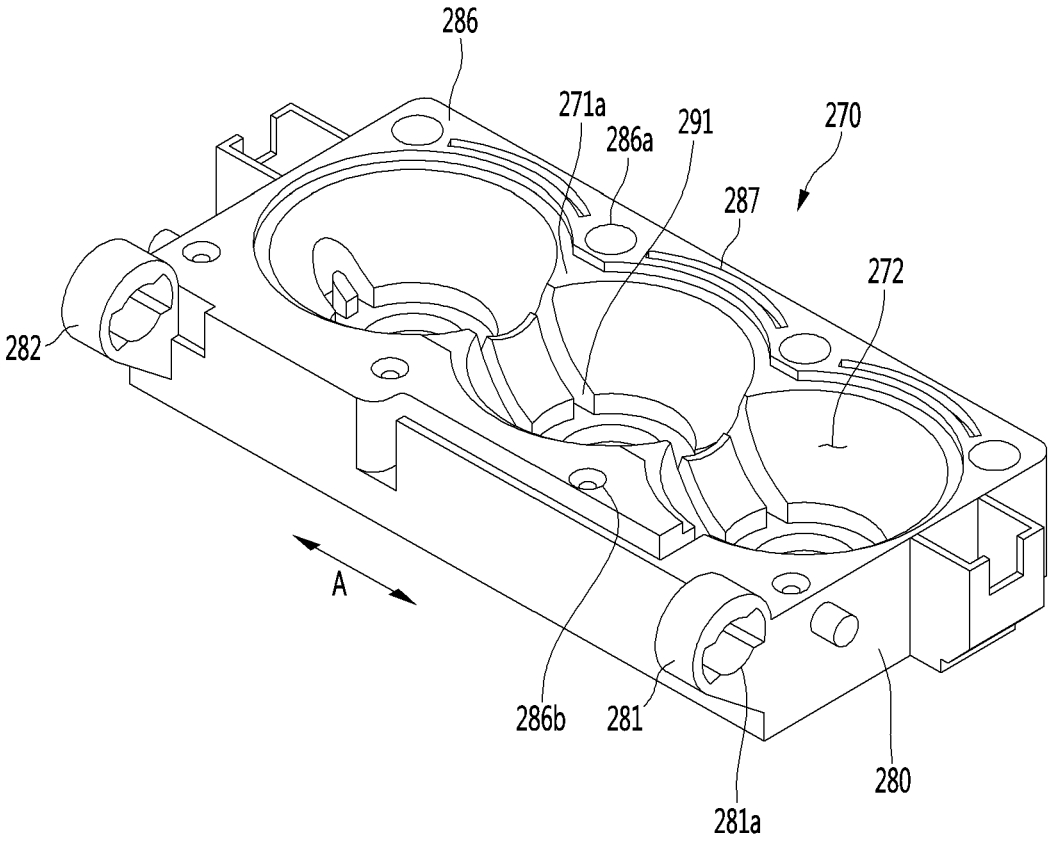
FIG. 24 is a top perspective view of the lower support according to an embodiment.
Figure 25:
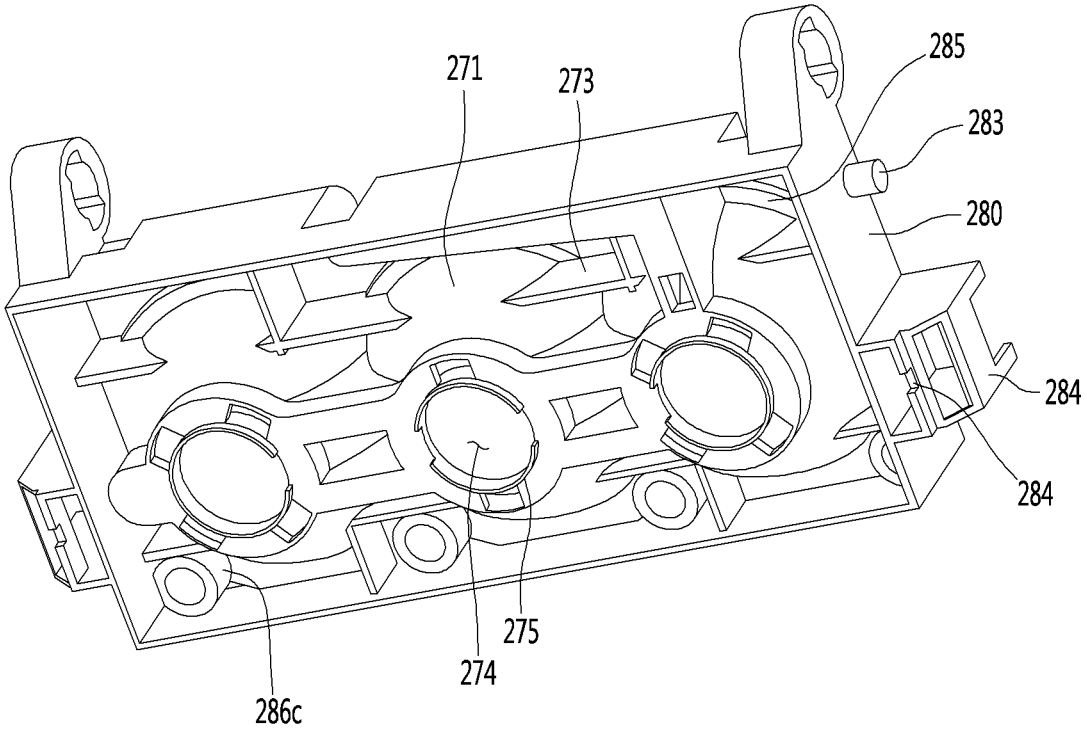
FIG. 25 is a bottom perspective view of the lower support according to an embodiment.
Figure 26:
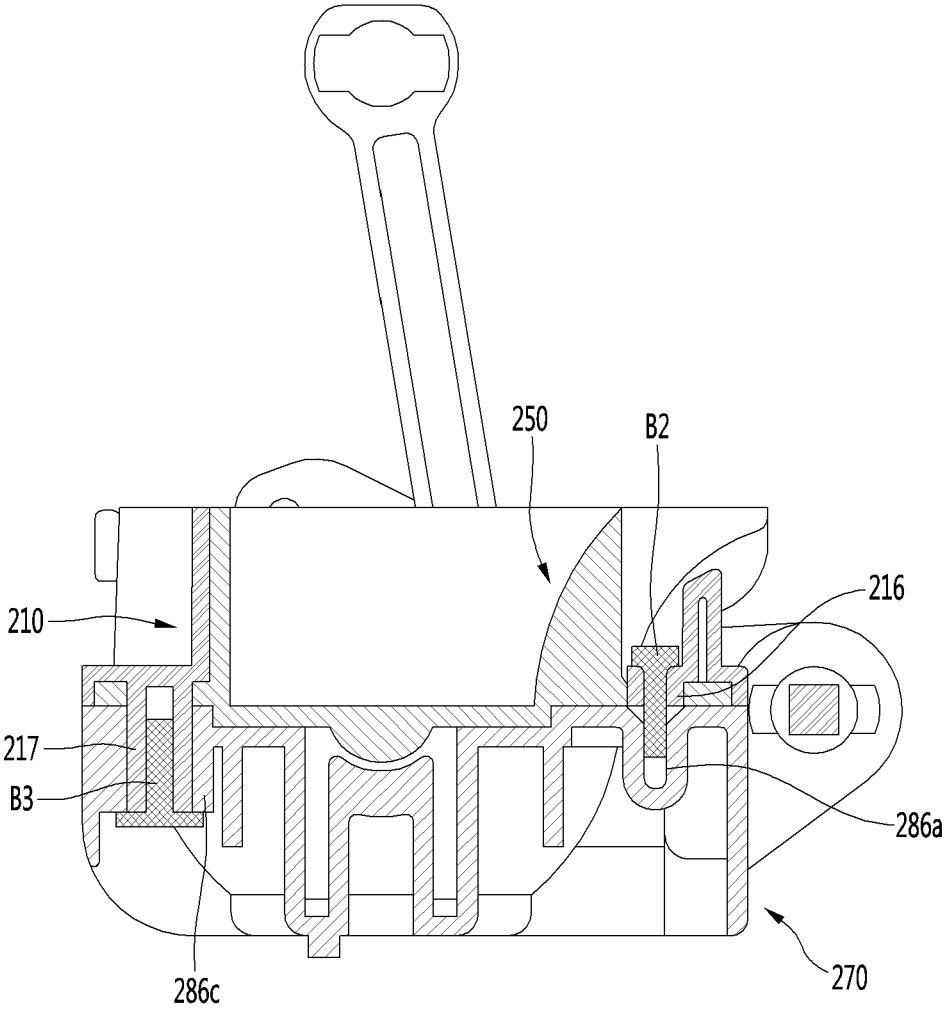
FIG. 26 is a cross-sectional view taken along 26-26 of FIG. 16 for showing the state in which the lower assembly is assembled.

FIG. 24 is a top perspective view of the lower support according to an embodiment, FIG. 25 is a bottom perspective view of the lower support according to an embodiment, and FIG. 26 is a cross-sectional view taken along 26-26 of FIG. 16 for showing the state in which the lower assembly is assembled.

Referring to FIGS. 24 to 26, the lower support 270 may include a support body 271 supporting the lower tray 250.

The support body 271 may include three chamber accommodation parts 272 accommodating the three chamber walls 252*d* of the lower tray 250. The chamber accommodation part 272 may have a hemispherical shape.

The support body 271 may have a lower opening 274 through which the lower ejector 400 passes during the ice separating process. For example, three lower openings 274 may be defined to correspond to the three chamber accommodation parts 272 in the support body 271.

A reinforcement rib 275 reinforcing strength may be disposed along a circumference of the lower opening 274.

Also, the adjacent two accommodation part 272 of the three accommodation part 272 may be connected to each other by a connection rib 273. The connection rib 273 may reinforce strength of the chamber wells 252*d*.

The lower support 270 may further include a first extension wall 285 horizontally extending from an upper end of the support body 271.

The lower support 270 may further include a second extension wall 286 that is formed to be stepped with respect to the first extension wall 285 on an edge of the first extension wall 285.

A top surface of the second extension wall 286 may be disposed higher than the first extension wall 285.

The first extension part 253 of the lower tray 250 may be seated on a top surface 271*a* of the support body 271, and the second extension part 285 may surround side surface of the first extension part 253 of the lower tray 250. Here, the second extension wall 286 may contact the side surface of the first extension part 253 of the lower tray 250.

The lower support 270 may further include a protrusion groove 287 accommodating the first lower protrusion 257 of the lower tray 250.

The protrusion groove 287 may extend in a curved shape. The protrusion groove 287 may be defined, for example, in a second extension wall 286.

The lower support 270 may further include a first coupling groove 286*a* to which a first coupling member B2 passing through the first coupling boss 216 of the upper case 210 is coupled.

The first coupling groove 286*a* may be provided, for example, in the second extension wall 286.

The plurality of first coupling grooves 286*a* may be disposed to be spaced apart from each other in the direction of the arrow A in the second extension wall 286. A portion of the plurality of first coupling grooves 286*a* may be defined between the adjacent two protrusion grooves 287.

The lower support 270 may further include a boss through-hole 286*b* through which the second coupling boss 217 of the upper case 210 passes.

The boss through-hole 286*b* may be provided, for example, in the second extension wall 286. A sleeve 286*c* surrounding the second coupling boss 217 passing through the boss through-hole 286*b* may be disposed on the second extension wall 286. The sleeve 286*c* may have a cylindrical shape with an opened lower portion.

The first coupling member B2 may be coupled to the first coupling groove 286*a* after passing through the first coupling boss 216 from an upper side of the lower case 210.

The second coupling member B3 may be coupled to the second coupling boss 217 from a lower side of the lower support 270.

The sleeve 286*c* may have a lower end that is disposed at the same height as a lower end of the second coupling boss 217 or disposed at a height lower than that of the lower end of the second coupling boss 217.

Thus, while the second coupling member B3 is coupled, the head part of the second coupling member B3 may contact bottom surfaces of the second coupling boss 217 and the sleeve 286*c* or may contact a bottom surface of the sleeve 286*c*.

The lower support 270 may further include an outer wall 280 disposed to surround the lower tray body 251 in a state of being spaced outward from the outside of the lower tray body 251.

The outer wall 280 may, for example, extend downward along an edge of the second extension wall 286.

The lower support 270 may further include a plurality of hinge bodies 281 and 282 respectively connected to hinge supports 135 and 136 of the upper case 210.

The plurality of hinge bodies 281 and 282 may be disposed to be spaced apart from each other in a direction of an arrow A of FIG. 24. Each of the hinge bodies 281 and 282 may further include a second hinge hole 281*a*.

The shaft connection part 353 of the first link 352 may pass through the second hinge hole 281. The connection shaft 370 may be connected to the shaft connection part 353.

A distance between the plurality of hinge bodies 281 and 282 may be less than that between the plurality of hinge supports 135 and 136. Thus, the plurality of hinge bodies 281 and 282 may be disposed between the plurality of hinge supports 135 and 136.

The lower support 270 may further include a coupling shaft 283 to which the second link 356 is rotatably coupled. The coupling shaft 383 may be disposed on each of both surfaces of the outer wall 280.

Also, the lower support 270 may further include an elastic member coupling part 284 to which the elastic member 360 is coupled. The elastic member coupling part 284 may define a space in which a portion of the elastic member 360 is accommodated. Since the elastic member 360 is accommodated in the elastic member coupling part 284 to prevent the elastic member 360 from interfering with the surrounding structure.

Also, the elastic member coupling part 284 may include a hook part 284*a* on which a lower end of the elastic member 370 is hooked.

Figure 28:
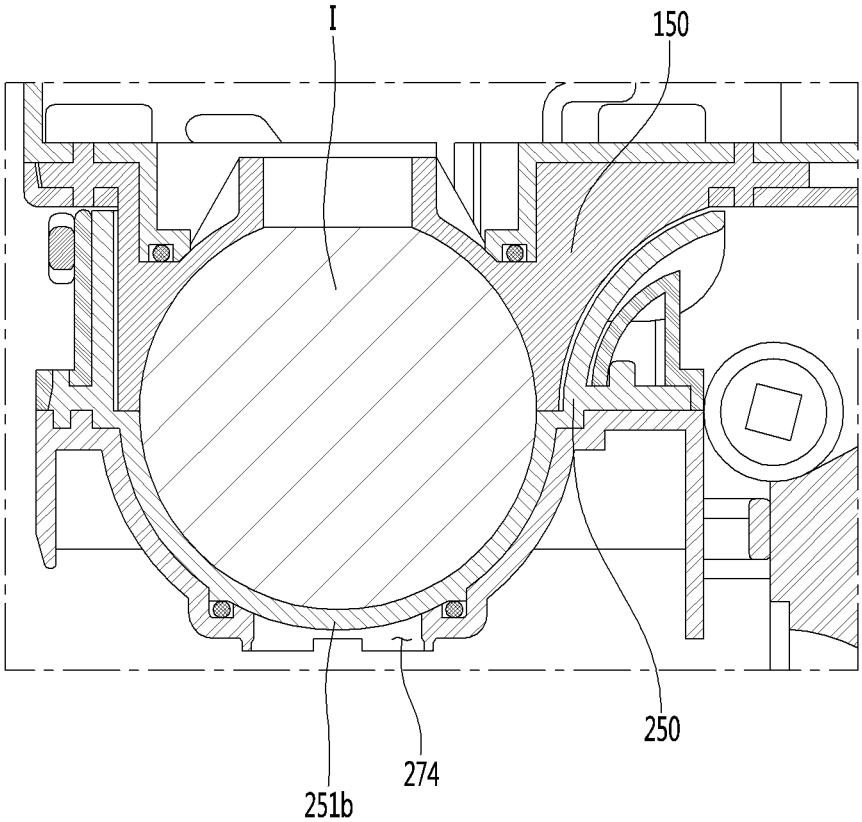
FIG. 28 is a view illustrating the state in which ice is completely made in FIG. 27.

FIG. 27 is a cross-sectional view taken along 27-27 of FIG. 3. FIG. 28 is a view illustrating the state in which ice is completely made in FIG. 27.

Referring to FIGS. 24 to 28, a lower heater 296 may be mounted on the lower supporter 270.

The lower heater 297 may provide the heat to the ice chamber 111 during the ice making process so that ice within the ice chamber 111 is frozen from an upper side.

Also, since lower heater 296 generates heat in the ice making process, bubbles within the ice chamber 111 may move downward during the ice making process. When the ice is completely made, a remaining portion of the spherical ice except for the lowermost portion of the ice may be transparent. According to this embodiment, the spherical ice that is substantially transparent may be made.

For example, the lower heater 296 may be a wire-type heater.

The lower heater 296 may be located between the lower tray 250 and the lower support 270.

The lower heater 296 may be installed on the lower support 270. Also, the lower heater 296 may contact the lower tray 250 to provide heat to the lower chamber 252.

For example, the lower heater 296 may contact the lower tray body 251. Also, the lower heater 296 may be disposed to surround the three chamber walls 252*d* of the lower tray body 251.

In one example, the lower heater 296 may be in contact with the lower tray body 251. The lower heater 296 may be arranged to surround the three chamber walls 252*d* of the lower tray body 251.

The lower support 270 may include a heater accommodation groove 291 to be concave downward from the chamber accommodation part 272 of the lower tray body 251.

The upper tray 150 and the lower tray 250 vertically contact each other to complete the ice chamber 111.

The bottom surface 151*a* of the upper tray body 151 contacts the top surface 251*e* of the lower tray body 251.

Here, in the state in which the top surface 251*e* of the lower tray body 251 contacts the bottom surface 151*a* of the upper tray body 151, elastic force of the elastic member 360 is applied to the lower support 270.

The elastic force of the elastic member 360 may be applied to the lower tray 250 by the lower support 270, and thus, the top surface 251*e* of the lower tray body 251 may press the bottom surface 151*a* of the upper tray body 151.

Thus, in the state in which the top surface 251*e* of the lower tray body 251 contacts the bottom surface 151*a* of the upper tray body 151, the surfaces may be pressed with respect to each other to improve the adhesion.

As described above, when the adhesion between the top surface 251*e* of the lower tray body 251 and the bottom surface 151*a* of the upper tray increases, a gap between the two surface may not occur to prevent ice having a thin band shape along a circumference of the spherical ice from being made after the ice making is completed.

The first extension part 253 of the lower tray 250 is seated on the top surface 271*a* of the support body 271 of the lower support 270. Also, the second extension wall 286 of the lower support 270 contacts a side surface of the first extension part 253 of the lower tray 250.

The second extension part 254 of the lower tray 250 may be seated on the second extension wall 286 of the lower support 270.

In the state in which the bottom surface 151*a* of the upper tray body 151 is seated on the top surface 251*e* of the lower tray body 251, the upper tray body 151 may be accommodated in an inner space of the circumferential wall 260 of the lower tray 250.

Here, the vertical wall 153*a* of the upper tray body 151 may be disposed to face the vertical wall 260*a* of the lower tray 250, and the curved wall 153*b* of the upper tray body 151 may be disposed to face the second wall 260*b* of the lower tray 250.

An outer face of the chamber wall 153 of the upper tray body 151 is spaced apart from an inner face of the circumferential wall 260 of the lower tray 250. That is, a space may be defined between the outer face of the chamber wall 153 of the upper tray body 151 and the inner face of the circumferential wall 260 of the lower tray 250.

Water supplied through the water supply part 180 is accommodated in the ice chamber 111. When a relatively large amount of water than a volume of the ice chamber 111 is supplied, water that is not accommodated in the ice chamber 111 may flow into the space between the outer face of the chamber wall 153 of the upper tray body 151 and the inner face of the circumferential wall 260 of the lower tray 250.

Thus, according to this embodiment, even though a relatively large amount of water than the volume of the ice chamber 111 is supplied, the water may be prevented from overflowing from the ice maker 100.

In the state in which the top surface 251*e* of the lower tray body 251 contacts the bottom surface 151*a* of the upper tray body 151, an upper surface of the circumferential wall 260 may be positioned higher than the upper chamber 152 or the upper opening 154 of the upper tray 150.

A heater contact part 251*a* for allowing the contact area with the lower heater 296 to increase may be further provided on the lower tray body 251.

The heater contact portion 251*a* may protrude from the bottom surface of the lower tray body 251. In one example, the heater contact portion 251*a* may be formed in a ring shape and disposed on the bottom surface of the lower tray body 251. The bottom surface of the heater contact portion 251*a* may be planar.

Without being limited to, the lower heater 296 may be positioned lower than an intermediate point of the height of the lower chamber 252 in the state in which the lower heater 296 contacts the heater contact portion 251*a*.

The lower tray body 251 may further include a convex portion 251*b* in which a portion of the lower portion of the lower tray body 251 is convex upward. That is, the convex portion 251*b* may be convex toward the inside of the ice chamber 111.

A recess 251*c* may be defined below the convex portion 251*b* so that the convex portion 251*b* has substantially the same thickness as the other portion of the lower tray body 251.

In this specification, the "substantially the same" is a concept that includes completely the same shape and a shape that is not similar but there is little difference.

The convex portion 251*b* may be disposed to vertically face the lower opening 274 of the lower support 270.

The lower opening 274 may be defined just below the lower chamber 252. That is, the lower opening 274 may be defined just below the convex portion 251*b*.

The convex portion 251*b* may have a diameter D less than that D2 of the lower opening 274.

When cold air is supplied to the ice chamber 111 in the state in which the water is supplied to the ice chamber 111, the liquid water is phase-changed into solid ice. Here, the water may be expanded while the water is changed in phase. The expansive force of the water may be transmitted to each of the upper tray body 151 and the lower tray body 251.

In case of this embodiment, although other portions of the lower tray body 251 are surrounded by the support body 271, a portion (hereinafter, referred to as a "corresponding portion") corresponding to the lower opening 274 of the support body 271 is not surrounded.

If the lower tray body 251 has a complete hemispherical shape, when the expansive force of the water is applied to the corresponding portion of the lower tray body 251 corresponding to the lower opening 274, the corresponding portion of the lower tray body 251 is deformed toward the lower opening 274.

In this case, although the water supplied to the ice chamber 111 exists in the spherical shape before the ice is made, the corresponding portion of the lower tray body 251 is deformed after the ice is made. Thus, additional ice having a projection shape may be made from the spherical ice by a space occurring by the deformation of the corresponding portion.

Thus, in this embodiment, the convex portion 251*b* may be disposed on the lower tray body 251 in consideration of the deformation of the lower tray body 251 so that the ice has the completely spherical shape.

In this embodiment, the water supplied to the ice chamber 111 is not formed into a spherical form before the ice is generated. After the generation of the ice is completed, the convex portion 251*b* of the lower tray body 251 is deformed toward the lower opening 274, such that the spherical ice may be generated.

In the present embodiment, the diameter D1 of the convex portion 251*b* is smaller than the diameter D2 of the lower opening 274, such that the convex portion 251 *b* may be deformed and positioned inside the lower opening 274.

Figure 29:
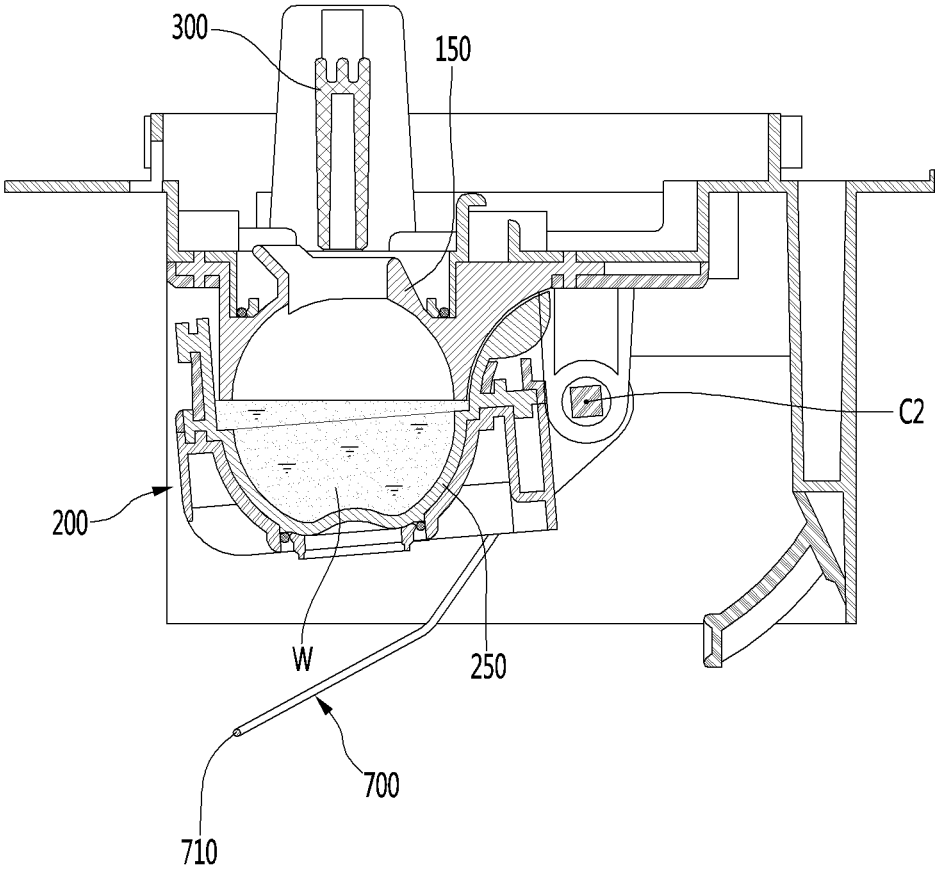
FIG. 29 is a cross-sectional view taken along 29-29 of FIG. 3 in the state in which water is supplied.
Figure 30:
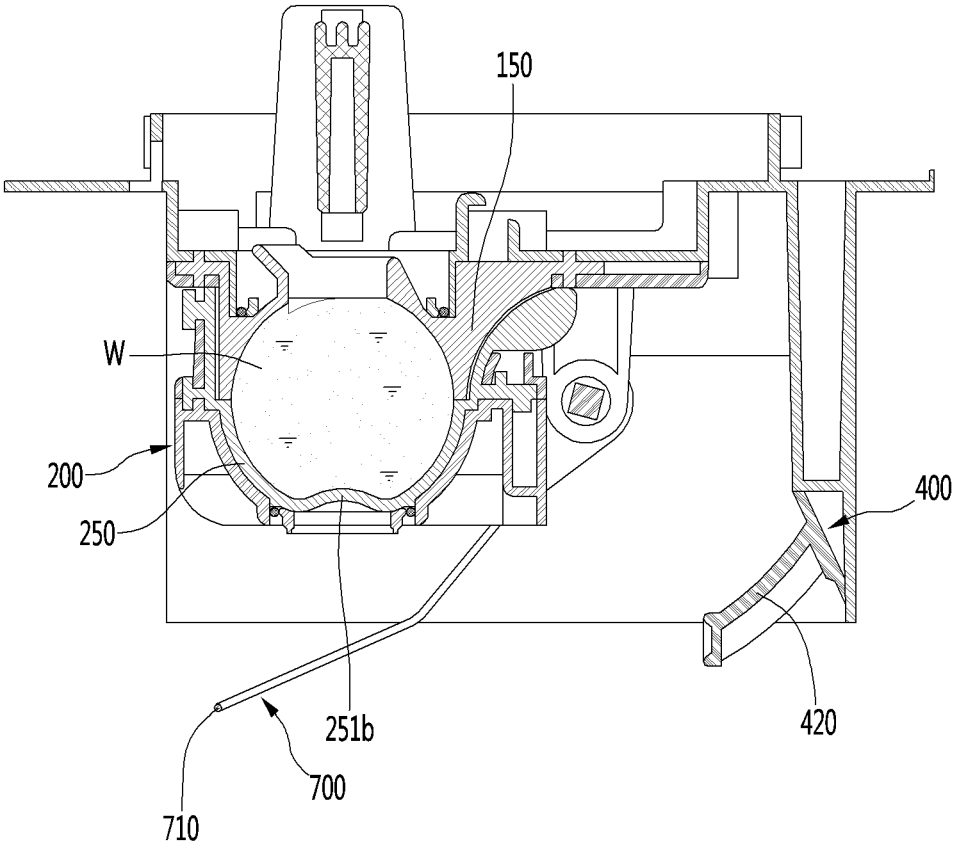
FIG. 30 is a cross-sectional view taken along 29-29 of FIG. 3 in the state in which ice is made.

FIG. 29 is a cross-sectional view taken along 29-29 of FIG. 3 in the state in which water is supplied. FIG. 30 is a cross-sectional view taken along 29-29 of FIG. 3 in the state in which ice is made.

Figure 31:
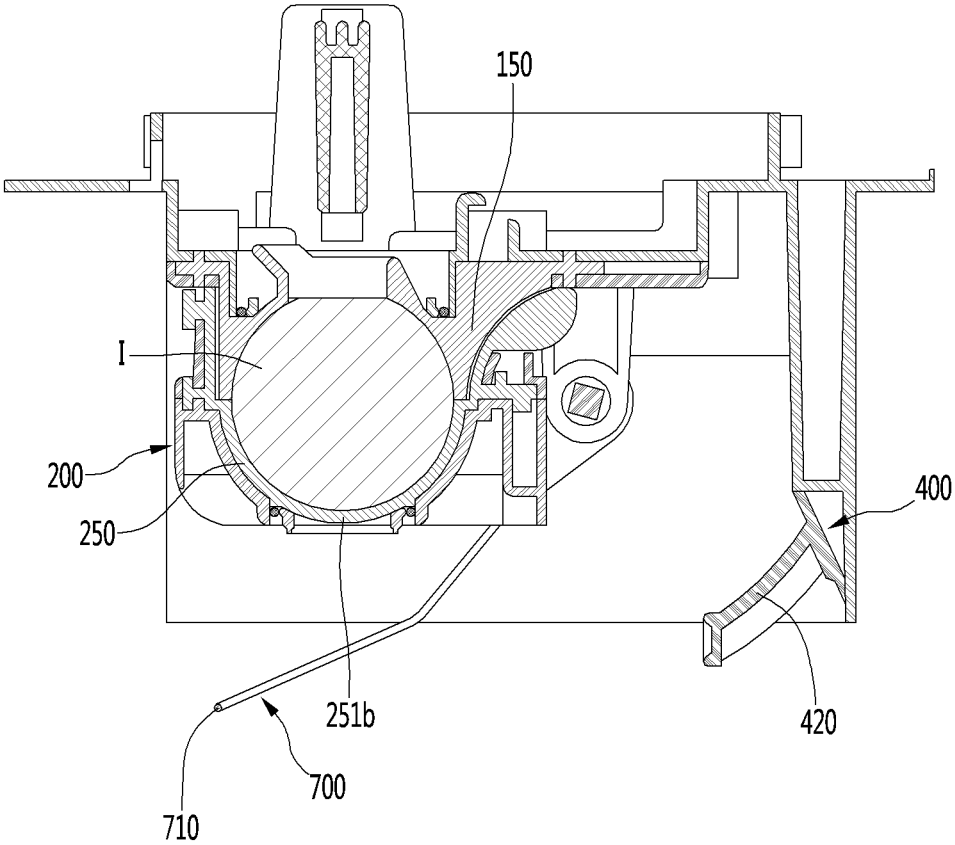
FIG. 31 is a cross-sectional view taken along 29-29 of FIG. 2 in the state in which ice is completely made.
Figure 32:
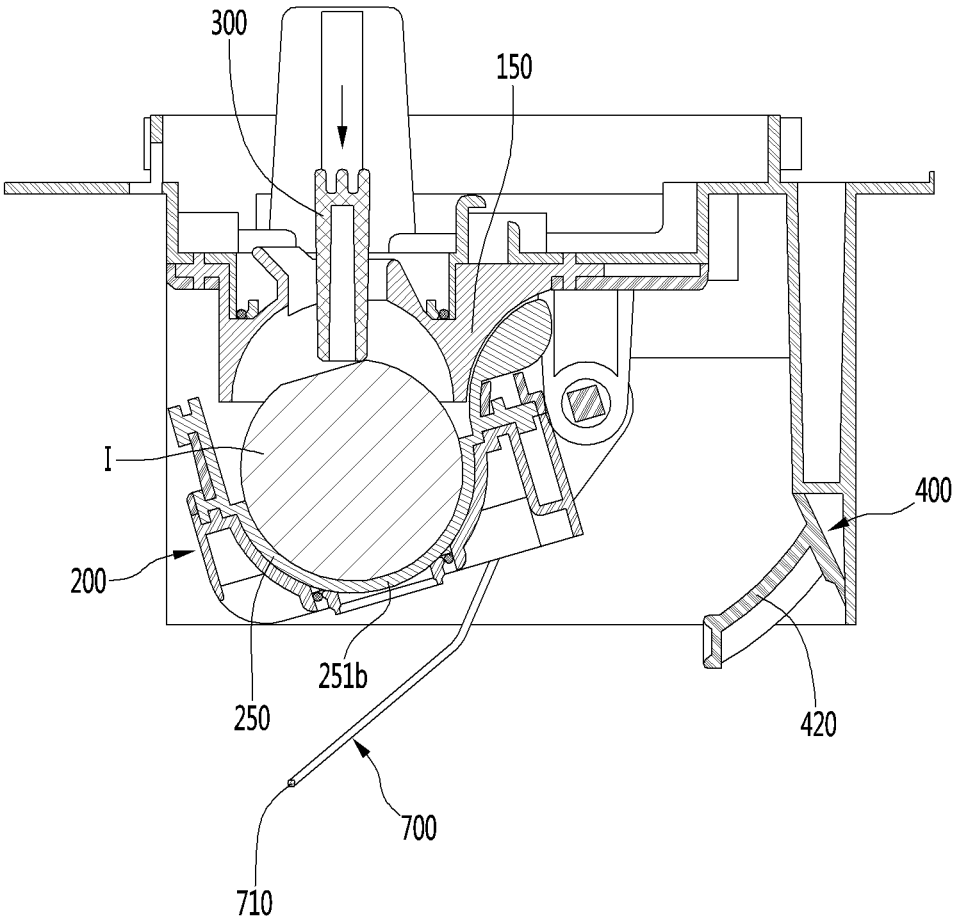
FIG. 32 is a cross-sectional view taken along 29-29 of FIG. 3 in an early stage in which ice is transferred.
Figure 33:
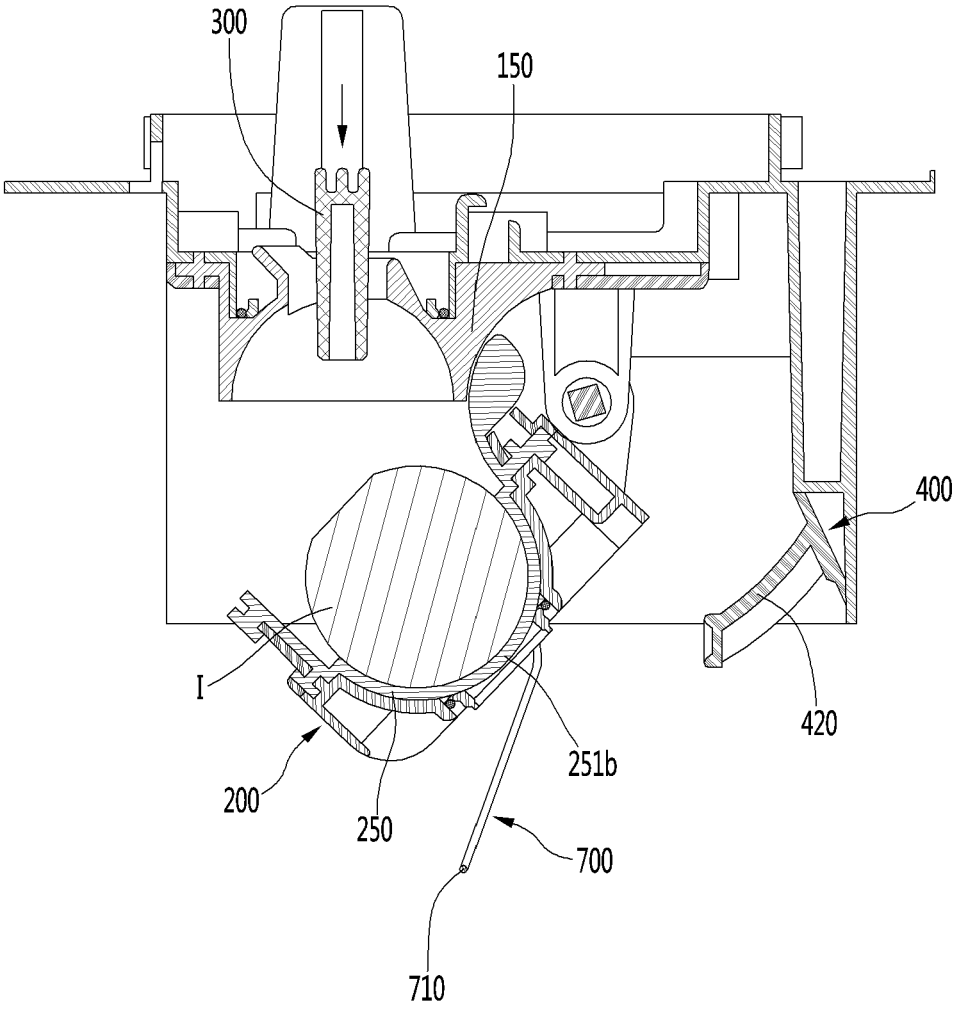
FIG. 33 is a cross-sectional view taken along 29-29 of FIG. 3 at a position at which full ice is detected.
Figure 34:
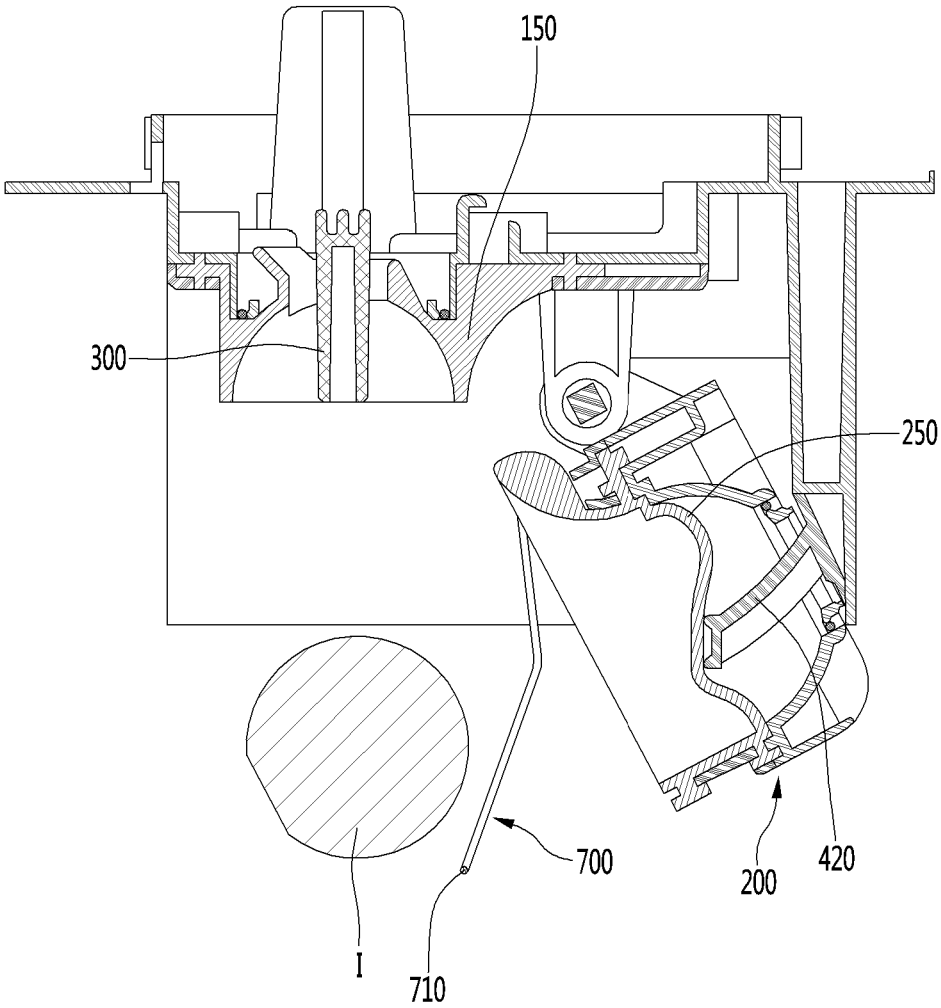
FIG. 34 is a cross-sectional view taken along 29-29 of FIG. 3 at a position at which ice is completely transferred.

FIG. 31 is a cross-sectional view taken along 29-29 of FIG. 2 in the state in which ice is completely made. FIG. 32 is a cross-sectional view taken along 29-29 of FIG. 3 in an early stage in which ice is transferred. FIG. 33 is a cross-sectional view taken along 29-29 of FIG. 3 at a position at which full ice is detected. FIG. 34 is a cross-sectional view taken along 29-29 of FIG. 3 at a position at which ice is completely transferred.

Referring to FIGS. 29 to 34, first, the lower assembly 200 rotates to a water supply position.

The top surface 251*e* of the lower tray 250 is spaced apart from the bottom surface 151*e* of the upper tray 150 at the water supply position of the lower assembly 200.

Although not limited, the bottom surface 151*e* of the upper tray 150 may be disposed at a height that is equal or similar to a rotational center C2 of the lower assembly 200.

In this embodiment, the direction in which the lower assembly 200 rotates (in a counterclockwise direction in the drawing) is referred to as a forward direction, and the opposite direction (in a clockwise direction) is referred to as a reverse direction.

Although not limited, an angle between the top surface 251*e* of the lower tray 250 and the bottom surface 151*e* of the upper tray 150 at the water supply position of the lower assembly 200 may be about 8 degrees.

The detection body 710 may be positioned below the lower assembly 200 at a water supply position of the lower assembly 200.

In this state, the water is guided by the water supply part 190 and supplied to the ice chamber 111.

In this connection, the water is supplied to the ice chamber 111 through one upper opening of the plurality of upper openings 154 of the upper tray 150.

In the state in which the supply of the water is completed, a portion of the supplied water may be fully filled into the lower chamber 252, and the other portion of the supplied water may be fully filled into the space between the upper tray 150 and the lower tray 250.

For example, the upper chamber 151 may have the same volume as that of the space between the upper tray 150 and the lower tray 250. Thus, the water between the upper tray 150 and the lower tray 250 may be fully filled in the upper tray 150. In another example, the volume of the upper chamber 152 may be smaller than the volume of the space between the upper tray 150 and the lower tray 250. In this case, water may also be positioned in the upper chamber 152.

In case of this embodiment, a channel for communication between the three lower chambers 252 may be provided in the lower tray 250.

As described above, although the channel for the flow of the water is not provided in the lower tray 250, since the top surface 251*e* of the lower tray 250 and the bottom surface 151*e* of the upper tray 150 are spaced apart from each other, the water may flow to the other lower chamber along the top surface 251*e* of the lower tray 250 when the water is fully filled in a specific lower chamber in the water supply process.

Thus, the water may be fully filled in each of the plurality of lower chambers 252 of the lower tray 250.

In the case of this embodiment, since the channel for the communication between the lower chambers 252 is not provided in the lower tray 250, additional ice having a projection shape around the ice after the ice making process may be prevented being made.

In the state in which the supply of the water is completed, as illustrated in FIG. 30, the lower assembly 200 rotates reversely. When the lower assembly 200 rotates reversely, the top surface 251*e* of the lower tray 250 is close to the bottom surface 151*e* of the upper tray 150.

Thus, the water between the top surface 251*e* of the lower tray 250 and the bottom surface 151*e* of the upper tray 150 may be divided and distributed into the plurality of upper chambers 152.

Also, when the top surface 251*e* of the lower tray 250 and the bottom surface 151*e* of the upper tray 150 are closely attached to each other, the water may be fully filled in the upper chamber 152.

In the state in which the top surface 251*e* of the lower tray 250 and the bottom surface 151*e* of the upper tray 150 are closely attached to each other, a position of the lower assembly 200 may be called an ice making position. The detection body 710 may be positioned below the lower assembly 200 at a position of the lower assembly 200, at which ice is made.

In the state in which the lower assembly 200 moves to the ice making position, ice making is started.

Since pressing force of water during ice making is less than the force for deforming the convex portion 251*b* of the lower tray 250, the convex portion 251*b* may not be deformed to maintain its original shape.

When the ice making is started, the lower heater 296 is turned on. When the lower heater 296 is turned on, heat of the lower heater 296 is transferred to the lower tray 250.

Thus, when the ice making is performed in the state where the lower heater 296 is turned on, ice may be made from the upper side in the ice chamber 111.

According to the present embodiment, mass (or volume) of water per unit height may be constant or changed in the ice chamber 111 according to a shape of the ice chamber 111.

For example, when the ice chamber 111 is shaped like a rectangle, mass (or volume) of water per unit height may be constant in the ice chamber 111.

In contrast, when the ice chamber 111 has a shape of a circle, an inverted triangle, or a crescent moon, mass (or volume) of water per unit height may be changed.

Assuming that the temperature and amount of cool air supplied to the freezing compartment 4 are constant, when output of the lower heater 296 is constant, mass of water per unit height may be changed in the ice chamber 111, and thus ice per unit height may be generated at different speeds.

For example, when mass of water per unit height is small, ice may be rapidly generated, but when mass of water per unit height is high, ice may be slowly generated.

As a result, a speed at which ice per unit height of water is not constant, and thus transparency of ice may be changed for each unit height. In particular, when ice is rapidly generated, bubbles do not move toward water from ice, and thus ice includes bubbles, thereby reducing transparency.

Thus, according to the present embodiment, output of the lower heater 296 may be controlled to be varied depending on mass of water per unit height in the ice chamber 111.

Like in the present embodiment, for example, when the ice chamber 111 is formed like a sphere, mass of water per unit height in the ice chamber 111 may be increased to a maximum downward from an upper side and may be re-decreased.

Thus, after the lower heater 296 is turned on, output of the lower heater 296 may be sequentially reduced and may be minimized at a point when mass of water per unit height. Then, output of the lower heater 296 may be sequentially increased as mass of water per unit height is reduced.

Thus, ice is generated from an upper side in the ice chamber 111, and thus bubbles in the ice chamber 111 may be moved downward.

In the process where ice is generated from a top to a bottom in the ice chamber 111, the ice comes into contact with the top surface of the convex portion 251*b* of the lower tray 250.

In this state, when the ice is continuously made, the block part 251*b* may be pressed and deformed as shown in FIG. 31, and the spherical ice may be made when the ice making is completed.

A control unit (not shown) may determine whether the ice making is completed based on the temperature sensed by the temperature sensor 500.

The lower heater 296 may be turned off at the ice-making completion or before the ice-making completion.

When the ice-making is completed, the upper heater 148 is first turned on for the ice-removal of the ice. When the upper heater 148 is turned on, the heat of the upper heater 148 is transferred to the upper tray 150, and thus, the ice may be separated from the surface (the inner face) of the upper tray 150.

After the upper heater 148 has been activated for a set time duration, the upper heater 148 may be turned off and then the drive unit 180 may be operated to rotate the lower assembly 200 in a forward direction.

As illustrated in FIG. 32, when the lower assembly 200 rotates forward, the lower tray 250 may be spaced apart from the upper tray 150.

Also, the rotation force of the lower assembly 200 may be transmitted to the upper ejector 300 by the connector 350. Thus, the upper ejector 300 descends by the unit guides 181 and 182, and the upper ejecting pin 320 may be inserted into the upper chamber 152 through the upper opening 154.

In the ice separating process, the ice may be separated from the upper tray 250 before the upper ejecting pin 320 presses the ice. That is, the ice may be separated from the surface of the upper tray 150 by the heat of the upper heater 148.

In this case, the ice may rotate together with the lower assembly 200 in the state of being supported by the lower tray 250.

Alternatively, even though the heat of the upper heater 148 is applied to the upper tray 150, the ice may not be separated from the surface of the upper tray 150.

Thus, when the lower assembly 200 rotates forward, the ice may be separated from the lower tray 250 in the state in which the ice is closely attached to the upper tray 150.

In this state, while the lower assembly 200 rotates, the upper ejecting pin 320 passing through the upper opening 154 may press the ice closely attached to the upper tray 150 to separate the ice from the upper tray 150. The ice separated from the upper tray 150 may be supported again by the lower tray 250.

When the ice rotates together with the lower assembly 200 in the state in which the ice is supported by the lower tray 250, even though external force is not applied to the lower tray 250, the ice may be separated from the lower tray 250 by the self-weight thereof.

Like in FIG. 33, during a procedure in which the lower assembly 200 is moved at the correct position, the full ice detection lever 700 may be moved to a full ice detection position. In this case, when the ice bin 102 is not filled with ice, the full ice detection lever 700 may be moved to the full ice detection position.

In the state in which the full ice detection lever 700 is moved to the full ice detection position, the full ice detection lever 700 may be positioned below the lower assembly 200.

While the lower assembly 200 rotates, even though the ice is not separated from the lower tray 250 by the self-weight thereof, when the lower tray 250 is pressed by the lower ejector 400 as shown in FIG. 34, the ice may be separated from the lower tray 250.

Particularly, while the lower assembly 200 rotates, the lower tray 250 may contact the lower ejecting pin 420.

When the lower assembly 200 continuously rotates forward, the lower ejecting pin 420 may press the lower tray 250 to deform the lower tray 250, and the pressing force of the lower ejecting pin 420 may be transmitted to the ice to separate the ice from the lower tray 250. The ice separated from the surface of the lower tray 250 may drop downward and be stored in the ice bin 102.

After the ice is separated from the lower tray 250, the lower assembly 200 may be rotated in the reverse direction by the drive unit 180.

When the lower ejecting pin 420 is spaced apart from the lower tray 250 in a process in which the lower assembly 200 is rotated in the reverse direction, the deformed lower tray 250 may be restored to its original form.

In the reverse rotation process of the lower assembly 200, the rotational force is transmitted to the upper ejector 300 by the connecting unit 350, such that the upper ejector 300 is raised, and thus, the upper ejecting pin 320 is removed from the upper chamber 152.

When the lower assembly 200 reaches the water supply position, the drive unit 180 is stopped, and then water supply starts again.

According to the proposed embodiment, cool air passing through a cool air hole may be concentrated into an upper side of an ice chamber by a cool air guide, and thus a plurality of ices may be generated at uniform speeds and may be maintained in a spherical shape, thereby preventing completely made ices from being connected to each other.

According to the present embodiment, a speed at which ice is generated may be delayed by a lower heater for supplying heat to an ice chamber, and bubbles may be moved toward water from a portion at which ice is generated, and accordingly, transparent ice may be advantageously made.

According to the present embodiment, irrespective of a type of a refrigerator including an ice maker installed therein, cool air passing through the cool air hole may flow, and thus a flowing pattern of the cool air may be almost constant. Thus, the transparency of ice may be advantageously uniform irrespective of a type of the refrigerator.

According to the present embodiment, a side wall including a driver installed thereon for rotating a lower tray may be prevented from being deformed, and thus the driver and the lower assembly may be prevented from being separated from each other during a procedure in which the lower tray repeatedly reciprocates.

According to the present embodiment, a lower tray may include an anti-deformation protrusion, and thus may be prevented from being deformed by interference with the upper tray during a rotation procedure of the lower tray, and accordingly, ice may be prevented from being made with a non-spherical shape in a next procedure of making ice.

What is claimed is:

1. An ice maker comprising:

a first tray and a second tray, the first and second trays being configured to come together to define a plurality of ice chambers for making ice; and a case comprising:

a first guide through which cool air passes, a plate defining a tray opening, and a second guide comprising one end positioned adjacent to the first guide and another end positioned adjacent to the tray opening such that the cool air passing through the first guide flows toward the tray opening, wherein each of the first tray and the second tray comprises a chamber wall having (i) an inner surface that defines the plurality of ice chambers and (ii) an outer surface, wherein the tray opening is disposed above the chamber wall, wherein at least a portion of the outer surface of the chamber wall is exposed, through the tray opening, to the cool air passing through the first guide to thereby come in contact with the cool air passing through the first guide, and wherein the second guide is disposed on an upper surface of the plate, and the second guide and the upper surface of the plate form a guidance path from the first guide to the tray opening, a cross-sectional area of at least a portion of the guidance path being decreased in a direction away from the first guide.

2. The ice maker of claim 1, wherein the plurality of ice chambers comprises a first chamber that is positioned closest to the first guide and a second chamber adjacent to the first chamber.

3. The ice maker of claim 2, wherein the second guide has a first end positioned closer to the first guide than the first chamber, and a second end positioned closer to the second chamber than the first guide.

4. The ice maker of claim 2, wherein the second guide comprises:

a second-first guide extended from the plate and having one end positioned adjacent to the first guide and another end positioned adjacent to the tray opening, and a second-second guide extended from the plate and spaced apart from the second-first guide, the second-second guide having one end positioned adjacent to the first guide and another end positioned adjacent to the tray opening.

5. The ice maker of claim 4, wherein the second-first guide and the second-second guide form the guidance path.

6. The ice maker of claim 4, wherein the plurality of ice chambers are arranged in a first direction to be away from the first guide, and wherein a first imaginary line that bisects the first guide and extends in the first direction is spaced apart from a second imaginary line that connects centers of the plurality of ice chambers.

7. The ice maker of claim 6, wherein the first imaginary line penetrates the second-first guide after passing along the guidance path.

8. The ice maker of claim 6, wherein one end of the second-first guide positioned at an opposite side to the second imaginary line based on the first imaginary line.

9. The ice maker of claim 8, wherein the plurality of ice chambers includes a first ice chamber and a second ice chamber, and wherein the other end of the second-first guide is positioned closer to the second ice chamber than to the first ice chamber.

10. The ice maker of claim 9, wherein at least a portion of the second-first guide is curved along a direction from one end of the second-first guide to the other end of the second-first guide.

11. The ice maker of claim 9, wherein one end of the second-second guide is positioned at an opposite side to the one end of the second-first guide in the first guide, and at least a portion of the first ice chamber is positioned between the other end of the second-first guide and the other end of the second-second guide.

12. The ice maker of claim 4, wherein the case defines a through-opening through which the cool air flows, and the second guide is configured to guide the cool air passing through the first guide to flow toward the plurality of ice chambers before flowing toward the through-opening.

13. The ice maker of claim 12, wherein the through-opening comprises:

a first through-opening positioned adjacent to the first guide; and a second through-opening spaced apart from the first through-opening, wherein a portion of the tray opening is positioned between the first through-opening and the second through-opening.

14. The ice maker of claim 13, wherein the second-second guide positioned closer to the first through-opening than the second-first guide.

15. The ice maker of claim 12, further comprising:

an ejector configured to separate an ice from the first tray;

a support configured to support the second tray; and a connector that connects the support and the ejector through the through-opening.

16. The ice maker of claim 1, wherein the case further comprises a third guide that is configured to guide the cool air passing through the first guide and that extends from a position that is same or lower than a lowermost point of the first guide.

17. The ice maker of claim 1, wherein the plurality of ice chambers arranged along a line in a direction to be away from the first guide.

18. The ice maker of claim 1, wherein a portion of the first tray passes through the tray opening.

19. The ice maker of claim 1, wherein the first tray defines a plurality of first openings configured to guide the cool air to the plurality of ice chambers.

20. The ice maker of claim 1, wherein the second guide is configured to receive air that has passed through the first guide, the second guide being configured to guide the received air from the one end toward the tray opening via the another end.

21. The ice maker of claim 1, wherein the plate is disposed over the first tray.

22. A refrigerator comprising:

a storage compartment configured to store a food object; and an ice maker configured to phase-change water of an ice chamber to ice by cool air supplied to the storage compartment, wherein the ice maker includes first and second trays configured to form a plurality of ice chambers, and a case configured to support the first tray;

wherein the case comprises:

a first guide through which the cool air passes, a plate defining a tray opening, and a second guide comprising one end positioned adjacent to the first guide and another end positioned adjacent to the tray opening such that the cool air passing through the first guide flows toward the tray opening, wherein each of the first tray and the second tray comprises a chamber wall having (i) an inner surface that defines the plurality of ice chambers and (ii) an outer surface, wherein the tray opening is disposed above the chamber wall, wherein at least a portion of the outer surface of the chamber wall is exposed, through the tray opening, to the cool air passing through the first guide to thereby come in contact with the cool air passing through the first guide, and wherein the second guide is disposed on an upper surface of the plate, and the second guide and the upper surface of the plate form a guidance path from the first guide to the tray opening, a cross-sectional area of at least a portion of the guidance path being decreased in a direction away from the first guide.

23. The refrigerator of claim 22, wherein the plate is disposed over the first tray.

* * * * *